US010286693B2

(12) United States Patent
Ishida et al.

(10) Patent No.: US 10,286,693 B2
(45) Date of Patent: May 14, 2019

(54) PRINTING APPARATUS

(71) Applicant: BROTHER KOGYO KABUSHIKI KAISHA, Nagoya-shi, Aichi-ken (JP)

(72) Inventors: Minako Ishida, Nagoya (JP); Junya Kawai, Kiyosu (JP); Naoto Ito, Nagoya (JP); Shuhei Nohara, Kasugai (JP); Harumitsu Inoue, Toki (JP); Yukihiko Sato, Nagoya (JP); Haruki Matsumoto, Nagoya (JP); Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/715,283

(22) Filed: Sep. 26, 2017

(65) Prior Publication Data

US 2018/0281480 A1 Oct. 4, 2018

(30) Foreign Application Priority Data

Mar. 31, 2017 (JP) ..... 2017-073186

(51) Int. Cl.
*B41J 3/407* (2006.01)
*B41J 13/00* (2006.01)
*B41J 11/00* (2006.01)

(52) U.S. Cl.
CPC ..... *B41J 13/0045* (2013.01); *B41J 3/4075* (2013.01); *B41J 11/008* (2013.01)

(58) Field of Classification Search
CPC ..... B41J 3/4075; B41J 3/4073
See application file for complete search history.

(56) References Cited

U.S. PATENT DOCUMENTS

2004/0189733 A1* 9/2004 Yamamoto ..... B41J 3/4075 347/19
2009/0277570 A1* 11/2009 Caveney ..... G09F 3/0295 156/184

FOREIGN PATENT DOCUMENTS

JP 2011-524154 A 8/2011

* cited by examiner

*Primary Examiner* — Jason S Uhlenhake
(74) *Attorney, Agent, or Firm* — Scully, Scott, Murphy & Presser, PC

(57) ABSTRACT

A printing apparatus includes: a conveyor configured to convey a medium including a transparent base layer and a separation layer stacked on each other, the medium further including a printing background layer; a printer configured to print a character on the medium conveyed by the conveyor, wherein the medium on which the character is printed is a printed medium; and a controller configured to control the conveyor and the printer. The controller is configured to: obtain outside-diameter relating information relating to an outside diameter of a wrapped member; and based on the obtained outside-diameter relating information, set a character printable region in which the printer is allowed to print the character on the printing background layer.

22 Claims, 52 Drawing Sheets

FIG.16

| RIGHT-AND-LEFT-MARGIN TABLE | | |
|---|---|---|
| CONDITION | | OBTAINED VALUE |
| WIDTH OF PRINT TAPE | OUTSIDE DIAMETER OF WRAPPED MEMBER | LENGTH OF MARGIN |
| 50.8mm | 9.1mm | 1mm |
| 50.8mm | 8.1mm | 1mm |
| 50.8mm | 7.1mm | 1mm |
| 50.8mm | 6.1mm | 1mm |
| 50.8mm | 5.1mm | 2mm |
| 50.8mm | 4.1mm | 2mm |
| ∘ | ∘ | ∘ |
| ∘ | ∘ | ∘ |
| ∘ | ∘ | ∘ |
| ∘ | ∘ | ∘ |
| ∘ | ∘ | ∘ |

FIG.35

| CHARACTER-STRING-PRINTABLE-REGION TABLE | | | | | |
|---|---|---|---|---|---|
| CONDITION | | OBTAINED VALUE | | | |
| WIDTH OF PRINT TAPE | OUTSIDE DIAMETER OF WRAPPED MEMBER | LOWER END OF CHARACTER-STRING PRINTABLE REGION | HEIGHT OF CHARACTER-STRING PRINTABLE REGION | MAXIMUM NUMBER OF LINES | MAXIMUM CHARACTER SIZE |
| 50.8mm | 9.1mm | 29.6mm | 6.4mm | TWO | 17pt |
| 50.8mm | 8.1mm | 26.4mm | 9.6mm | THREE | 26pt |
| 50.8mm | 7.1mm | 23.3mm | 12.7mm | FOUR | 34p |
| 50.8mm | 6.1mm | 23.3mm | 12.7mm | FOUR | 34p |
| 50.8mm | 5.1mm | 23.3mm | 12.7mm | FOUR | 34p |
| 50.8mm | 4.1mm | 23.3mm | 12.7mm | FOUR | 34p |
| 50.8mm | 3.1mm | 23.3mm | 9.6mm | THREE | 26pt |
| 50.8mm | 2.1mm | 23.3mm | 6.4mm | TWO | 17pt |
| * | * | * | * | * | * |
| * | * | * | * | * | * |
| * | * | * | * | * | * |

FIG.36

| MAXIMUM-NUMBER-OF-LINES TABLE | | |
|---|---|---|
| CONDITION | | OBTAINED VALUE |
| WIDTH OF PRINT TAPE | OUTSIDE DIAMETER OF WRAPPED MEMBER | MAXIMUM NUMBER OF LINES |
| 50.8mm | 9.1mm | — |
| 50.8mm | 8.1mm | TWO |
| 50.8mm | 7.1mm | FOUR |
| 50.8mm | 6.1mm | FOUR |
| 50.8mm | 5.1mm | FOUR |
| 50.8mm | 4.1mm | FOUR |
| 50.8mm | 3.1mm | TWO |
| 50.8mm | 2.1mm | — |
| * | * | * |
| * | * | * |
| * | * | * |

FIG.37

| MAXIMUM-CHARACTER-SIZE TABLE | | |
|---|---|---|
| CONDITION | | OBTAINED VALUE |
| WIDTH OF PRINT TAPE | OUTSIDE DIAMETER OF WRAPPED MEMBER | MAXIMUM CHARACTER SIZE |
| 50.8mm | 9.1mm | — |
| 50.8mm | 8.1mm | 18p |
| 50.8mm | 7.1mm | 34p |
| 50.8mm | 6.1mm | 34p |
| 50.8mm | 5.1mm | 34p |
| 50.8mm | 4.1mm | 34p |
| 50.8mm | 3.1mm | 18p |
| 50.8mm | 2.1mm | — |
| * | * | * |
| * | * | * |
| * | * | * |

FIG.46

| CHARACTER LAYOUT TABLE | | |
|---|---|---|
| CONDITION | | OBTAINED VALUE |
| WIDTH OF PRINT TAPE | OUTSIDE DIAMETER OF WRAPPED MEMBER | CHARACTER LAYOUT |
| 50.8mm | 9.1mm | TOP ALIGNMENT |
| 50.8mm | 8.1mm | TOP ALIGNMENT |
| 50.8mm | 7.1mm | CENTER ALIGNMENT |
| 50.8mm | 6.1mm | CENTER ALIGNMENT |
| 50.8mm | 5.1mm | CENTER ALIGNMENT |
| 50.8mm | 4.1mm | CENTER ALIGNMENT |
| 50.8mm | 3.1mm | BOTTOM ALIGNMENT |
| 50.8mm | 2.1mm | BOTTOM ALIGNMENT |
| × | × | × |
| × | × | × |
| × | × | × |

FIG.52

| | | | | |
|---|---|---|---|---|
| FIRST MARK | ○ | ● | + | ■ |
| SECOND MARK | • | • | × | ▪ |
| AFTER STICKING | ◉ | ● | ✳ | ■ |

PRINTING APPARATUS

CROSS REFERENCE TO RELATED APPLICATION

The present application claims priority from Japanese Patent Application No. 2017-073186, which was filed on Mar. 31, 2017, the disclosure of which is herein incorporated by reference in its entirety.

BACKGROUND

The following disclosure relates to a printing apparatus configured to perform printing on a medium.

There is known a technique for creating a medium to be wrapped around a cable or a circular cylindrical wrapped member. This medium includes a base layer, an adhesive layer, and a separation layer stacked on one another. Desired characters are printed on a background layer provided on a surface of the base layer.

SUMMARY

However, in the case where the outside diameter of the wrapped member is smaller than assumed in advance, when the medium is attached to the wrapped member, a printed portion of the medium may be covered with the background layer, making it impossible or difficult to visually recognize the printed portion.

Accordingly, an aspect of the disclosure relates to a printing apparatus capable of reducing lowering of viewability of a printed character even in the case where the outside diameter of a wrapped member is small.

In one aspect of the disclosure, a printing apparatus includes: a conveyor configured to convey a medium including a transparent base layer and a separation layer stacked on each other in a stacking direction, the medium further including a printing background layer; a printer configured to print a character on the medium conveyed by the conveyor; and a controller configured to control the conveyor and the printer. The controller is configured to: obtain outside-diameter relating information relating to an outside diameter of a wrapped member; and based on the obtained outside-diameter relating information, set a character printable region in which the printer is allowed to print the character on the printing background layer.

In another aspect of the disclosure, a printing apparatus includes: a conveyor configured to convey a medium including a transparent base layer and a separation layer stacked on each other in a stacking direction, the medium further including a printing background layer; a printer configured to print a character on the medium conveyed by the conveyor; and a controller configured to control the conveyor and the printer. The controller is configured to: obtain outside-diameter relating information relating to an outside diameter of a wrapped member; and based on the obtained outside-diameter relating information, set a position of the character in a character printable region in which the printer is allowed to print the character on the printing background layer.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which:

FIG. 16 is a view for explaining a right-and-left-margin table;

FIG. 35 is a view for explaining a character-string-printable-region table;

FIG. 36 is a view for explaining a maximum-number-of-lines table;

FIG. 37 is a view for explaining a maximum-character-size table;

FIG. 46 is a view for explaining a character layout table;

FIG. 52 is a view illustrating a table representing examples of shapes each formed by a first mark and a second mark overlapping each other after being stuck together.

DETAILED DESCRIPTION OF THE EMBODIMENTS

Hereinafter, there will be described embodiments by reference to the drawings.

There will be described a first embodiment with reference to FIGS. 1-21.

Label Creating Apparatus

There will be described a label creating apparatus according to the present embodiment with reference to FIG. 1.

Figure 1:
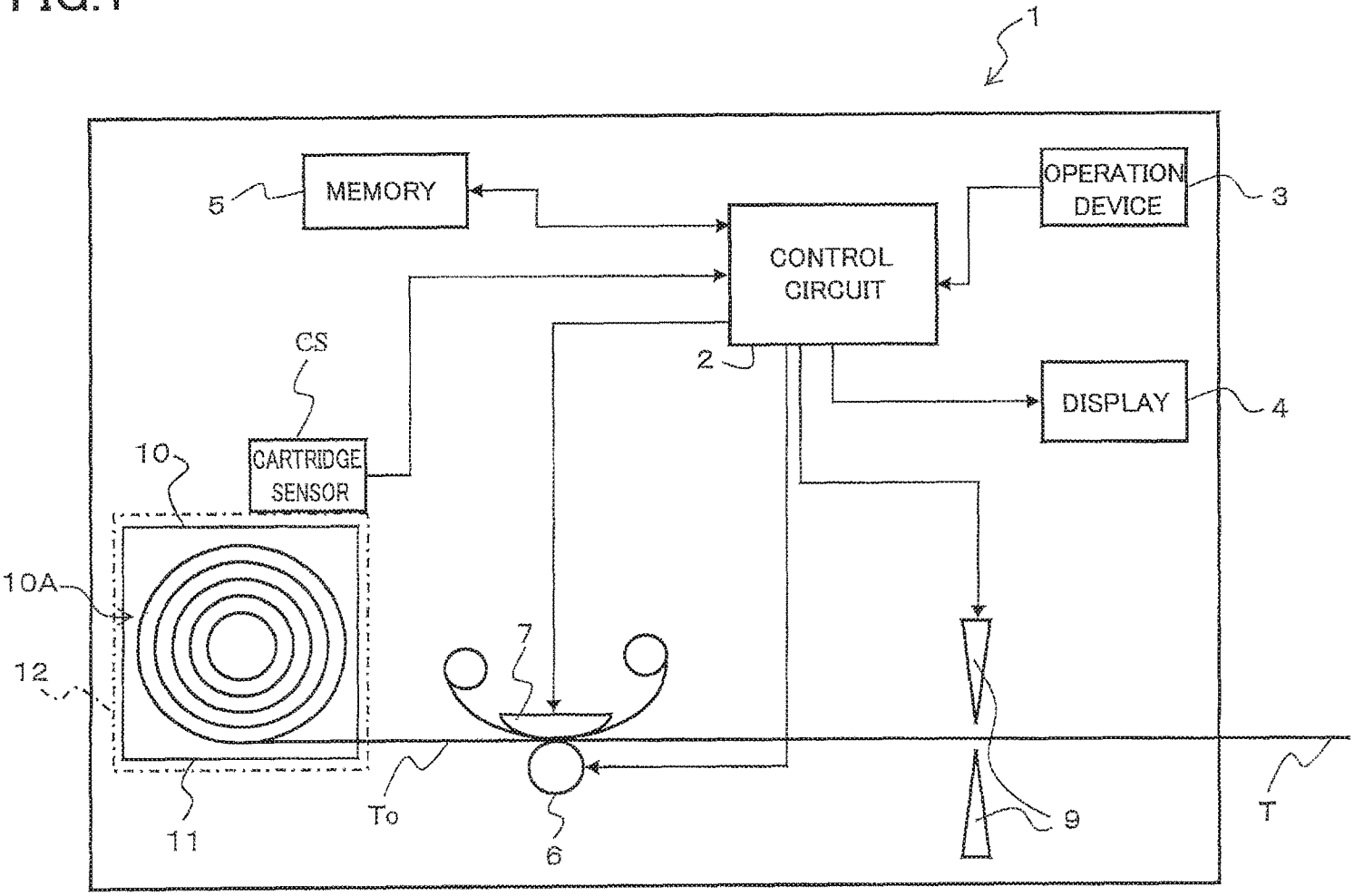
FIG. 1 is a view for explaining a general structure of a label creating apparatus according to a first embodiment.

In FIG. 1, a label creating apparatus 1 as one example of a printing apparatus includes: a control circuit 2; an operation device 3 configured to accept operations of a user (an operator); a display 4; a memory 5 configured to store various kinds of information; a conveying roller 6 as one example of a conveyor; a thermal head 7 as one example of a printer; and cutters 9.

The label creating apparatus 1 includes a cartridge holder 12 having a housing 11, on which a tape cartridge 10 is mountable removably. The tape cartridge 10 accommodates a tape roll 10A having a spiral shape. It is noted that FIG. 1 illustrates the tape roll 10A in the form of concentric circles for simplicity. The tape roll 10A is a roll of a print tape To as one example of a tape. Examples of the tape cartridge 10 include: a tape cartridge of a die-cut-label type in which the print tape To having half-cut regions HC (see FIGS. 2A and 2B which will be described below) formed by half cut (kiss cut) of the print tape To is rolled; and a tape cartridge of what is called a continuous type (see FIGS. 10A and 10B which will be described below) in which the print tape To having no half-cut regions HC is rolled. In the label creating apparatus 1, any of the types of the tape cartridge 10 can be used. A cartridge sensor CS provided on the cartridge holder 12 detects which type of the tape cartridge 10 is used. The cartridge sensor CS, based on this detection, sends the control circuit a corresponding detection signal as cartridge type information, in other words, information about the type of the print tape To. It is noted that the following explanation is provided assuming that the tape cartridge 10 of the die-cut-label type is used, unless otherwise specified.

The control circuit 2 includes a central processing unit (CPU) and a read-only memory (ROM), not illustrated. The control circuit 2 is configured to execute various programs stored in the ROM and control overall operations of the label creating apparatus 1 while using a temporary storage function of a RAM of the memory 5.

The conveying roller 6 is opposed to the thermal head 7. The print tape To fed from the tape roll 10A is nipped between the conveying roller 6 and the thermal head 7. The conveying roller 6 is rotated by control of the control circuit 2 (specifically, a controller 500 which will be described below) so as to convey the print tape To while drawing the print tape To out from the tape roll 10A. In the following description, the control of the control circuit 2 is similar to control of the controller 500 in meaning.

The thermal head 7 is controlled by the control circuit 2 to print a desired print object, such as characters and figures, on each of label portions (which will be described later in detail) of the print tape To conveyed by the conveying roller 6.

In this example, the cutters 9 are controlled by the control circuit 2 to cut a print tape T (which will be described later in detail) on which a plurality of print labels L (each one example of a printed medium) are printed along a conveying direction. It is noted that a cut lever, not illustrated, may be provided so as to be operable by the user to actuate the cutters 9. It is noted that each of the print tapes To, T is one example of a medium.

Print Tape

Figure 2A:
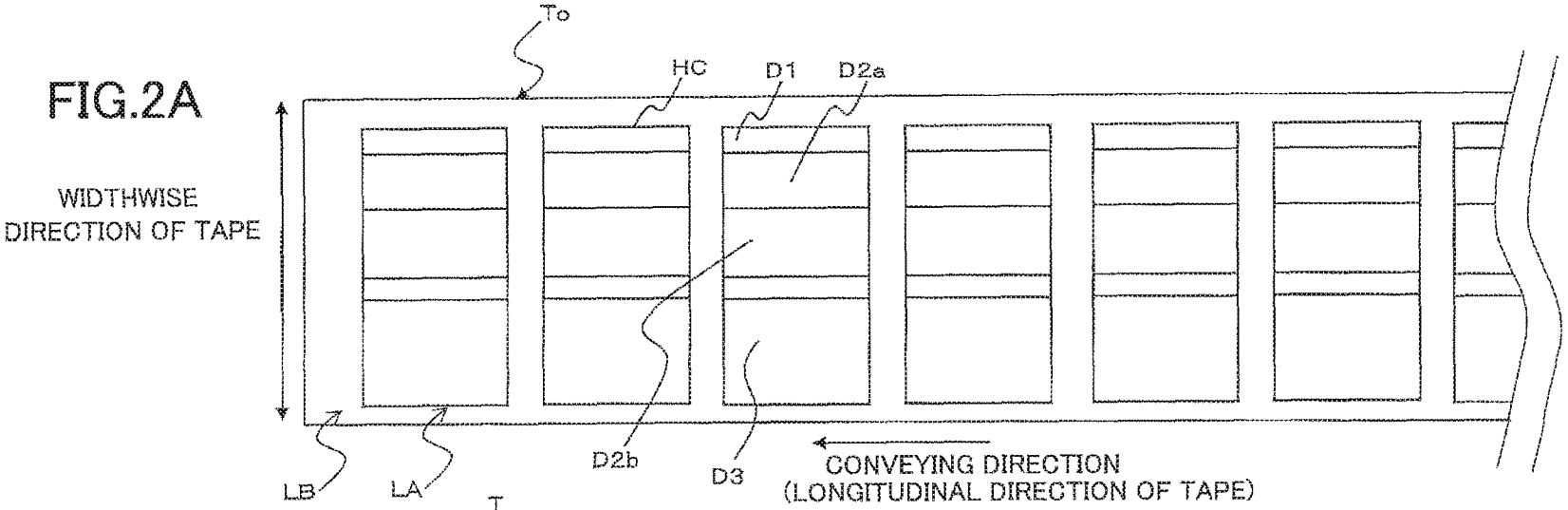
FIG. 2A is a plan view illustrating a print tape before printing.

FIG. 2A illustrates the print tape To. FIG. 2A is a plan view of the print tape To in an unprinted state. In FIG. 2A, the right and left direction coincides with the conveying direction (in other words, the longitudinal direction of the tape), the up and down direction coincides with the widthwise direction of the tape, and the front and back direction of the sheet on which FIG. 2A is illustrated coincides with the thickness direction of the tape. In FIG. 2A, the print tape To has substantially rectangular half-cut regions HC (see FIG. 3B which will be described below) formed by cutting a base layer 21 and an adhesive layer 22. Portions of the print tape To inside the half-cut regions HC are label portions LA, and a portion of the print tape To outside the half-cut regions HC is a non-label portion LB. It is noted that a print tape from which the non-label portion LB is peeled off in advance may be used as the print tape To. The label portions LA are arranged in the longitudinal direction of the tape. Each of the label portions LA includes an adhesive region D1, a non-adhesive region D2*a*, a non-adhesive region D2*b*, and a partly-adhesive region D3 arranged in order toward one side in the widthwise direction of the tape (downward in FIG. 2A). These regions will be described below.

Figure 2B:
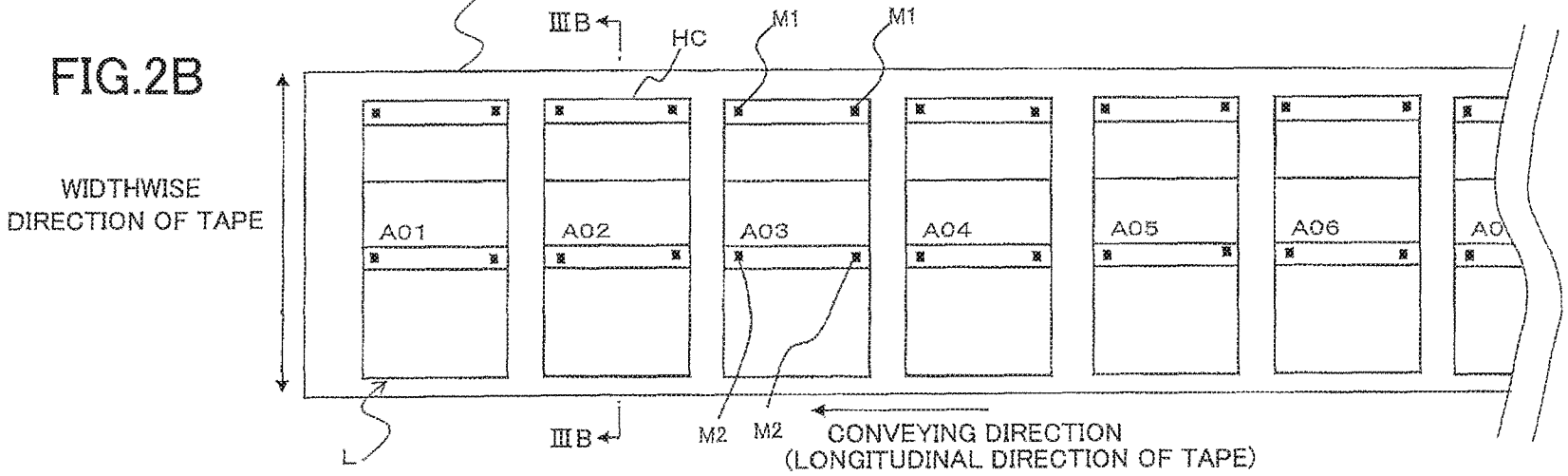
FIG. 2B is a plan view illustrating the print tape after printing.

FIG. 2B illustrates the print tape T on which character strings R are formed. In this example, FIG. 2B is a plan view of the print tape T after the character strings R are respectively printed on printing background layers 25 (which will be described below) in the respective non-adhesive regions D2*b* of the regions D1-D4. In this example, as illustrated in FIG. 2B, text objects as the print objects, i.e., the character strings R ("A01", "A02", "A03", and so on) are formed in order by the thermal head 7 on the respective label portions LA to create the print labels L. Also, marks M1 are printed on the adhesive regions D1 by the thermal head 7, and likewise marks M2 are printed on the partly-adhesive regions D3. It is noted that the print tape T may be configured such that the mark M1 is formed on the print tape To in advance, and the mark M2 is printed on the print tape To by the thermal head 7 (see FIG. 19 which will be described below), for example. Conversely, the print tape T may be configured such that the mark M2 is formed on the print tape To in advance, and the mark M1 is printed on the print tape To by the thermal head 7 (not illustrated).

Print Label

Figure 3B:
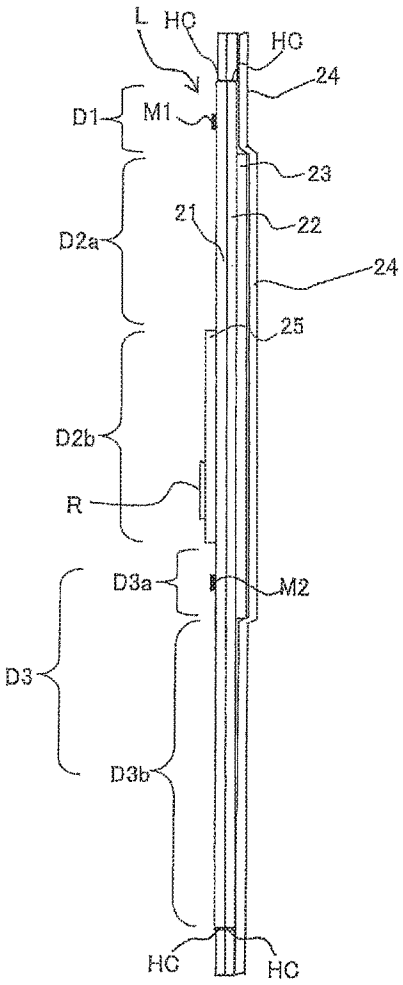
FIG. 3B is a cross-sectional view taken along line IIIB-IIIB in FIG. 2B.
Figure 3A:
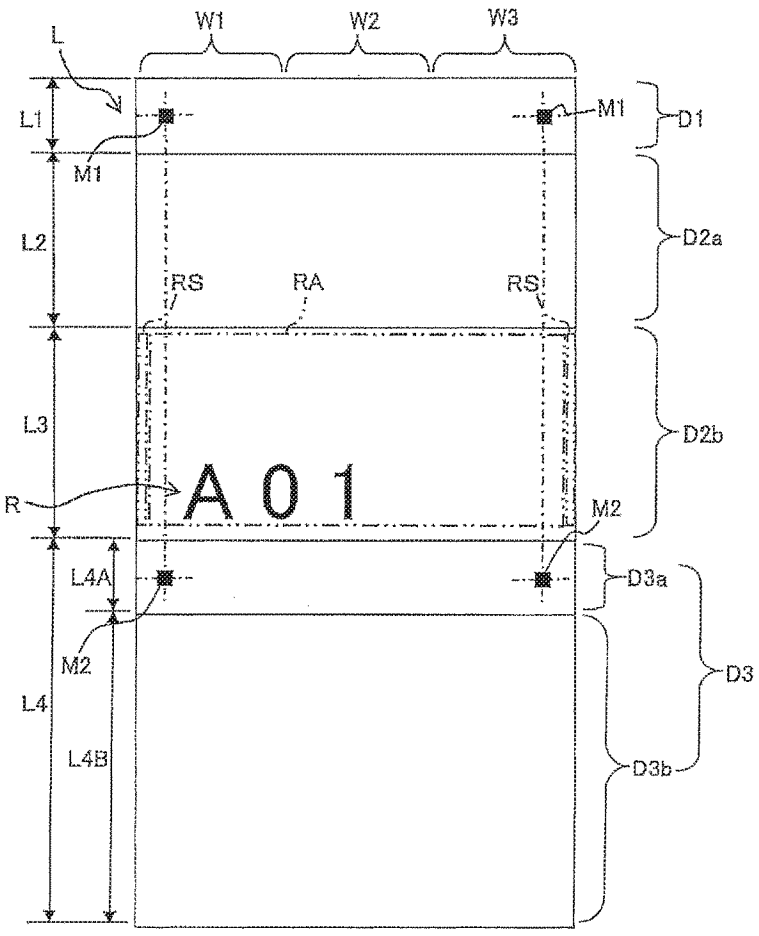
FIG. 3A is a development plan view of a print label.

There will be next described the structure of the print label L with reference to FIGS. 3A and 3B. FIG. 3A is plan view of one print label L separated from the non-label portion LB. FIG. 3B is a cross-sectional view taken along line IIIB-IIIB in FIG. 2B.

In FIGS. 3A and 3B, each of the print labels L is constituted by the transparent base layer 21, the transparent adhesive layer 22, a transparent non-adhesive layer 23, and a separation layer 24 which are stacked on one another from the left side toward the right side in FIG. 3B (from the front side toward the back side in FIG. 3A) in a thickness direction of the print label L (i.e., the depth direction of the sheet in FIG. 3A and the right and left direction in FIG. 3B). The thickness direction is one example of a stacking direction in which the layers are stacked on one another. It is noted that since each of the print tapes To, T has this stacking structure, each of the print tapes To, T has the base layer 21, the adhesive layer 22, the non-adhesive layer 23, and the separation layer 24 each elongated in the right and left direction in FIGS. 2A and 2B (as one example of a second direction orthogonal to each of a first direction and the thickness direction).

The printing background layer 25 having a non-transparent color on which the character string R is formed by the thermal head 7 is provided on a portion of a front surface of the base layer 21 (i.e., a left surface thereof in FIG. 3B which is a one-side surface thereof in the thickness direction). The non-adhesive layer 23 is provided between a portion of the adhesive layer 22 and a portion of the separation layer 24. While the adhesive layer 22 is provided on the entire back surface of the base layer 21 (i.e., a right surface in FIG. 3B which is an other-side surface thereof in the thickness direction) between the base layer 21 and the separation layer 24 in this example, the adhesive layer 22 may be provided on a portion of the back surface of the base layer 21.

In view of the above, the print label L has the four regions along the direction orthogonal to the thickness direction (i.e., the up and down direction in FIGS. 3A and 3B, the circumferential direction of a wrapped member 302 which will be described below, and the first direction). The four regions include: the adhesive region D1 (as one example of a first region in this example) constituting an upper end portion of the print label L in FIGS. 3A and 3B in the first direction (noted that the upper side in FIGS. 3A and 3B may be referred to as "the other side in the first direction"); the non-adhesive region D2*a* (as one example of a second region in this example) located contiguous to and under the adhesive region D1 in FIGS. 3A and 3B (noted that the lower side in FIGS. 3A and 3B may be referred to as "one side in the first direction"); the non-adhesive region D2*b* (as another example of the second region in this example) located contiguous to and under the non-adhesive region D2*a* in FIGS. 3A and 3B; and the partly-adhesive region D3 (as one example of a third region in this example) located contiguous to and under the non-adhesive region D2*b* in FIGS. 3A and 3B.

In the adhesive region D1, the base layer 21, the adhesive layer 22, and the separation layer 24 are stacked in order from the one side toward the other side in the thickness direction (from the left side toward the right side in FIG. 3B). Thus, the entire portion of the adhesive region D1 which is in contact with the separation layer 24 has adhesiveness owing to the adhesive layer 22. The adhesiveness is one example of stickability in this specification. It is noted that the adhesive region D1 has a length L1 in the first direction. It is noted that a region in the print label L which is occupied by the adhesive region D1 extends in the first direction by the length L1 from an upper end of the print label L in the first direction, and is interposed in the second direction between opposite end portions of the base layer 21 in the second direction in the region extending from the upper end by the length L1.

In the non-adhesive region D2*a*, the base layer 21, the adhesive layer 22, the non-adhesive layer 23, and the separation layer 24 are stacked in order from the one side toward the other side in the thickness direction (from the left side toward the right side in FIG. 3B). Thus, the entire portion of the non-adhesive region D2*a* which is in contact with the separation layer 24 is not adhesive (non-adhesiveness) because the adhesiveness of the adhesive layer 22 is interrupted by the non-adhesive layer 23. It is noted that the non-adhesiveness is one example of non-stickability in this specification. It is noted that the non-adhesive region D2*a* has a length L2 in the first direction. It is noted that a region in the print label L which is occupied by the non-adhesive region D2*a* extends in the first direction by the length L2 from a lower end of the adhesive region D1, and is interposed in the second direction between the opposite end portions of the base layer 21 in the second direction in the region extending from the lower end of the adhesive region D1 by the length L2.

In the non-adhesive region D2*b*, the printing background layer 25, the base layer 21, the adhesive layer 22, the non-adhesive layer 23, and the separation layer 24 are stacked in order from the one side toward the other side in the thickness direction (from the left side toward the right side in FIG. 3B). Thus, the entire portion of the non-adhesive region D2*b* which is in contact with the separation layer 24 is not adhesive because the adhesiveness of the adhesive layer 22 is interrupted by the non-adhesive layer 23. In this example, the printing background layer (ink coated layer) 25 is formed by coating the base layer 21 with ink of an appropriate color, for example. The character string R (the text "A01") is formed by the thermal head 7 on a portion of the print label L in a character-string print region RA that is set in advance on the printing background layer 25 in the non-adhesive region D2*b*, as a region on which characters are printable by the thermal head 7. It is noted that right and left end portions of the character-string print region RA in the second direction in FIG. 3A are margin regions RS on which no characters are formed by the thermal head 7. Since the sizes of the margin regions RS are changeable as will be described later in detail, the size of the character-string print region RA is also changeable, which will also be described later. It is noted that the non-adhesive region D2*b* has a length L3 in the first direction. It is noted that a region in the print label L which is occupied by the non-adhesive region D2*b* extends in the first direction by the length L3 from a lower end of the non-adhesive region D2*a* and is interposed in the second direction between the opposite end portions of the base layer 21 in the second direction in the region extending from the lower end of the non-adhesive region D2*a* by the length L3.

The partly-adhesive region D3 includes: a non-adhesive region D3*a* (as one example of a first-portion region in this example) provided contiguous to and under the non-adhesive region D2*b* in FIGS. 3A and 3B; and an adhesive region D3*b* (as one example of a second-portion region in this example) provided contiguous to and under the non-adhesive region D3*a* in FIGS. 3A and 3B and defines a lower end of the print label L in the first direction in FIGS. 3A and 3B.

In the non-adhesive region D3*a*, the base layer 21, the adhesive layer 22, the non-adhesive layer 23, and the separation layer 24 are stacked in order from the one side toward the other side in the thickness direction (from the left side toward the right side in FIG. 3B). Thus, the entire portion of the non-adhesive region D3*a* which is in contact with the separation layer 24 is not adhesive because the adhesiveness of the adhesive layer 22 is interrupted by the non-adhesive layer 23. It is noted that the non-adhesive region D3*a* has a length L4A in the first direction. It is noted that a region in the print label L which is occupied by the non-adhesive region D3*a* extends in the first direction by the length L4A from a lower end of the non-adhesive region D2*b*, and is interposed in the second direction between the opposite end portions of the base layer 21 in the second direction in the region extending from the lower end of the non-adhesive region D2*b* by the length L4A.

In the adhesive region D3*b*, the base layer 21, the adhesive layer 22, and the separation layer 24 are stacked in order from the one side toward the other side in the thickness direction (from the left side toward the right side in FIG. 3B). Thus, at least a part of a portion of the adhesive region D3*b*, which portion is in contact with the separation layer 24, has adhesiveness owing to the adhesive layer 22. It is noted that the adhesive region D3*b* has a length L4B in the first direction. As a result, the partly-adhesive region D3 has a length LA (=L4A+L4B) in the first direction, and at least a portion of the partly-adhesive region D3 is adhesive. A region in the print label L which is occupied by the adhesive region D3*b* extends in the first direction by the length L4B from a lower end of the non-adhesive region D3*a*, and is interposed in the second direction between the opposite end portions of the base layer 21 in the second direction in the region extending from the lower end of the non-adhesive region D3*a* by the length L4B.

It is noted that a well-known release processing is applied at least to a surface of the separation layer 24 which is in contact with the adhesive layer 22 in the adhesive region D1 and to a surface of the separation layer 24 which is in contact with the adhesive layer 22 in a portion of the partly-adhesive region D3 (e.g., the adhesive region D3*b*). As a result, when the separation layer 24 is peeled off, the adhesive layer 22 clings to the base layer 21 and is kept unseparated therefrom at least in the adhesive region D1 and the adhesive region D3*b*. The release processing may not be applied to the surface of the separation layer 24 which is in contact with the adhesive layer 22 in the adhesive region D1 but be applied to the surface of the base layer 21 which is in contact with the adhesive layer 22 in the adhesive region D1. With this structure, when the separation layer 24 is peeled off, the adhesive layer 22 does not remain on the base layer 21 in the adhesive region D1. In the region D3*a*, in this case, the base layer 21, the adhesive layer 22, and the separation layer 24 need to be stacked in order from the one side toward the other side in the thickness direction, and the release processing needs to be applied to the separation layer 24. Also, the base layer 21 does not have perforation or slits (except the half-cut regions HC), and the cross-sectional shape of the base layer 21 in the thickness direction is continuous in the first direction.

As described above, the two first marks M1 are printed by the thermal head 7 on the base layer 21 in the adhesive region D1 (or the non-adhesive region D2*a*) so as to be arranged in the right and left direction in FIG. 3A (i.e., the second direction), and the two second marks M2 are printed by the thermal head 7 on the base layer 21 in the partly-adhesive region D3 (specifically, the non-adhesive region D3*a*) so as to be arranged in the right and left direction in FIG. 3A (i.e., the second direction).

Positions of each of the first marks M1 and the second marks M2 in the first direction and the second direction are determined by control of the control circuit 2 for the thermal head 7 and the conveying roller 6 (see a circumferential-direction mark-position setter 408 and an axial-direction mark-position setter 409 which will be described below, for example). In this example, in particular, the two first marks M1 and the two second marks M2 are formed such that each of the two first marks M1 and a corresponding one of the two second marks M2 are arranged along the up and down direction in FIG. 3A (i.e., the first direction). Specifically, the center of left first mark M1 in FIG. 3A and the center of the left second mark M2 in FIG. 3A are arranged along the up and down direction in FIG. 3A (i.e., the first direction), and likewise the center of right first mark M1 in FIG. 3A and the center of the right second mark M2 in FIG. 3A are arranged along the up and down direction in FIG. 3A (i.e., the first direction). In this example, the first marks M1 and the second marks M2 have the same shape (square in this example).

As illustrated in FIG. 3A, assuming that the print label L is divided into three regions in the second direction, namely, a left end region W1, a central region W2, and a right end region W3, the marks M1, M2 are formed on opposite end portions of the print label L in the second direction, i.e., the left end region W1 and the right end region W3. It is noted that the second marks M2 may be respectively formed on the opposite end portions of the character-string print region RA in the second direction in the non-adhesive region D2*b*.

Procedure of Attachment of Print Label to Wrapped Member

Figure 4A:
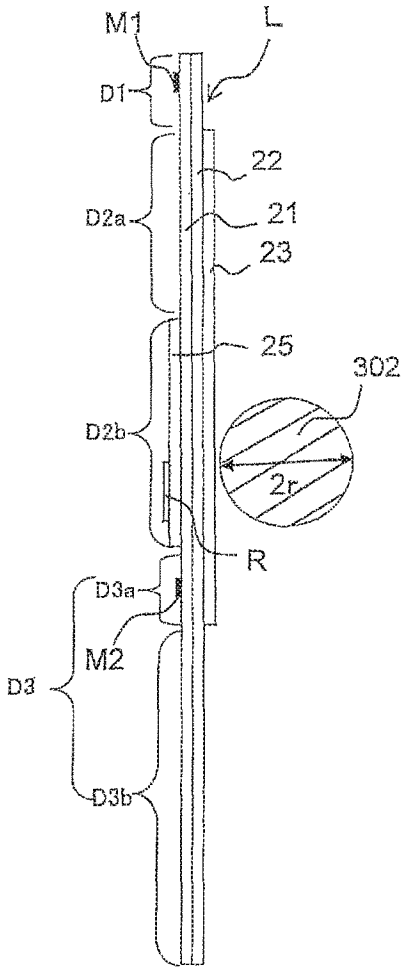
FIGS. 4A through 4C are views for explaining a procedure of attachment of the print label to a wrapped member.
Figure 4B:
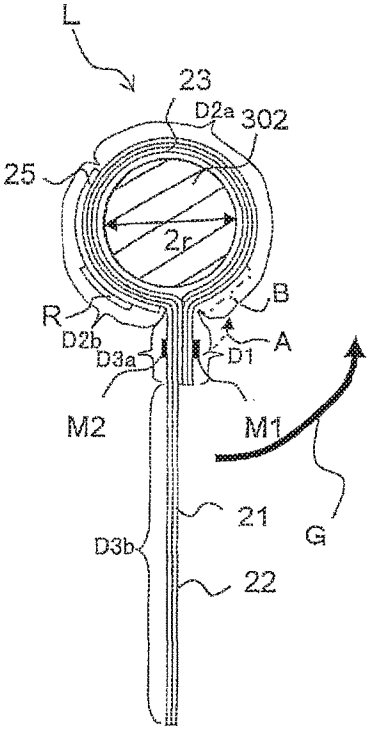
Figure 4C:
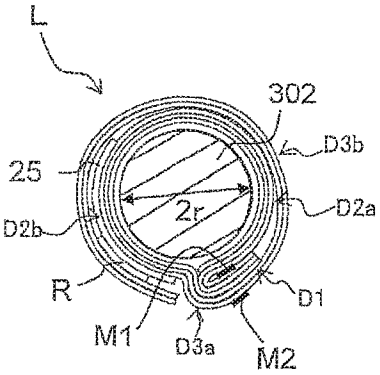

FIGS. 4A-4C illustrate one example of a procedure of attachment of the print labels L to the wrapped member. In this example, FIGS. 4A-4C illustrate one example of wrapping the print label L around the wrapped member 302 shaped like a circular cylinder or a cable and having a diameter 2*r*.

As illustrated in FIG. 4A, the separation layer 24 is first peeled off from the print label L having the above-described structure to expose the non-adhesive layer 23 and so on. While the print label L is constituted by the adhesive region D1, the non-adhesive region D2*a*, the non-adhesive region D2*b*, and the partly-adhesive region D3 arranged in this order, the portions of the print label L in the adhesive region D1, the non-adhesive region D2*a*, and the non-adhesive region D2*b* are then bent in a concave shape such that a portion of the print label L which had been in contact with the separation layer 24 (a right portion of the print label L in FIG. 4A) is located on an inner side (not illustrated).

As illustrated in FIG. 4B, the wrapped member 302 is placed on an inner portion of the concave portion of the print label L, and the print label L is wrapped around the wrapped member 302 so as to form a cylindrical member surrounding the wrapped member 302. Then, the adhesive layer 22 in the adhesive region D1 as a part of a distal end portion of the print label L (noted that the adhesive layer 22 in the adhesive region D1 serves as a sticking portion in inner-sides sticking which will be described below) and the non-adhesive layer 23 in the non-adhesive region D3*a* of the partly-adhesive region D3 (which serves as a stuck portion in the inner-sides sticking which will be described below) are stuck together. This sticking may be hereinafter referred to as "inner-sides sticking". This sticking is performed such that each of the two first marks M1 in the adhesive region D1 and the corresponding one of the two second marks M2 in the non-adhesive region D3*a* are located at the same position when viewed in the right and left direction in FIG. 4B (see FIGS. 4B and 4C).

In this state, the sum of the lengths L2, L3, L4A of the non-adhesive layer 23 in the first direction is at least greater than or equal to the circumference of a circle 2πr of the wrapped member 302. As a result, the shape of the print label L is fixed by sticking of the portions of the adhesive layer 22, and the print label L is wrapped around the wrapped member 302 in the non-adhesive region D2*a* and the non-adhesive region D2*b* without adhesive, whereby the print label L is rotatably attached to the wrapped member 302.

Thereafter, the rest portion (the adhesive region D3*b* in this example) of the partly-adhesive region D3 which is not used for surrounding the wrapped member 302 is wrapped around an outer circumferential portion of the print label L in the regions D2, D3 (see FIG. 4C) so as to cover the non-adhesive region D2*a* and the non-adhesive region D2*b* constituting the cylindrical member in this order such that the stuck portions of the print label L in the adhesive region D1 and the non-adhesive region D3*a* are folded into an inner circumferential side as indicated by arrow G in FIG. 4B (such that the adhesive region D1 as the sticking portion is folded along arrow A and brought into contact with an area B in FIG. 4B). The portion of the print label L in the adhesive region D3*b* of the partly-adhesive region D3 is stuck to the outer circumferential portion of the print label L in the non-adhesive region D2*a* and the non-adhesive region D2*b* using adhesiveness of the adhesive layer 22, and the attachment of the print label L to the wrapped member 302 is finished.

Example of Use of Print Label

Figure 5:
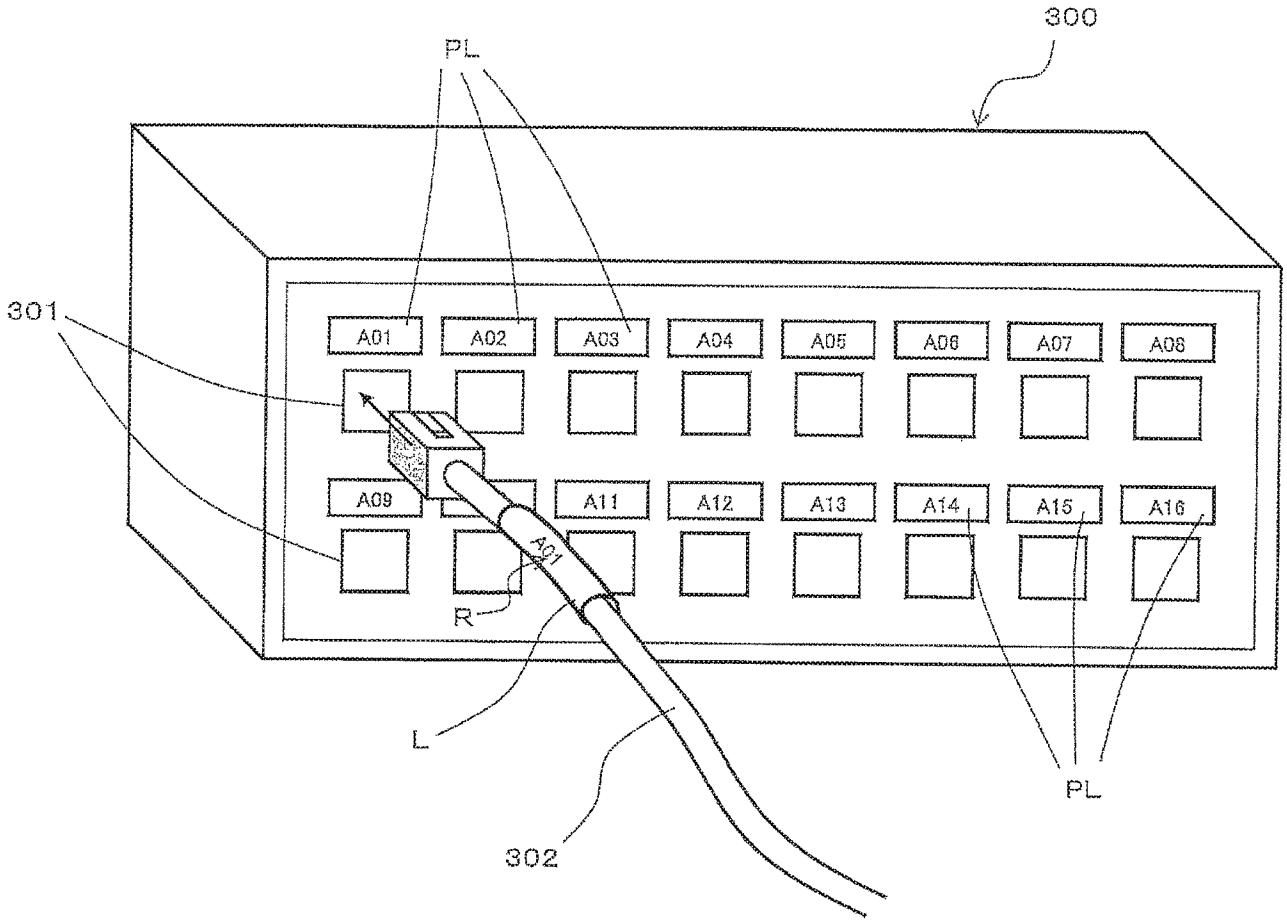
FIG. 5 is a perspective view illustrating an example of use of the print labels.

FIG. 5 illustrates one example of use of the print labels L. In this example, cables used for a switching hub configured to relay information over a wired LAN are used each as the wrapped member 302. These cables will be hereinafter referred to as "cables 302". As illustrated in FIG. 5, a switching hub 300 has sixteen slots 301, eight of which are formed in an upper portion of the switching hub 300, and the other eight of which are formed in a lower portion of the switching hub 300. In the illustrated example, plates PL indicating identification names "A01"–"A08" are provided respectively for the upper eight slots 301 so as to be arranged in this order from the left. Also, plates PL indicating identification names "A09"–"A16" are provided respectively for the lower eight slots 301 so as to be arranged in this order from the left.

Each of the cables 302 is connected to a corresponding one of the slots 301. For easy connection, the print labels L are attached to end portions of the respective cables 302 such that the same character strings R as the respective identification names of the slots 301 are printed on the respective print labels L to indicate the corresponding slots 301. That is, the print labels L on which the same texts as the identification names of the plates PL are printed are attached to the respective cables 302 to indicate which slot 31 each cable 302 is to be connected to. This configuration clarifies a relationship between the slots 301 and the cables 302, thereby preventing erroneous connection.

Figure 6A:
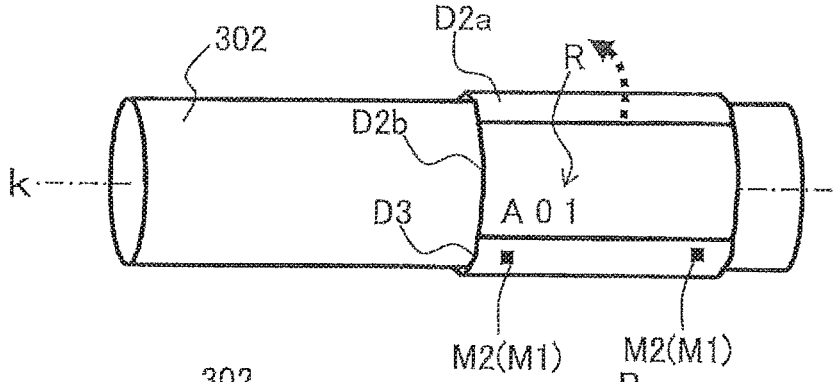
FIGS. 6A and 6B are schematic views each illustrating a state in which the print label is attached to a cable.
Figure 6B:
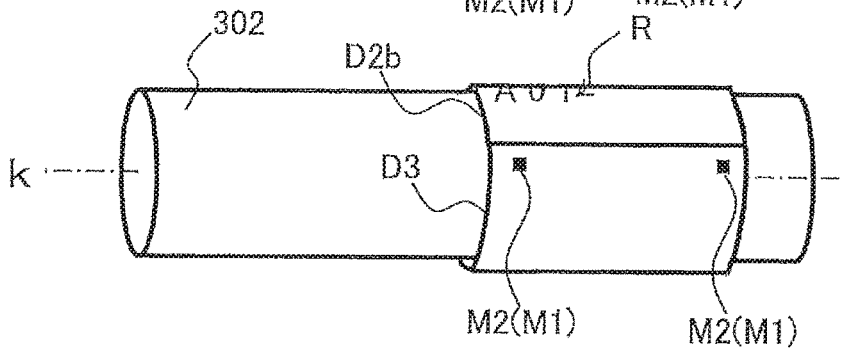

Each of FIGS. 6A and 6B schematically illustrates a state in which the print label L is attached to the cable 302. FIGS. 6A and 6B also illustrate axes k of the cables 302. As described above, the print label L is rotatably attached to the cable 302 as the wrapped member. In the state illustrated in FIG. 6A, for example, the print label L is in a state in which the non-adhesive region D2*b* in which the character string R representing "A01" is printed is on a front side in FIG. 6A. It is noted that the transparent adhesive region D3*b* covers the outer circumferential portion of the non-adhesive region D2*b* in reality as illustrated in FIG. 4C, but illustration of the transparent adhesive region D3*b* is omitted in FIGS. 6A and 6B for simplicity. When the print label L is rotated in a direction indicated by the broken-line arrow (i.e., in the circumferential direction) from the state illustrated in FIG. 6A, for example, the partly-adhesive region D3 of the print label L is located on the front side as illustrated in FIG. 6B. In the case where the print label L is fixed to the cable 302 at the position in FIG. 6B, the viewability of the character string R is low. However, since the print label L is rotatable in this example, the viewability of the character string R is increased by rotating the print label L in a direction reverse to the above-described direction to the position in FIG. 6A.

Another Sticking Manner

Figure 7B:
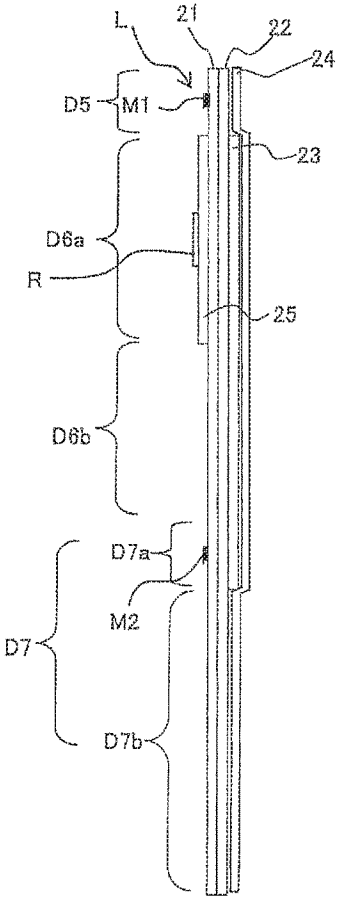
FIG. 7B is a cross-sectional view taken along line VIIB-VIIB in FIG. 7A.
Figure 7A:
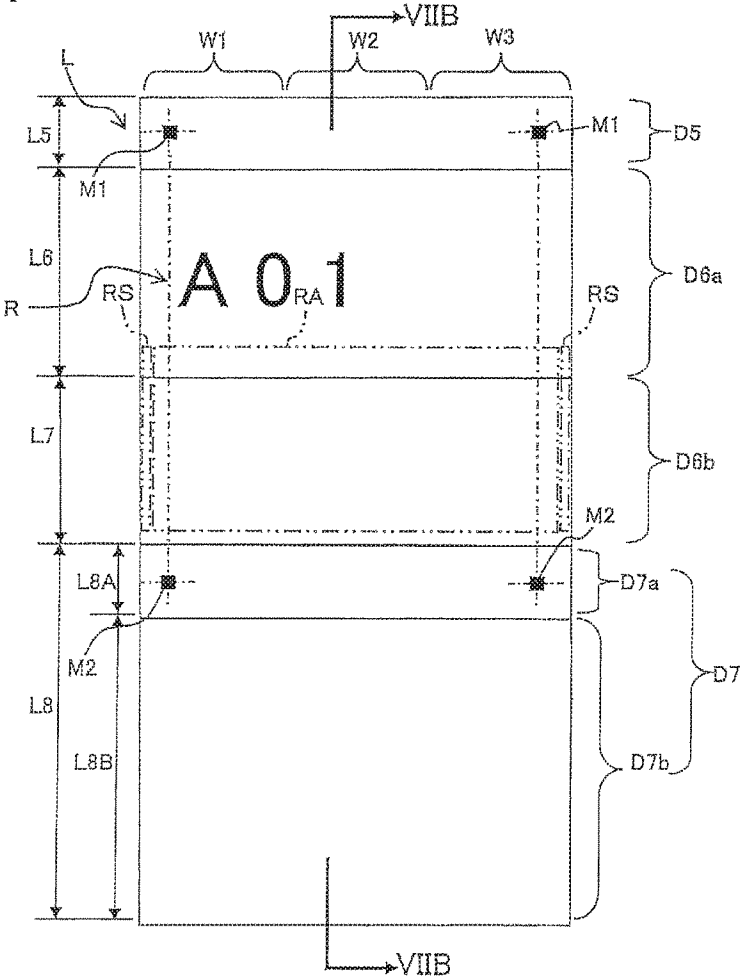
FIG. 7A is a plan view of a print label different in sticking manner from the print label in FIG. 3A.

In the label creating apparatus 1 according to the present embodiment, the print label L may be created in a sticking manner different from the above-described manner. FIG. 7A is a plan view of a print label L to be stuck in another sticking manner. FIG. 7A corresponds to FIG. 3A. FIG. 7B is a cross-sectional view taken along line VIIB-VIIB in FIG. 7A. FIG. 7B generally corresponds to FIG. 3B. In this case, the print label L in FIGS. 7A and 7B is formed by displacing the printing background layer 25 in advance for a structure of the print label L in the print tapes To, T illustrated in FIGS. 2A through 3B (not illustrated).

In FIGS. 7A and 7B, the print label L (in other words, the print tapes To, T) includes the transparent base layer 21, the transparent adhesive layer 22, the transparent non-adhesive layer 23, and the separation layer 24 which are stacked on one another in this order from the left side toward the right side in FIG. 7B along the thickness direction of the print label L.

As in the above-described structure, the printing background layer 25 is provided on a portion of a front surface of the base layer 21, and the non-adhesive layer 23 is provided between a portion of the adhesive layer 22 and a portion of the separation layer 24.

In view of the above, the print label L in this example has four regions along the first direction. The four regions include: an adhesive region D5 (as one example of the first region in this example) constituting an end portion of the print label L in the first direction; a non-adhesive region D6*a* (as one example of the second region in this example) provided contiguous to and under the adhesive region D5 in FIGS. 7A and 7B; a non-adhesive region D6*b* (as one example of the second region in this example) provided contiguous to and under the non-adhesive region D6*a* in FIGS. 7A and 7B; and a partly-adhesive region D7 (as one example of the third region in this example) provided contiguous to and under the non-adhesive region D6*b* in FIGS. 7A and 7B.

In the adhesive region D5, as in the adhesive region D1, the base layer 21, the adhesive layer 22, and the separation layer 24 are stacked in order from the left side toward the right side in FIG. 7B. A portion of the adhesive region D5, which portion is in contact with the separation layer 24, has adhesiveness. It is noted that the adhesive region D5 has a length L5 in the first direction. It is noted that a region in the print label L which is occupied by the adhesive region D5 extends in the first direction by the length L5 from an upper end of the print label L in the first direction, and is interposed in the second direction between the opposite end portions of the base layer 21 in the second direction in the region extending from the upper end by the length L5.

In the non-adhesive region D6*a*, as in the non-adhesive region D2*b*, the printing background layer 25, the base layer 21, the adhesive layer 22, the non-adhesive layer 23, and the separation layer 24 are stacked in order from the one side toward the other side in the thickness direction (from the left side toward the right side in FIG. 7B). Thus, the entire portion of the non-adhesive region D6*a* which is in contact with the separation layer 24 is not adhesive because the adhesiveness of the adhesive layer 22 is interrupted by the non-adhesive layer 23. The printing background layer 25 is an ink coated layer. The character string R (the text "A01") is formed by the thermal head 7 on the character-string print region RA that is set in advance on the printing background layer 25 in the non-adhesive region D6*a*, as a region on which characters are printable by the thermal head 7. It is noted that the non-adhesive region D6*a* has a length L6 in the first direction. It is noted that a region in the print label L which is occupied by the non-adhesive region D6*a* extends in the first direction by the length L6 from a lower end of the adhesive region D5, and is interposed in the second direction between the opposite end portions of the base layer 21 in the second direction in the region extending from the lower end of the adhesive region D5 by the length L6.

In the non-adhesive region D6*b*, as in the non-adhesive region D2*a*, the base layer 21, the adhesive layer 22, the non-adhesive layer 23, and the separation layer 24 are stacked in order from the one side toward the other side in the thickness direction (from the left side toward the right side in FIG. 7B). Thus, the entire portion of the non-adhesive region D6*b* which is in contact with the separation layer 24 is not adhesive because the adhesiveness of the adhesive layer 22 is interrupted by the non-adhesive layer 23. It is noted that the non-adhesive region D6*b* has a length L7 in the first direction. It is noted that a region in the print label L which is occupied by the non-adhesive region D6*b* extends in the first direction by the length L7 from a lower end of the adhesive region D6*a*, and is interposed in the second direction between the opposite end portions of the base layer 21 in the second direction in the region extending from the lower end of the adhesive region D6*a* by the length L7.

The partly-adhesive region D7 includes: a non-adhesive region D7*a* (as one example of the first-portion region in this example) provided contiguous to and under the non-adhesive region D6*b* in FIGS. 7A and 7B; and an adhesive region D7*b* (as one example of a second-portion region in this example) provided contiguous to and under the non-adhesive region D7*a* in FIGS. 7A and 7B and defines a lower end of the print label L in the first direction in FIGS. 7A and 7B.

Figure 8A:
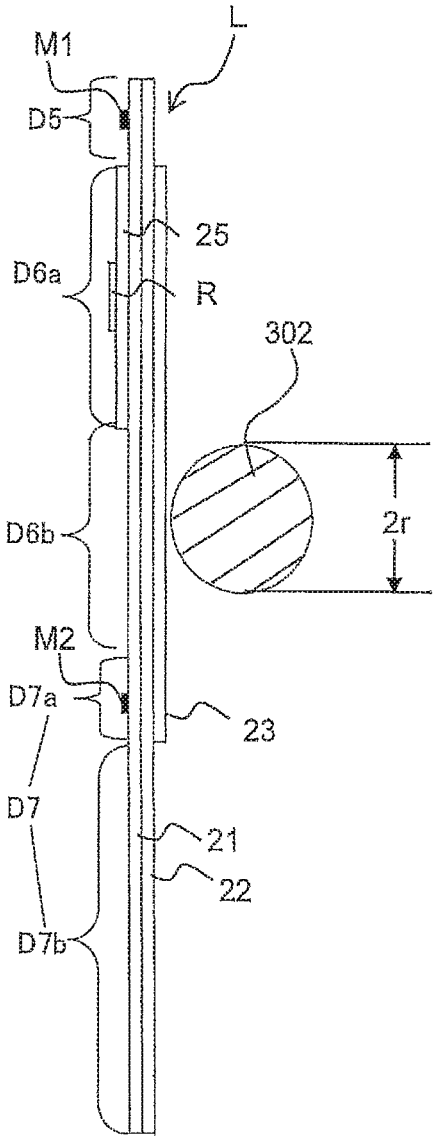
FIGS. 8A and 8B are views for explaining a procedure of attachment of the print label to a wrapped member having a large diameter.
Figure 8B:
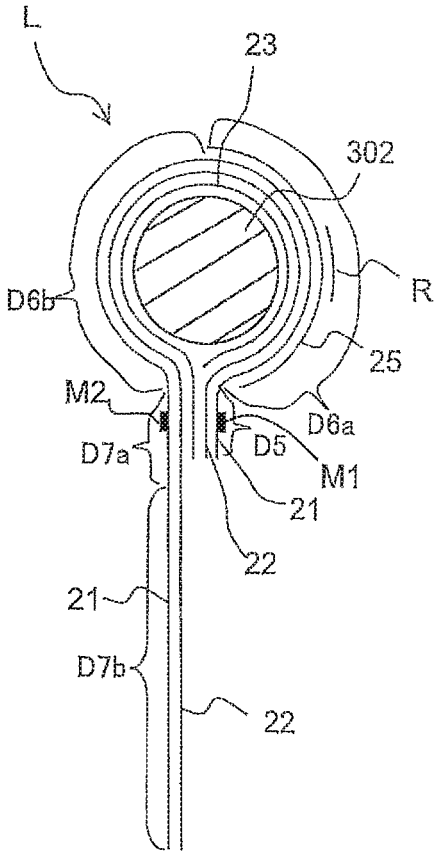

In the non-adhesive region D7*a*, as in the non-adhesive region D3*a*, the base layer 21, the adhesive layer 22, the non-adhesive layer 23, and the separation layer 24 are stacked in order from the one side toward the other side in the thickness direction (from the left side toward the right side in FIG. 8B). Thus, the entire portion of the non-adhesive region D7*a* which is in contact with the separation layer 24 is not adhesive because the adhesiveness of the adhesive layer 22 is interrupted by the non-adhesive layer 23. It is noted that the non-adhesive region D7*a* has a length L8A in the first direction. A region in the print label L which is occupied by the non-adhesive region D7*a* extends in the first direction by the length L8A from a lower end of the non-adhesive region D6*b*, and is interposed in the second direction between the opposite end portions of the base layer 21 in the second direction in the region extending from the lower end of the non-adhesive region D6*b* by the length L8A.

In the adhesive region D7*b*, as in the adhesive region D3*b*, the base layer 21, the adhesive layer 22, and the separation layer 24 are stacked in order from the one side toward the other side in the thickness direction (from the left side toward the right side in FIG. 8B). Thus, at least a part of a portion of the adhesive region D7*b*, which portion is in contact with the separation layer 24 has adhesiveness owing to the adhesive layer 22. It is noted that the adhesive region D7*b* has a length L8B in the first direction. As a result, the partly-adhesive region D7 has a length L8 (=L8A+L8B) in the first direction, and at least a portion of the partly-adhesive region D7 is adhesive. A region in the print label L which is occupied by the adhesive region D7*b* extends in the first direction by the length L8B from a lower end of the non-adhesive region D7*a*, and is interposed in the second direction between the opposite end portions of the base layer 21 in the second direction in the region extending from the lower end of the non-adhesive region D7*a* by the length L8B.

It is noted that, as in the above-described structure, the well-known release processing is applied at least to a surface of the separation layer 24 which is in contact with the adhesive layer 22 in the adhesive region D5 and to a surface of the separation layer 24 which is in contact with the adhesive layer 22 in a portion of the partly-adhesive region D7 (e.g., the adhesive region D7*b*). The well-known release processing is also applied at least to a surface of the base layer 21 which is in contact with the adhesive layer 22 (i.e., the other-side surface of the base layer 21 in the thickness direction) in the adhesive region D5. As a result, when the separation layer 24 is peeled off, the adhesive layer 22 clings to the base layer 21 and is kept unseparated at least in the adhesive region D5 and the adhesive region D7*b*. Also, the base layer 21 does not have perforation or slits, and the cross-sectional shape of the base layer 21 in the thickness direction is continuous in the first direction.

Also in this case, the two first marks M1 are printed by the thermal head 7 on the base layer 21 in the adhesive region D5 (or the non-adhesive region D2*a*), and the two second marks M2 are printed by the thermal head 7 on the base layer 21 in the partly-adhesive region D7, specifically, the non-adhesive region D7*a* (or the non-adhesive region D6*b*).

As in the above-described case, positions of each of the first marks M1 and the second marks M2 in the first direction and the second direction are determined by control of the control circuit 2 for the thermal head 7 and the conveying roller 6, and the two first marks M1 and the two second marks M2 are formed such that each of the two first marks M1 and a corresponding one of the two second marks M2 are arranged along the up and down direction in FIG. 7A, i.e., the first direction. In this example, the first marks M1 and the second marks M2 have the same shape (square in this example). As illustrated in FIG. 7A, the marks M1, M2 are formed on opposite end portions of the print label L in the second direction, i.e., the left end region W1 and the right end region W3.

Procedure of Attachment of Print Label to Wrapped Member

Figure 9A:
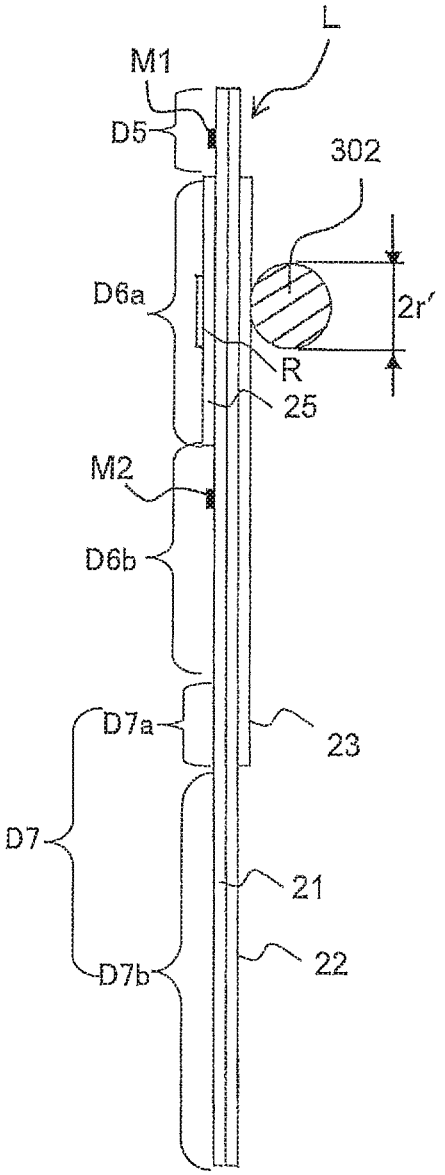
FIGS. 9A and 9B are views for explaining a procedure of attachment of the print label to a wrapped member having a small diameter.
Figure 9B:
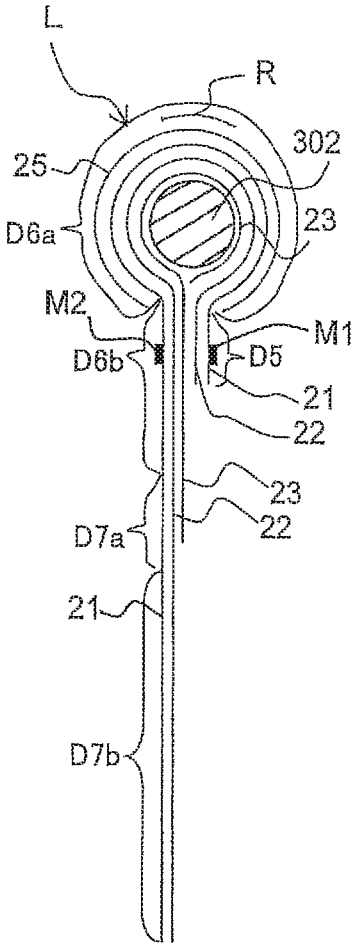

FIGS. 8A-9B illustrate one example of a procedure of attachment of the print label L to the wrapped member in this case. FIGS. 8A and 8B illustrate a case of attaching the print label L to the wrapped member 302 having a relatively large diameter. FIGS. 9A and 9B illustrate a case of attaching the print label L to the wrapped member 302 having a relatively small diameter. In this example, FIGS. 8A and 9A illustrate one example of wrapping the print label L around the wrapped member 302 shaped like a circular cylinder or a cable and having a diameter 2*r* (or 2*r*).

As illustrated in FIGS. 8A and 9A, the separation layer 24 is first peeled off from the print label L having the above-described structure to expose the non-adhesive layer 23 and so on. While the print label L is constituted by the adhesive region D5, the non-adhesive region D6*a*, the non-adhesive region D6*b*, and the partly-adhesive region D7 arranged in this order, the print label L in the adhesive region D5, the non-adhesive region D6*a*, and the non-adhesive region D6*b* are then bent in a concave shape such that a portion of the print label L which had been in contact with the separation layer 24 (a right portion of the print label L in FIGS. 8A and 9A) is located on an inner side (not illustrated).

As illustrated in FIGS. 8B and 9B, the wrapped member 302 is placed on an inner portion of the concave portion of the print label L, and the print label L is wrapped around the wrapped member 302 so as to form a cylindrical member surrounding the wrapped member 302. Then, the adhesive layer 22 in the adhesive region D5 as a part of a distal end portion of the print label L (noted that the adhesive layer 22 in the adhesive region D5 serves as the sticking portion) is stuck to the non-adhesive layer 23 as the stuck portion in the non-adhesive region D7*a* of the partly-adhesive region D7 in the case illustrated in FIG. 8B and to the non-adhesive layer 23 as the stuck portion in the non-adhesive region D6*b* and the non-adhesive region D7*a* in the case illustrated in FIG. 9B (that is, the inner-sides sticking is performed). This sticking is performed such that each of the two first marks M1 in the adhesive region D5 and the corresponding one of the two second marks M2 in the non-adhesive region D7*a* are located at the same position when viewed in the right and left direction in FIGS. 8B and 9B. In this state, the sum of the lengths L6, L7, L8*a* of the non-adhesive layer 23 in the first direction is at least greater than or equal to the circumference of a circle $2\pi r$, $2\pi r'$ of the wrapped member 302. As a result, the shape of the print label L is fixed by the sticking, and the print label L is wrapped around the wrapped member 302 without adhesive, whereby the print label L is rotatably attached to the wrapped member 302.

Thereafter, the rest portion (the adhesive region D7*b* in the example in FIG. 8B and the partly-adhesive region D7 in the example in FIG. 9B) of the partly-adhesive region D8 which is not used for surrounding the wrapped member 302 is wrapped around an outer circumferential portion of the print label L (not illustrated) so as to cover the cylindrical member such that the stuck portions of the print label L are folded into an inner circumferential side. The portion of the print label L in the adhesive region D7*b* of the partly-adhesive region D7 is stuck to the outer circumferential portion of the cylindrical member using adhesiveness of the adhesive layer 22, and the attachment of the print label L to the wrapped member 302 is finished.

Case where Continuous Length Tape

Figure 10A:
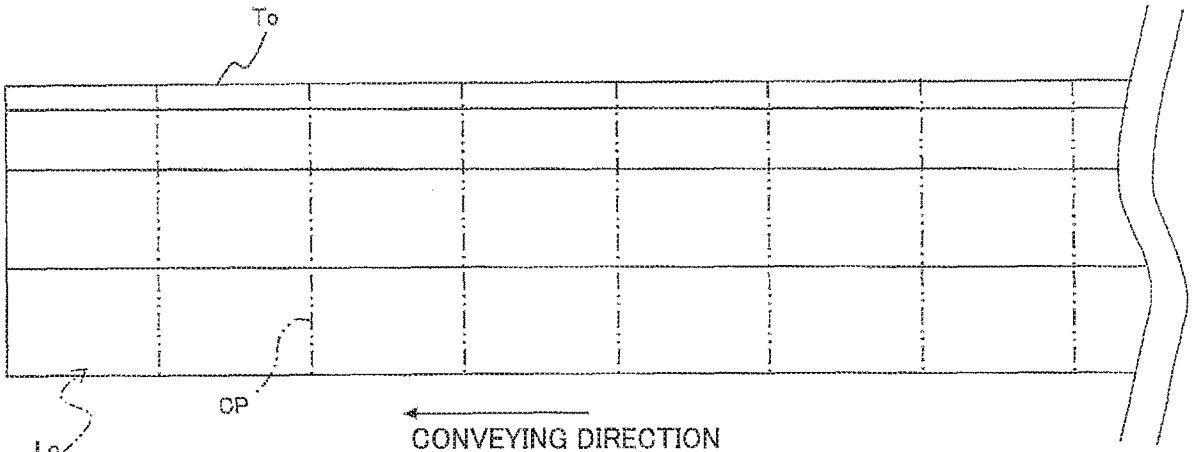
FIG. 10A is a plan view illustrating a print tape before printing in an example in which a continuous length tape is used.

The label creating apparatus 1 is capable of creating the print label L by using the print tape of the continuous type. FIG. 10A illustrates a structure of the print tape To of the continuous type. As illustrated in FIG. 10A, the print tape To in this case does not have the half-cut regions HC as illustrated in FIG. 2A and is cut into a predetermined size by the cutters 9 based on control of the control circuit 2 in creation of the print label L. Thus, the print tape To does not have the non-label portion LB. The print tape To is divided into a plurality of label regions Lo (corresponding to the label portions LA in the above-described embodiment) by cut-planned lines CP along which the print tape To is to be cut by the cutters 9. The label regions Lo are continuous to one another in the longitudinal direction of the print tape To.

Figure 10B:
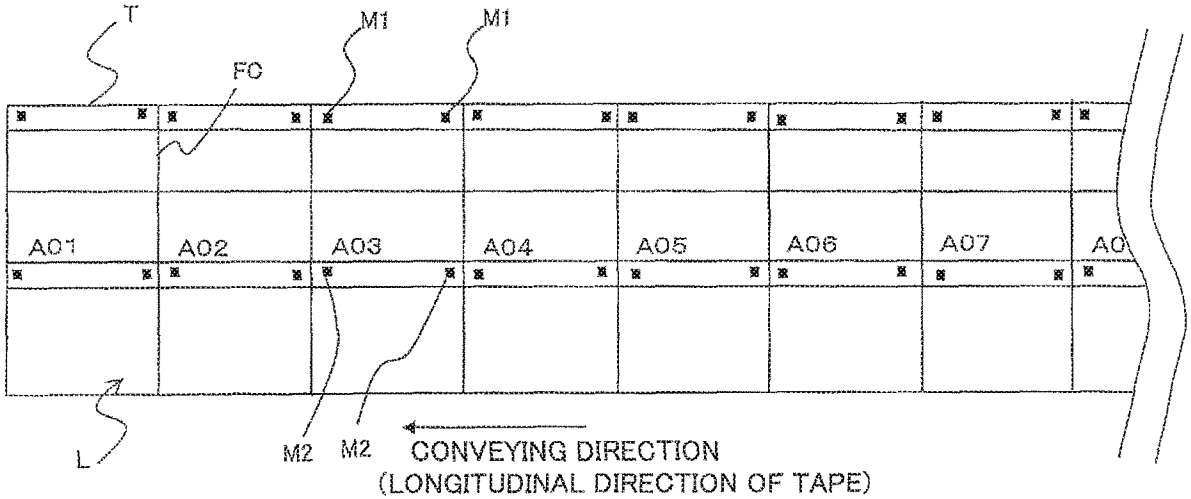
FIG. 10B is a plan view illustrating the print tape after printing.

FIG. 10B is a plan view of the print tape T after the character strings R are printed on the respective label regions Lo. The character strings R representing "A01", "A02", "A03", and so on are formed in order respectively on the label regions Lo as in the structure illustrated in FIG. 2B, and the print tape T is cut by the cutters 9 along cutting lines FC (corresponding to the cut-planned lines CP) to create the print labels L. It is noted that FIG. 10B illustrates the print labels L in an unseparated state for easy understanding even though the print tape T has already been cut by the cutters 9.

Function of Printing Mark on Portion Other than Opposite End Portions

Figure 11B:
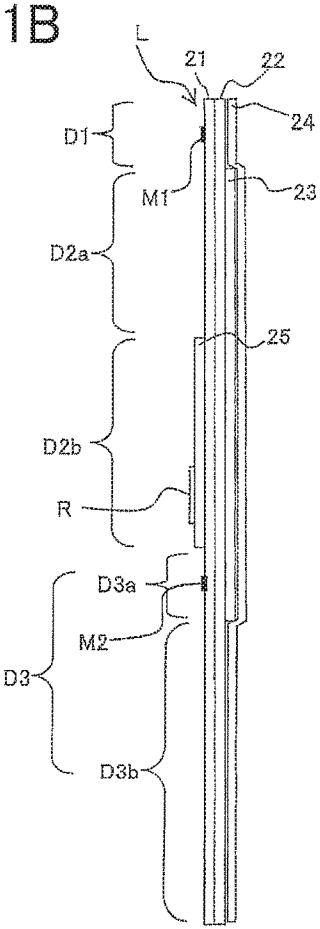
FIG. 11B is a cross-sectional view taken along line XIB-XIB in FIG. 11A.
Figure 11A:
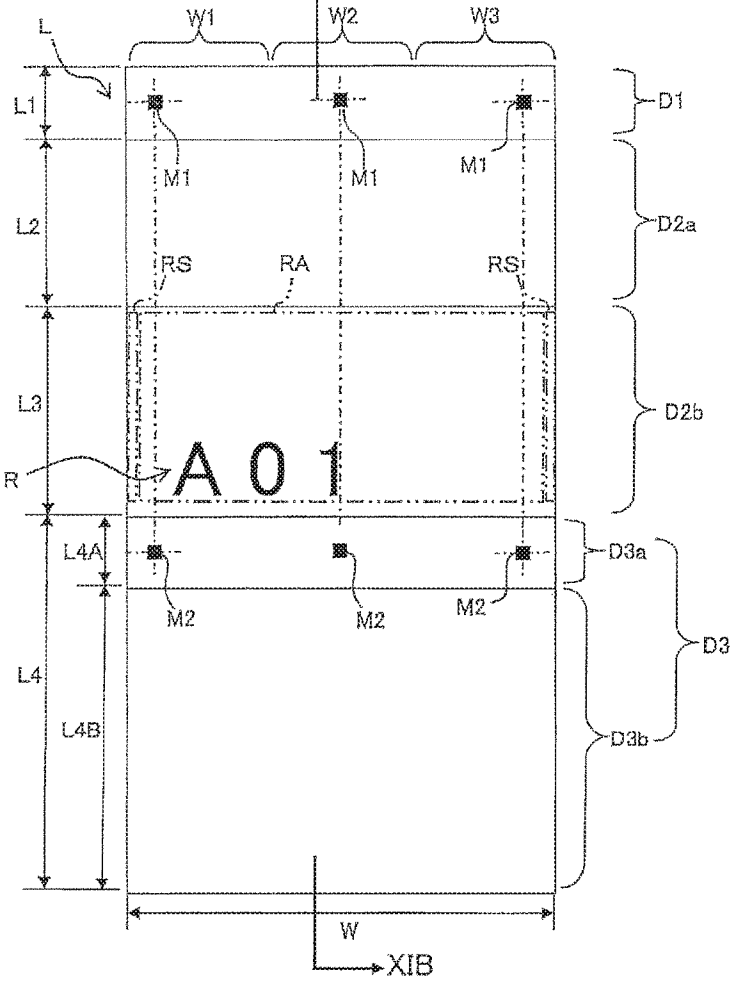
FIG. 11A is a development plan view of an example of a print label on which marks are additionally put on a central portion.

The label creating apparatus 1 according to the present embodiment is capable of setting the number of the marks M1, M2 in accordance with a second-direction dimension W of the print label L (see the axial-direction mark-position setter 409 and a number-of-marks calculator 410 which will be described below). FIG. 11A illustrates an example in which the mark M1 and the mark M2 are printed on the central region W2 in addition to the marks M1 and the marks M2 printed on the opposite end regions of the print label L (i.e., the left end region W1 and the right end region W3) as illustrated in FIG. 3A by way of example. FIG. 11B illustrates a cross-sectional view taken along line XIB-XIB in FIG. 11A. FIG. 11B corresponds to FIG. 3B. In this case, as illustrated in FIGS. 11A and 11B, the thermal head 7 and the conveying roller 6 are controlled by the control circuit 2 to print the three marks M1 and the three marks M2. That is, in the case where it is assumed that the adhesive region D1 is divided into the three regions in the second direction, the first marks M1 are printed respectively on the left end region W1 in the adhesive region D1, the central region W2 in the adhesive region D1, and the right end region W3 in the adhesive region D1 such that a distance between the first mark M1 in the left end region W1 in the adhesive region D1 and the first mark M1 in the central region W2 in the adhesive region D1 is equal to a distance between the first mark M1 in the central region W2 in the adhesive region D1 and the first mark M1 in the right end region W3 in the adhesive region D1. Likewise, it is assumed that the non-adhesive region D3*a* is divided into the three regions in the second direction, the second marks M2 are printed respectively on the left end region W1 in the non-adhesive region D3*a*, the central region W2 in the non-adhesive region D3*a*, and the right end region W3 in the non-adhesive region D3*a* such that a distance between the second mark M2 in the left end region W1 in the non-adhesive region D3*a* and the second mark M2 in the central region W2 in the non-adhesive region D3*a* is equal to a distance between the second mark M2 in the central region W2 in the non-adhesive region D3*a* and the second mark M2 in the right end region W3 in the non-adhesive region D3*a*. As a result, even in the case of the print label L having a relatively large dimension in the second direction, the above-described positioning can be easily performed in the sticking.

Control Circuit

Figure 12:
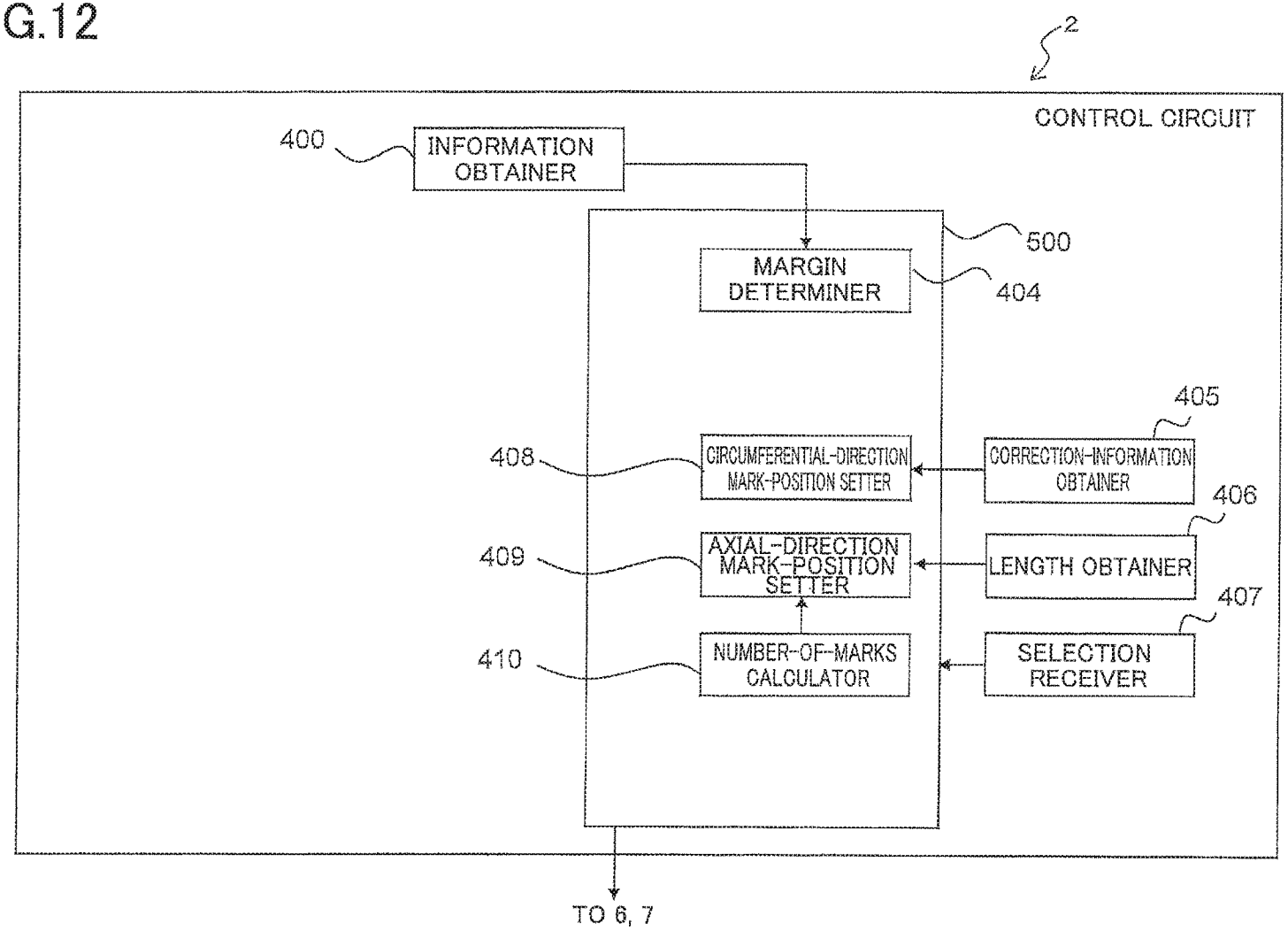
FIG. 12 is a block diagram illustrating a functional configuration of a control circuit.

There will be next explained a configuration and a control procedure of the control circuit 2 for achieving the above-described functions. FIG. 12 illustrates a functional configuration of the control circuit 2. As illustrated in FIG. 12, the control circuit 2 functionally includes the controller 500, an information obtainer 400, a correction-information obtainer 405, a length obtainer 406, and a selection receiver 407. The controller 500 includes a margin determiner 404, the circumferential-direction mark-position setter 408, the axial-direction mark-position setter 409, and the number-of-marks calculator 410. Functions of these elements will be described later in detail.

Control Procedure

Figure 13:
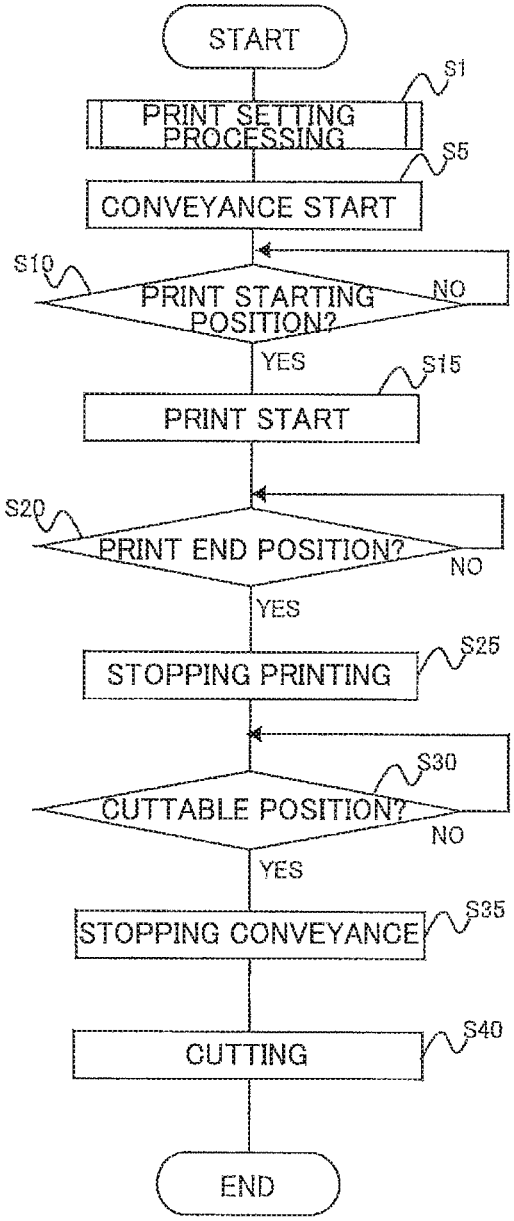
FIG. 13 is a flow chart illustrating a procedure of control executed by a central processing unit (CPU) of the control circuit.

There will be next explained a control procedure executed by the control circuit 2 (specifically, the CPU) with reference to the flow chart in FIG. 13. The flow in FIG. 13 begins when the label creating apparatus 1 is turned on, for example.

At S1, the CPU of the control circuit 2 executes a print setting processing (which will be described later in detail) corresponding to print data, created based on the operation of the operation device 3, for forming the character string R on the print tape To.

At S5, the CPU of the control circuit 2 outputs a control signal to the conveying roller 6 to draw the print tape To from the tape roll 10A, that is, the CPU controls the conveying roller 6 to start conveying the print tape To. It is noted that when the CPU outputs a control signal in this specification, the CPU may output the control signal via a drive circuit, not illustrated.

The CPU of the control circuit 2 at S10 determines whether the print tape To is conveyed by a predetermined amount and located at a print starting position. For example, this predetermined amount is a distance required for a distal end of the print tape To in the character-string print region RA to reach a position substantially opposed to the thermal head 7. When the print tape To is not conveyed by the predetermined amount (S10: NO), the CPU repeats this processing. When the print tape To is conveyed by the predetermined amount (S10: YES), this flow goes to S15.

The CPU of the control circuit 2 at S15 outputs a control signal to the thermal head 7 to start printing the character string R on the portion of the print tape To in the character-string print region RA conveyed by the conveying roller 6 and printing the marks M1, M2 based on the print data, based on the settings (which will be described later in detail) set in the print setting processing at S1. As described above, the print tape To becomes the print tape T after this printing.

The CPU of the control circuit 2 at S20 determines whether the printing of the character string R on the portion of the print tape To in the character-string print region RA by the thermal head 7 and the printing of the marks M1, M2 by the thermal head 7 are completed. In other words, the CPU determines whether the print tape T has reached a print end position. When the printing of the character string R and the marks M1, M2 is not completed (S20: NO), the CPU repeats this processing. When the printing of the character string R and the marks M1, M2 are completed (S20: YES), this flow goes to S25.

The CPU of the control circuit 2 at S25 outputs a control signal to the thermal head 7 to stop the printing on the character-string print region (the non-adhesive region D2*b*) of the print tape To conveyed by the conveying roller 6.

The CPU of the control circuit 2 at S30 determines the print tape T on which the printing is performed by the thermal head 7 is located at a cuttable position. Specifically, in the case where the print tapes To, T having the structure illustrated in FIGS. 2A and 2B, for example, the CPU determines whether the cutters 9 are opposed to the non-label portion LB located between the adjacent print labels L. In the print tapes To, T having the structure illustrated in FIGS. 10A and 10B, for example, the CPU determines whether the cutters 9 are opposed to the cut-planned lines CP located between the adjacent print labels L. When the print tape T has not reached the cuttable position (S30: NO), the CPU repeats this processing. When the print tape T has reached the cuttable position, the cuttable position (S30: YES), this flow goes to S35.

The CPU of the control circuit 2 at S35 outputs a control signal to the conveying roller 6 to stop feeding the print tape To from the tape roll 10A. That is, the conveyance of the print tape To which is started at S5 is stopped.

The CPU of the control circuit 2 at S40 outputs a control signal to an actuator, not illustrated, (e.g., a solenoid) for driving the cutters 9 to cut the print tape T (specifically, the non-label portion LB or the cut-planned line CP between the print labels L). It is noted that in the case where the above-described cut lever is provided, this processing is omitted, and the CPU of the control circuit 2 waits for the print tape T to be cut based on the operation of the cutters 9 by the user via the cut lever after the stop of the conveyance at S35. This procedure in this flow thereafter ends.

Print Setting Processing

Figure 14:
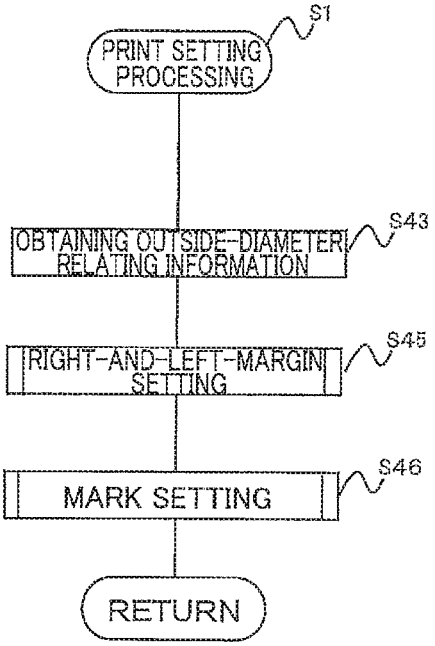
FIG. 14 is a flow chart illustrating a procedure of a processing at S1 in FIG. 13.

There will be next explained a detailed procedure of the print setting processing with reference to FIG. 14.

The procedure in FIG. 14 begins with S43 at which the information obtainer 400 of the control circuit 2 obtains outside-diameter relating information on the wrapped member 302 (the outside diameter of the wrapped member 302 or a module number, a type, or the like corresponding to the outside diameter) which is manually input via the operation device 3, for example.

The margin determiner 404 of the control circuit 2 at S45 executes a right-and-left-margin setting processing to determine the length of each of the margin regions RS in the second direction, based on the outside-diameter relating information obtained at S43. The right-and-left-margin setting processing will be described later in detail with reference to FIG. 15.

The circumferential-direction mark-position setter 408, the axial-direction mark-position setter 409, and the number-of-marks calculator 410 of the control circuit 2 at S46 execute a mark setting processing for the marks M1, M2. This mark setting processing will be described later in detail with reference to FIG. 17. Upon completion of the processing at S46, this flow returns to S5.

Right-and-Left-Margin Setting Processing

Figure 15:
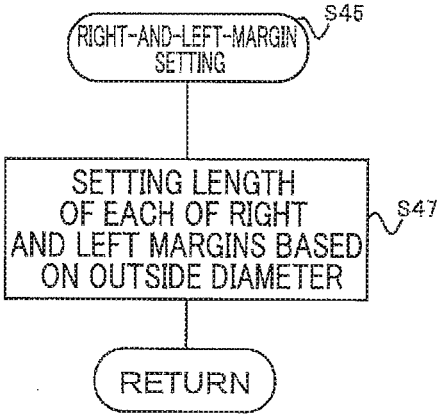
FIG. 15 is a flow chart illustrating a procedure of a processing at S45 in FIG. 14.

There will be next explained a detailed procedure of the right-and-left-margin setting processing at S45 with reference to FIG. 15.

In the right-and-left-margin setting processing illustrated in FIG. 15, the margin determiner 404 of the control circuit 2 at S47 determines the length of each of the margin regions RS in the second direction, based on the outside-diameter relating information obtained at S43. This determination is performed based on a right-and-left-margin table stored in the memory 5 in advance.

Right-and-Left-Margin Table

FIG. 16 illustrates one example of the right-and-left-margin table. In FIG. 16, the dimension of each of the print tapes To, T in the widthwise direction is 50.8 mm by way of example. As illustrated in FIG. 16, the right-and-left-margin table stores a relationship between the outside-diameter relating information obtained at S43 (the outside diameter of the wrapped member 302 in this example) and the length of each of the margin regions RS in the second direction.

As illustrated in FIG. 16, in the case where the outside diameter of the wrapped member 302 is 9.1 mm, the length of each of the margin regions RS is 1 mm. In the case where the outside diameter of the wrapped member 302 is 8.1 mm, the length of each of the margin regions RS is 1 mm. In the case where the outside diameter of the wrapped member 302 is 7.1 mm, the length of each of the margin regions RS is 1 mm. In the case where the outside diameter of the wrapped member 302 is 6.1 mm, the length of each of the margin regions RS is 1 mm. In the case where the outside diameter of the wrapped member 302 is 5.1 mm, the length of each of the margin regions RS is 2 mm. In the case where the outside diameter of the wrapped member 302 is 4.1 mm, the length of each of the margin regions RS is 2 mm. In this right-and-left-margin table, the length of each of the margin regions RS is greater in the case where the outside diameter of the wrapped member 302 is less than or equal to a predetermined value assumed in advance (6.0 mm in this example) than in the case where the outside diameter of the wrapped member 302 is greater than the predetermined value.

Upon completion of the processing at S47, this flow returns to S46.

Mark Setting Processing

Figure 17:
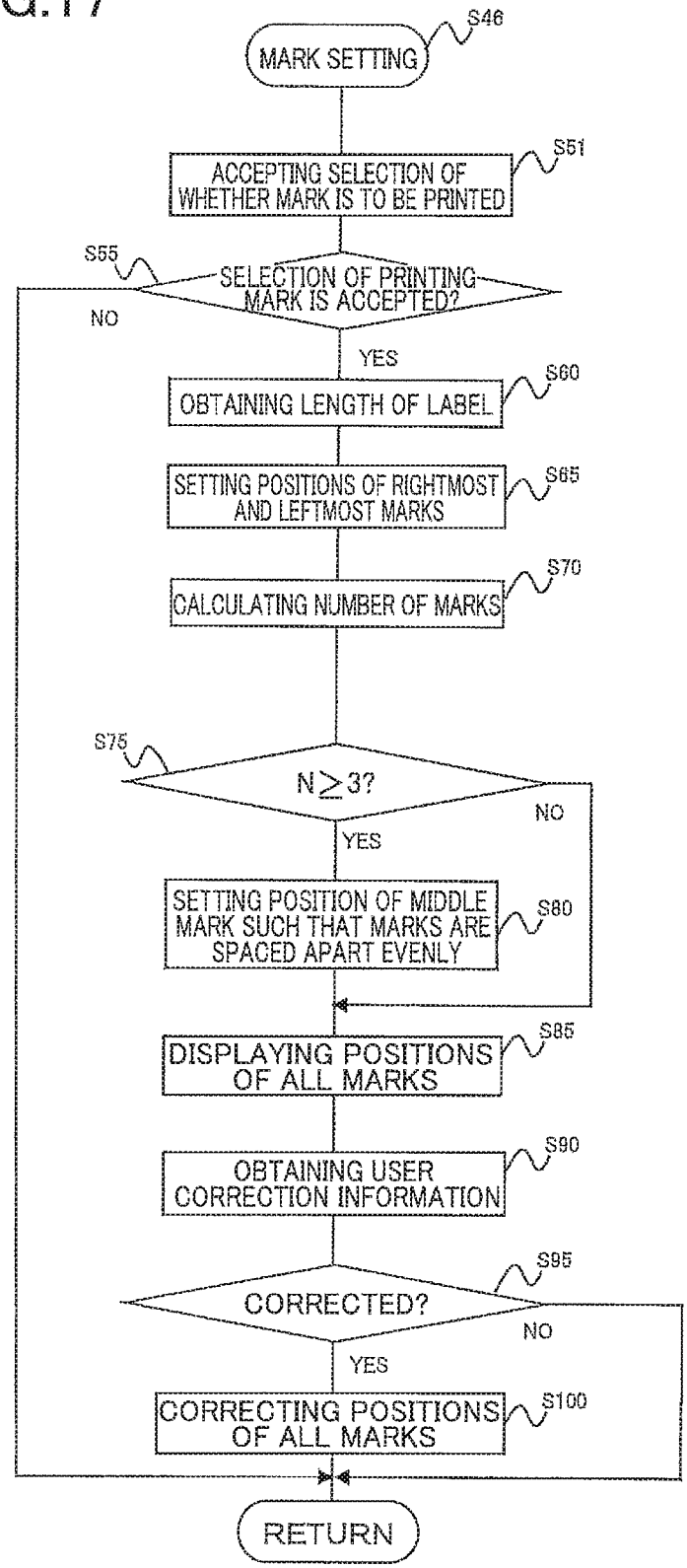
FIG. 17 is a flow chart illustrating a procedure of a processing at S46 in FIG. 14.

There will be next explained a detailed procedure of the mark setting processing at S47 with reference to FIG. 17.

The procedure of the mark setting processing in FIG. 17 begins with S51 at which the selection receiver 407 of the control circuit 2 accepts, via the operation device 3, user's selection of whether the first marks M1 and the second marks M2 are to be printed. That is, in the present embodiment, the user can select whether the marks M1, M2 are to be formed.

Then, the CPU of the control circuit 2 at S55 determines whether user's selection of printing the first marks M1 and the second marks M2 is accepted at S51. When user's selection of printing the first marks M1 and the second marks M2 is accepted (S55: YES), this flow goes to S60. When user's selection of not printing the marks M1, M2 is accepted (S55: NO), this procedure ends, and the flow returns to S5 in FIG. 13.

The length obtainer 406 of the control circuit 2 at S60 obtains the length of the printed print tape T (i.e., the print label L) in the second direction, which length is input by the user via the operation device 3, for example. That is, in the present embodiment, in the case where the print tapes To, T illustrated in FIG. 10 are used, the length of the print label L to be created in the second direction can be selected by the user. It is noted that, in the case where the print tapes To, T illustrated in FIG. 2 are used, the length of the print label L in the second direction is as described above determined uniquely based on which print tape (To, T) is used (based on the half-cut region HC). Thus, the user inputs the length via the operation device 3 in this case. Alternatively, the CPU of the control circuit 2 may automatically detect the length based on a result of detection of the cartridge sensor CS.

The axial-direction mark-position setter 409 and the circumferential-direction mark-position setter 408 of the control circuit 2 at S65 set positions of the first mark M1 and the second mark M2 (in the first direction and in the second direction) in each of the opposite end regions of the print label L, i.e., the left end region W1 and the right end region W3. In the setting of the positions in the first direction, for example, in the case where the outside diameter of the wrapped member 302 is small (in other words, the wrapped member 302 is narrow), the CPU sets the distance between the two marks M1, M2 in the up and down direction to a short distance, and in the case where the outside diameter of the wrapped member 302 is large (in other words, the wrapped member 302 is thick), the CPU sets the distance between the two marks M1, M2 in the up and down direction, to a long distance.

The number-of-marks calculator 410 of the control circuit 2 at S70 calculates the number N of the first marks M1 and the second marks M2 in the second direction, based on the length of the print label L obtained by the length obtainer 406 at S60. Specifically, in the case where it is assumed that the length of the print label L is defined as LL, and a predetermined set distance used when a mark or marks are printed in addition to the two marks is defined as p, the total number N of the first marks M1 or the second marks M2 (including the mark or marks to be added) is calculated by the following expression: N=(LL/p)+2. That is, the number of marks N is increased with increase in the length LL of the print label L, for example.

The CPU of the control circuit 2 at S75 determines whether the total number N of the first marks M1 (or the second marks M2) which is calculated at S70 is greater than or equal to three. When the total number N is greater than or equal to three (S75: YES), this flow goes to S80. When the total number N is less than three (S75: NO), this flow goes to S85.

The axial-direction mark-position setter 409 and the circumferential-direction mark-position setter 408 of the control circuit 2 at S80 set positions of the added marks M1, M2 (the marks M1, M2 except the two marks whose positions are determined at S65) in the first direction and in the second direction, such that all the three or more first marks M1 or second marks M2 are spaced apart evenly in the second direction.

The CPU of the control circuit 2 at S85 outputs a display control signal to the display 4 based on a result of the setting at S65 (or S65 and S80) such that the positions of all the marks M1, M2 on the print tape T are previewed on a screen displayed on the display 4, for example.

The correction-information obtainer 405 of the control circuit 2 at S90 obtains correction information about correction (including no correction) of positions set for all of the marks M1, M2, which correction is performed by the user via the operation device 3 in response to the preview screen. That is, in the present embodiment, the user can correct a result of the setting at S65 (or S65 and S80).

The CPU of the control circuit 2 at S95 determines, based on the result of the obtainment at S90, whether the positions of the marks M1, M2 in the first direction and in the second direction are corrected by the user. When the positions are corrected (S95: YES), this flow goes to S100. When the positions are not corrected (S95: NO), this procedure ends, and the flow returns to S5 in FIG. 13.

The circumferential-direction mark-position setter 408 and the axial-direction mark-position setter 409 of the control circuit 2 at S100, based on the correction information obtained at S90, correct the positions of the marks M1, M2 in the first direction and in the second direction, which positions are set at S65 (or S65 and S80). Upon completion of this processing, this procedure ends, and the flow returns to S5 in FIG. 13.

Effects in First Embodiment

In the first embodiment as described above, the control circuit 2 controls the conveying roller 6 and the thermal head 7 to print the first marks M1 on the adhesive region D1 (or the non-adhesive region D2*a*) and print the second marks M2 on the non-adhesive region D3*a* of the partly-adhesive region D3 such that each of the first marks M1 and a corresponding one of the second marks M2 are arranged in the first direction. In another structure, as described above, the control circuit 2 controls the conveying roller 6 and the thermal head 7 to print the first marks M1 on the adhesive region D5 and the second marks M2 on the partly-adhesive region D7 (or the non-adhesive region D6*b*). With this configuration, this label creating apparatus 1 is capable of creating the print label L on which the first marks M1 and the second marks M2 are printed such that each of the first marks M1 and a corresponding one of the second marks M2 are arranged in the up and down direction. Also, the portions of the print label L are stuck to each other such that the same kind of marks are aligned as described above (see FIGS. 4B, 4C, 8B, and 9B). Accordingly, it is possible to prevent misalignment and skew of the print label L and stick the portions of the print label L to each other in a proper posture. In particular, it is possible to prevent the adhesive from being exposed or lying off the print label L due to the misalignment and skew in the structure having the adhesive layer 22 as described above. This prevents the exposed adhesive from adhering to a hand of the user when the user handles the print label L and prevents the wrapped print label L from adhering to the wrapped member 302 due to the exposed adhesive, which may make it difficult for the wrapped print label L to rotate.

In the first embodiment as described above, the print label L is attached to the wrapped member 302 by sticking the portions of the print label L in the adhesive region D1 and the partly-adhesive region D3 to each other to form the cylindrical member around the wrapped member 302. Thus, an additional force such as a twisting of the wrapped member 302 is not applied to the print label L and the wrapped member 302 as in the conventional structure in which the print label L is wrapped around the wrapped member 302 and cut along the perforation. Also, since the misalignment and skew are reduced during attachment, the print label L can be easily rotated around the wrapped member 302, thereby ensuring viewability from a desired angle.

In the present embodiment, the circumferential-direction mark-position setter 408 sets the positions of the marks M1, M2 in the first direction, based on the outside diameter of the wrapped member 302 which is obtained by the information obtainer 400. In the case where the outside diameter of the wrapped member 302 is small (in other words, the wrapped member 302 is narrow), the cylindrical member having the small diameter corresponding to the small outside diameter of the wrapped member 302 can be shaped by reducing the distance between the two marks M1, M2 in the up and down direction. In the case where the outside diameter of the wrapped member 302 is large (in other words, the wrapped member 302 is thick), increasing the distance between the two marks M1, M2 in the up and down direction can shape the cylindrical member having the large diameter corresponding to the large outside diameter of the wrapped member 302 and form an appropriate space between the cylindrical member and the wrapped member 302.

In the first embodiment, the margin determiner 404 sets the length of each of the margin regions RS in the second direction, based on the outside diameter of the wrapped member 302 which is obtained by the information obtainer 400. In this setting, as described above, in the case where the outside diameter of the wrapped member 302 is small, the lengths of the margin regions RS in the right and left direction are increased to increase the sizes of the margin regions RS. This configuration prevents the character string R (e.g., "A001") formed in the character-string print region RA from being hidden by the first marks M1 and the second marks M2 during wrapping, thereby preventing reduction of the viewability of the character string R formed in the character-string print region RA.

In the first embodiment, the number-of-marks calculator 410 increases the number of the marks M1, M2 with increase in the length of the print label L in the second direction. This configuration facilitates the sticking even in the case of the print label L elongated in the second direction.

Modifications of First Embodiment

While the first embodiment has been described above, it is to be understood that the disclosure is not limited to the details of the illustrated embodiment, but may be embodied with various changes and modifications, which may occur to those skilled in the art, without departing from the spirit and scope of the disclosure. There will be described modifications of the first embodiment. It is noted that the same reference numerals as used in the first embodiment are used to designate the corresponding elements of the modifications, and an explanation of which is simplified or dispensed with.

1.1. Case where First Mark is Printed on Print Tape in Advance

Figure 18:
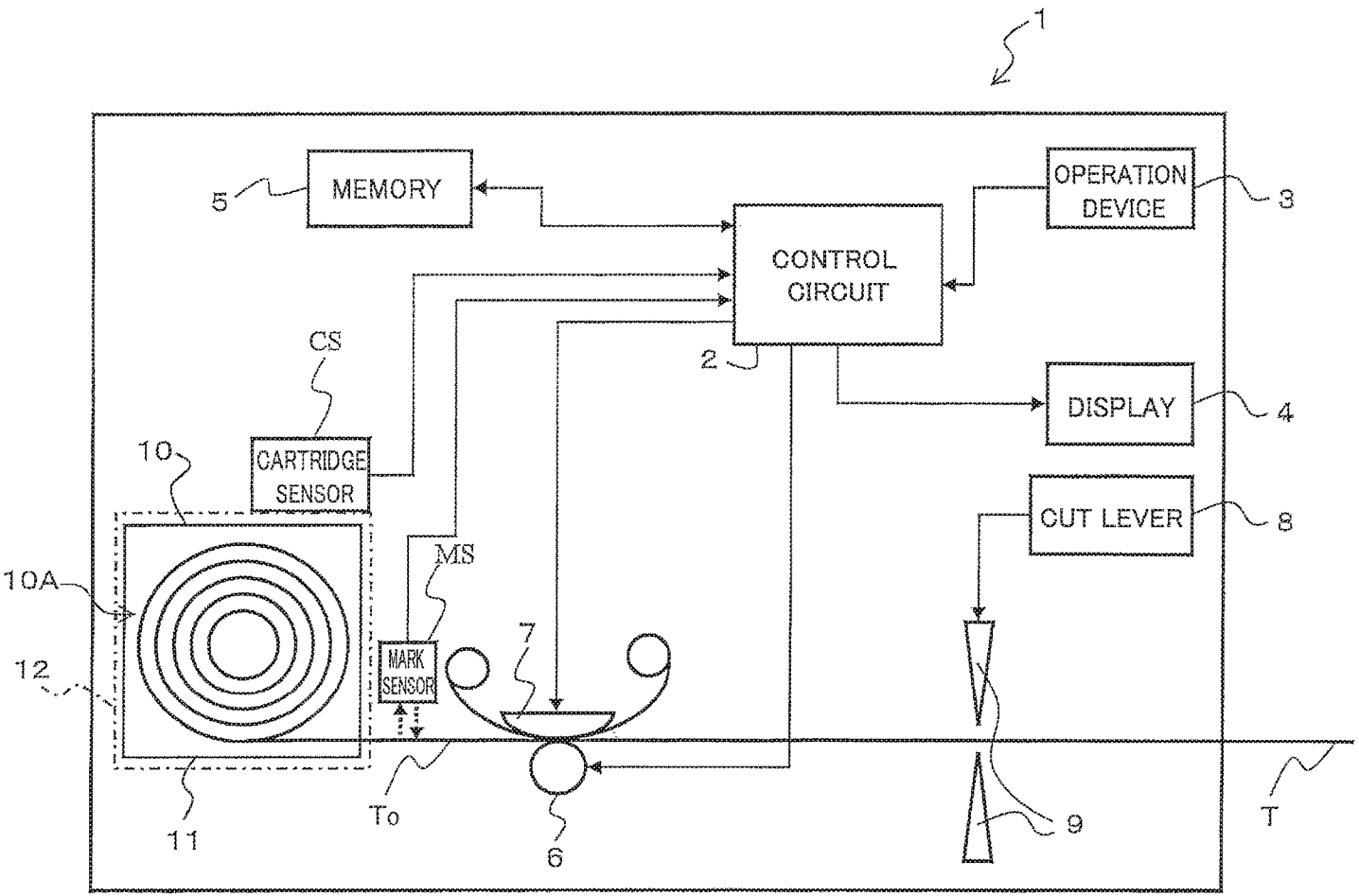
FIG. 18 is a view for explaining a general structure of a label creating apparatus according to a modification in which a first mark is printed on a tape in advance.
Figure 19A:
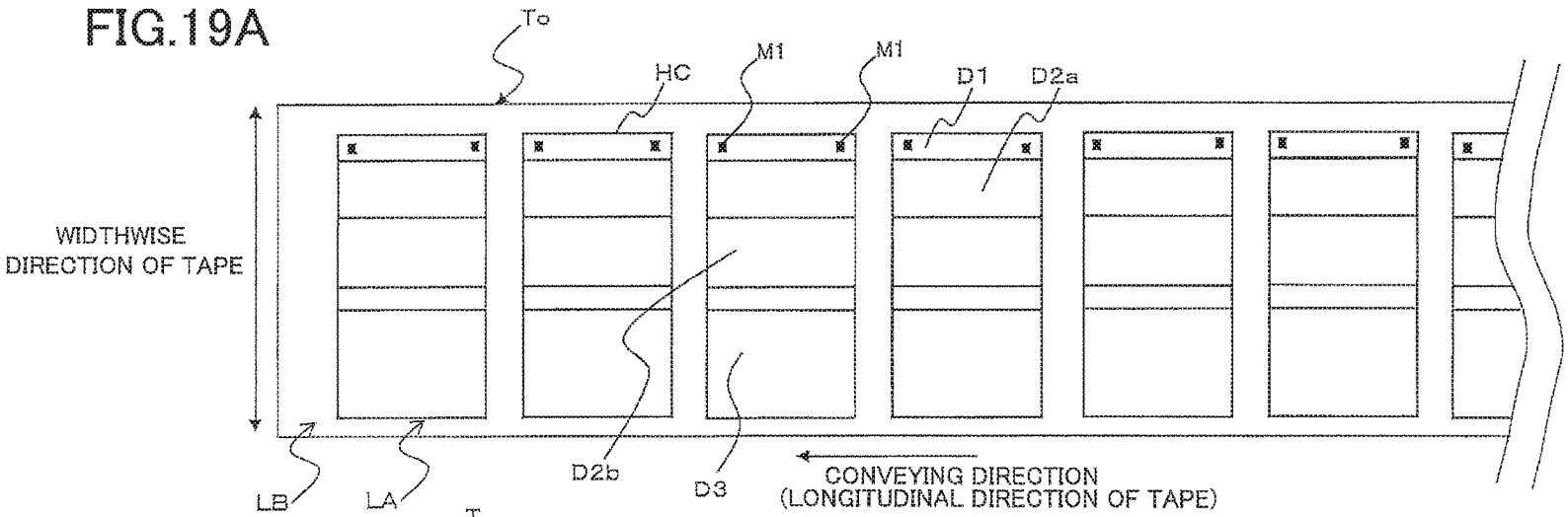
FIG. 19A is a plan view illustrating a print tape before printing.
Figure 19B:
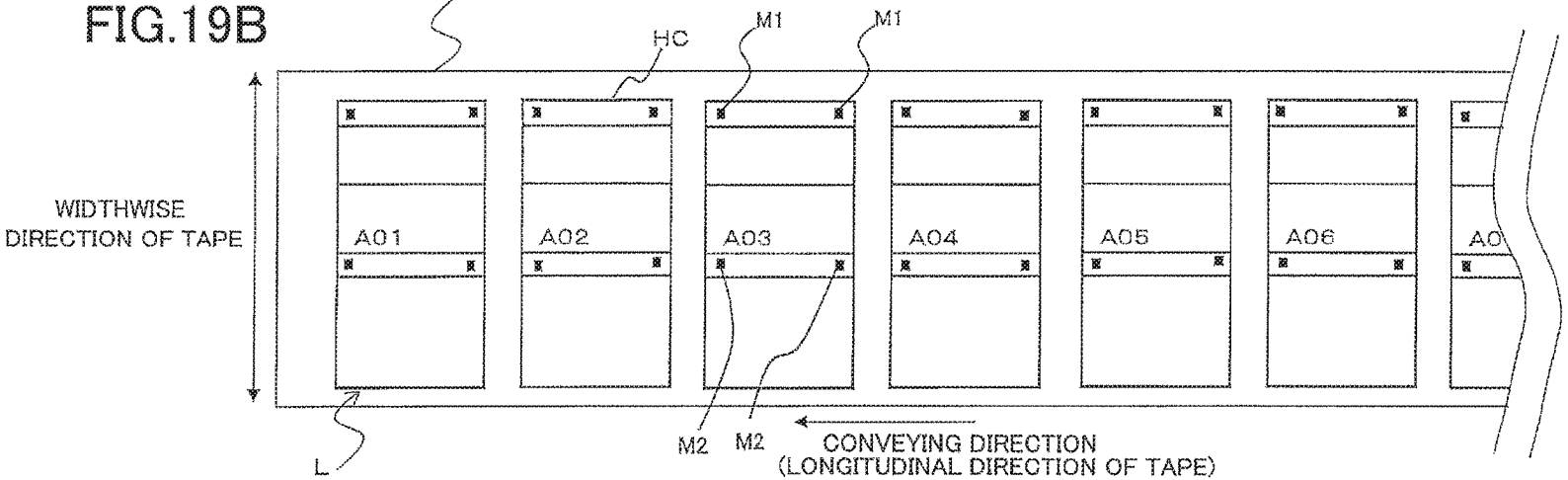
FIG. 19B is a plan view illustrating a print tape after printing.

FIG. 18 illustrates a general structure of the label creating apparatus 1 according to the present modification. FIG. 18 corresponds to FIG. 1. FIGS. 19A and 19B illustrate a structure of a print tape used in the present modification. FIGS. 19A and 19B respectively correspond to FIGS. 2A and 2B.

In the present modification, as illustrated in FIG. 19A, the first marks M1 (each as one example of a print mark) are printed in advance on the print tape To at the same positions as those in the above-described embodiment. In this label creating apparatus 1, as illustrated in FIG. 18, a well-known mark sensor MS is provided to optically detect positions of the first marks M1 on the print tape To in the first direction and in the second direction (see broken-line arrows in FIG. 18), for example. The mark sensor M3 outputs a detection signal to the control circuit 2.

Figure 20:
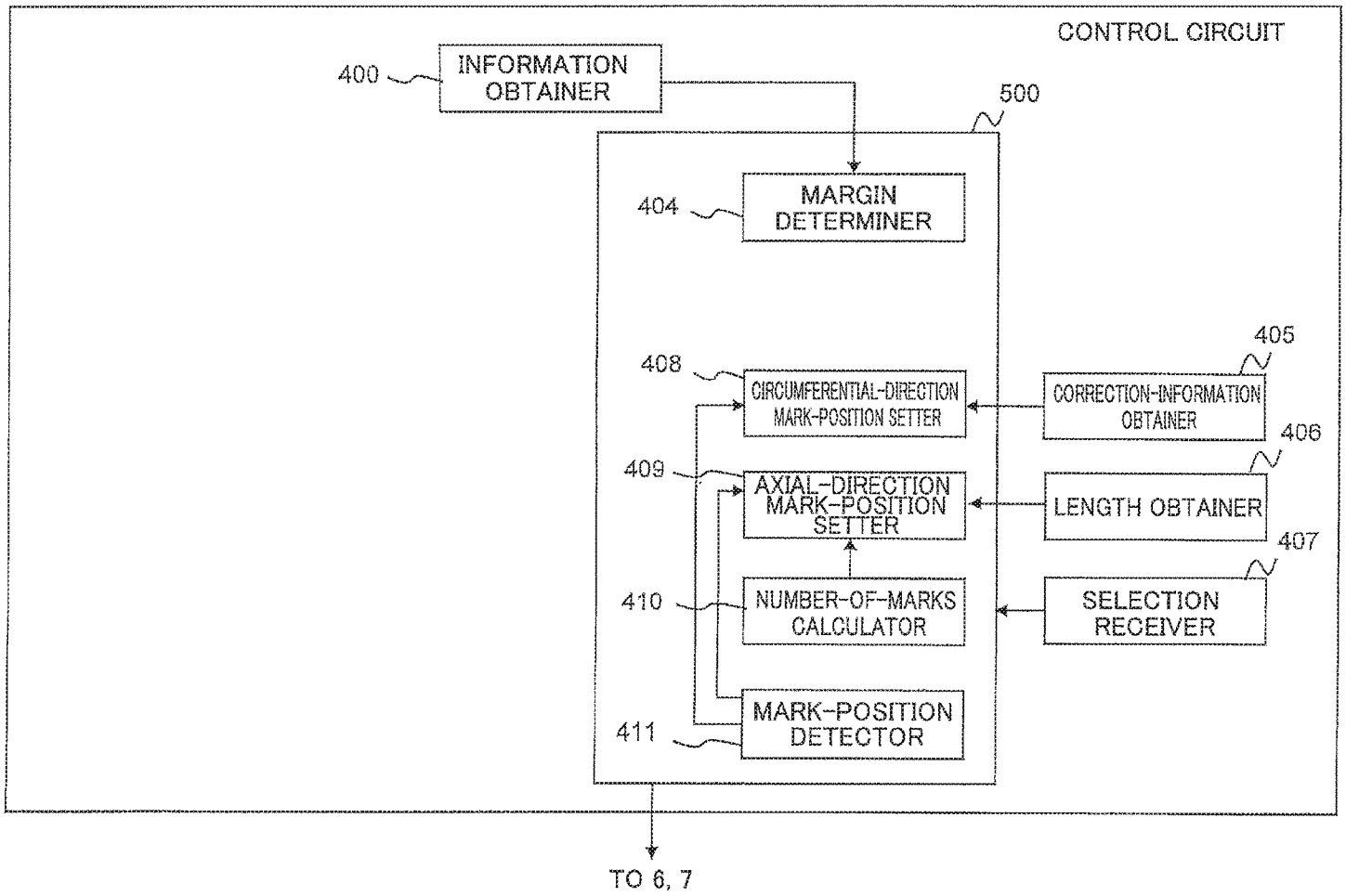
FIG. 20 is a block diagram illustrating a functional configuration of a control circuit.

FIG. 20 illustrates a configuration of the control circuit 2 in the present modification. FIG. 20 corresponds to FIG. 12. In the present modification, as illustrated in FIG. 20, the controller 500 includes a mark-position detector 411 configured to detect positions of the marks M1 and receive the detection signal output from the mark sensor M3. Based on the positions of the marks M1 which are detected by the mark-position detector 411 based on the detection signal, the circumferential-direction mark-position setter 408 and the axial-direction mark-position setter 409 set positions of the marks M2 in the first direction and in the second direction, and the character string R and the marks M2 are printed as described above. As a result, as illustrated in FIG. 19B, the print tape T with the second marks M2 printed at the same positions as those in FIG. 2B is created.

Figure 21:
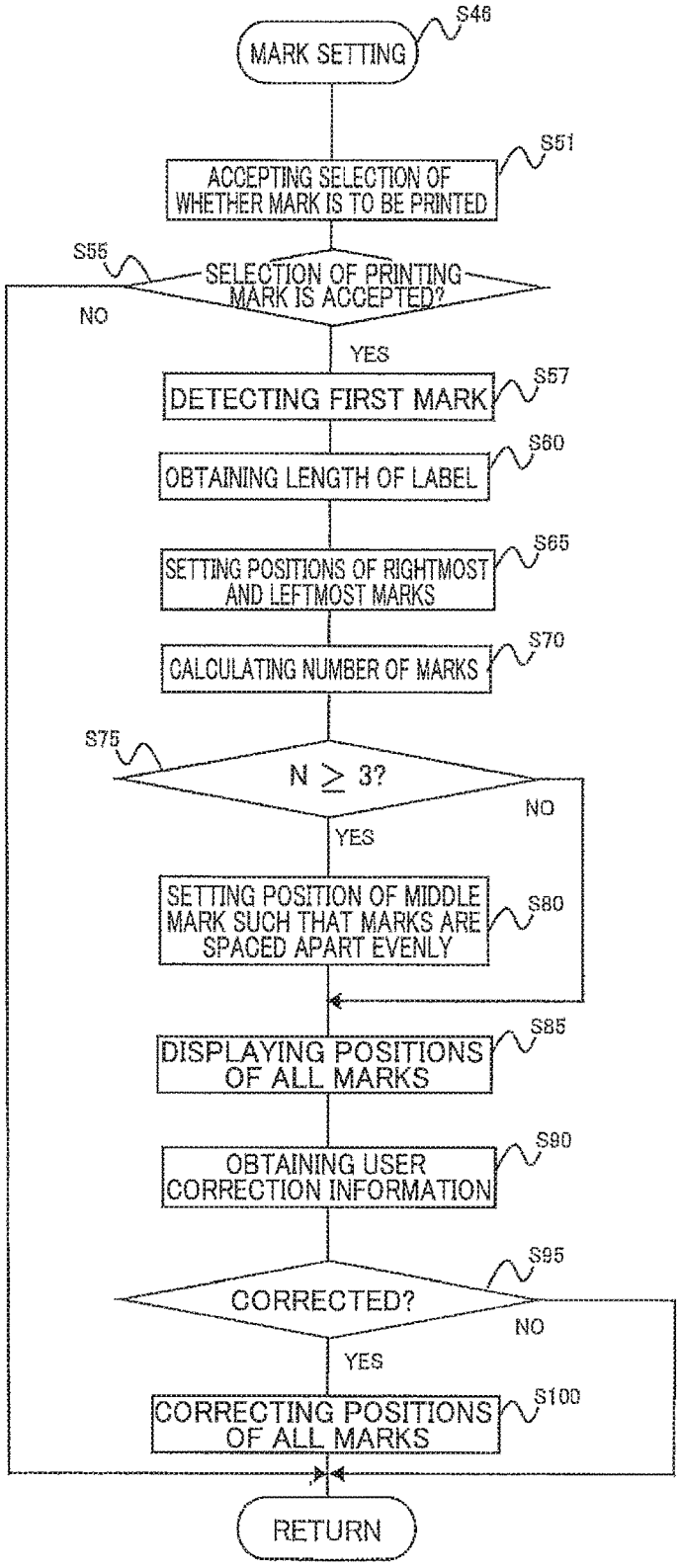
FIG. 21 is a flow chart illustrating a procedure of a mark setting processing in a procedure of control executed by a CPU of the control circuit.

FIG. 21 illustrates a detail of the mark setting processing executed in the present modification. FIG. 21 corresponds to FIG. 17. In the present modification, as illustrated in FIG. 21, a processing at S57 is provided between S55 and S60 in FIG. 17.

That is, the mark-position detector 411 of the control circuit 2 at S57 detects the positions of the marks M1 in the first direction and in the second direction based on a detection signal output from the mark sensor MS. At S65 and S80, positions of the marks M2 in the first direction and in the second direction are set with respect to the positions of the marks M1 which are detected at S57. Processings other than these processings are substantially the same as those in FIG. 17, and an explanation of which is dispensed with.

The present modification also achieves the same effects as those in the above-described embodiment.

1.2. Case where Second Mark is Printed on Print Tape in Advance

The second marks M2 may be printed on the print tape To in advance. That is, in this case, the second marks M2 (each as another example of the print mark) are printed in advance on the print tape To at the same positions as those in the above-described embodiment though not illustrated. In this label creating apparatus 1, as illustrated in FIG. 18, the above-described mark sensor MS is provided to output a detection signal to the mark-position detector 411 of the control circuit 2. Based on the positions of the marks M1 which are detected by the mark-position detector 411 based on the detection signal, the circumferential-direction mark-position setter 408 and the axial-direction mark-position setter 409 set positions of the marks M1 in the first direction and in the second direction, and the character string R and the marks M1 are printed as described above. As a result, as illustrated in FIG. 19B, the print tape T with the first marks M1 printed at the same positions as those in FIG. 2B is created.

The present modification also achieves the same effects as those in the above-described embodiment.

1.3. Case where Mark Setting is Performed by Operation Terminal

While the present disclosure is applied to the standalone label creating apparatus 1 capable of working alone, but the present disclosure is not limited to this configuration. That is, the above-described processings may be executed on an operation terminal (as one example of a terminal) that is connected to a label creating apparatus similar in configuration to the label creating apparatus described above such that information is transmittable and receivable between the operation terminal and the label creating apparatus. In this case, the operation terminal includes a CPU, an operation device, and a memory configured to store a printed-medium creating program.

That is, the CPU first executes a processing similar to the print setting processing at S1 in FIG. 13, according to the printed-medium creating program.

The CPU then outputs print data (as one example of a control procedure) containing information about the print setting processing, to the label creating apparatus similar in configuration to the label creating apparatus described above. Upon reception of the output print data, the label creating apparatus executes processings similar to the processings at S15-S40 in FIG. 13. These processings enable the CPU of the operation terminal to perform setting on the marks on the print label L which has been explained taking the standalone label creating apparatus 1.

The present modification also achieves the same effects as those in the above-described embodiment.

Second Embodiment

There will be next explained a second embodiment. It is noted that the same reference numerals as used in the first embodiment and the modifications thereof are used to designate the corresponding elements of the second embodiment, and an explanation of which is simplified or dispensed with.

BACKGROUND

Figure 22B:
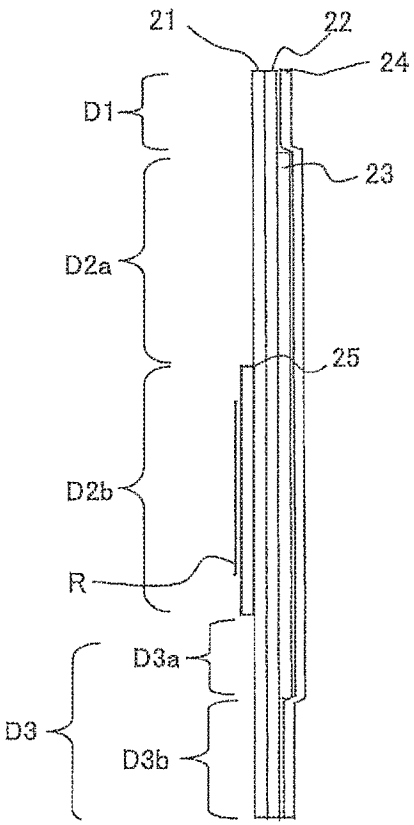
FIG. 22B is a cross-sectional view taken along line XXIIB-XXIIB in FIG. 22A.
Figure 22A:
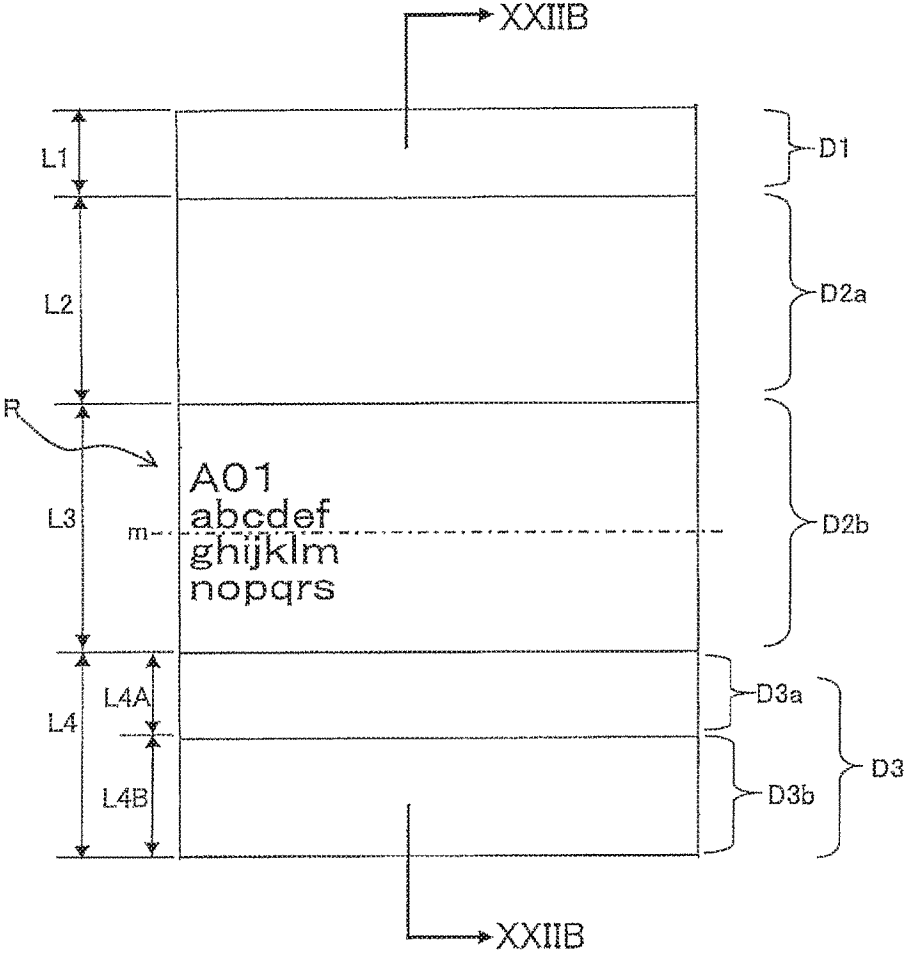
FIG. 22A is a development plan view of a print label in a configuration that is a precondition for a second embodiment.

There will be explained a background of the present embodiment with reference to FIGS. 22A-25B. FIGS. 22A and 22B respectively correspond to FIGS. 3A and 3B. FIG. 22A is a plan view of a print label L. FIG. 22B is a cross-sectional view taken along line XXIIB-XXIIB in FIG. 22A.

Figure 23A:
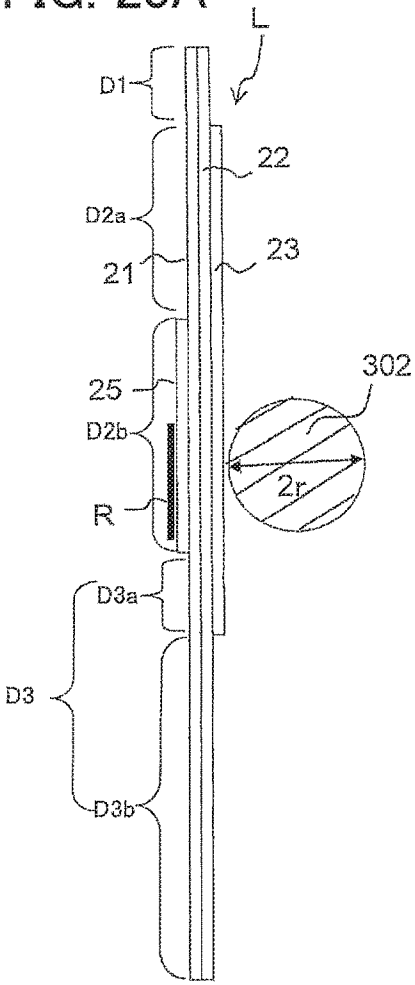
FIGS. 23A through 23C are views for explaining a procedure of attachment of the print label to a wrapped member.
Figure 23B:
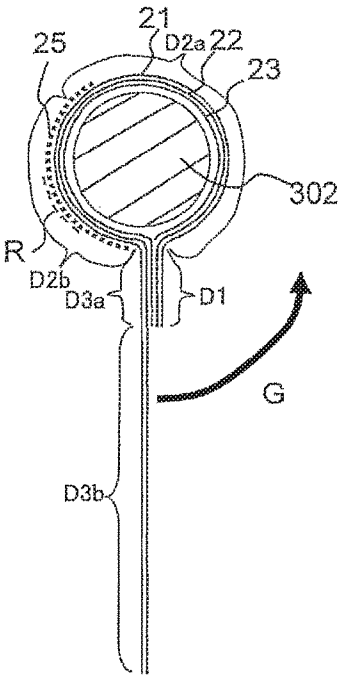
Figure 23C:
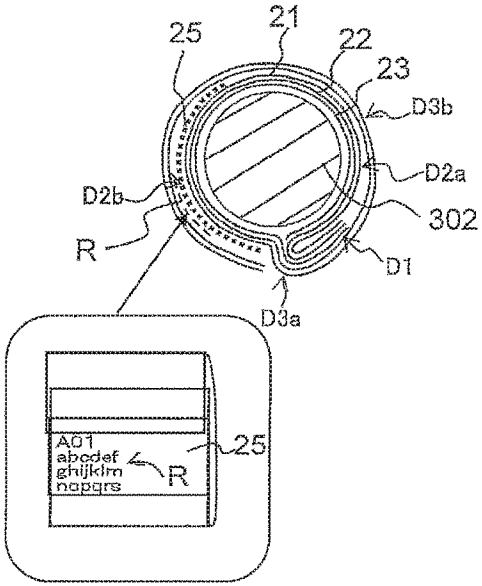

As illustrated in FIGS. 22A and 22B, in this example, four lines of the character strings R respectively representing "A01", "abcdef", "ghijklm", and "nopqrs" are formed on the printing background layer 25 in the non-adhesive region D2*b*. When the print label L is attached to a wrapped member, as illustrated in FIGS. 23A-23C, as described above, the print label L is wrapped around the wrapped member 302 so as to form a cylindrical member surrounding the wrapped member 302, and then the adhesive layer 22 in the adhesive region D1 as a distal end portion of the print label L (noted that the adhesive layer 22 in the adhesive region D1 serves as the sticking portion) is stuck to a portion of the adhesive layer 22 in the non-adhesive region D3*a* of the partly-adhesive region D3 (noted that the portion serves as the stuck portion) via the non-adhesive layer 23 (that is, the inner-sides sticking is performed). As a result, as illustrated in FIG. 23C, the character strings R respectively representing "A01", "abcdef", "ghijklm", and "nopqrs" on the printing background layer 25 are covered with a portion of the print label L in the adhesive region D3*b* (noted that the enlarged view in FIG. 23C illustrates the printing background layer 25 viewed from a position nearest thereto inside the portion of the print label L in the adhesive region D3*b*). However, since portions of the base layer 21 and the adhesive layer 22 in the adhesive region D3*b* are transparent, the character strings R are visually recognizable. In FIG. 23, the printing background layer 25 and the character strings R are indicated in manners different from that of the other layers for clarification of the layers. Specifically, the printing background layer 25 is indicated by the bold broken line, and the character strings R are indicated by the broken lines. This manner of illustration is used in other figures.

Inconvenience in the Case of Wrapped Member of Small Diameter

Figure 24B:
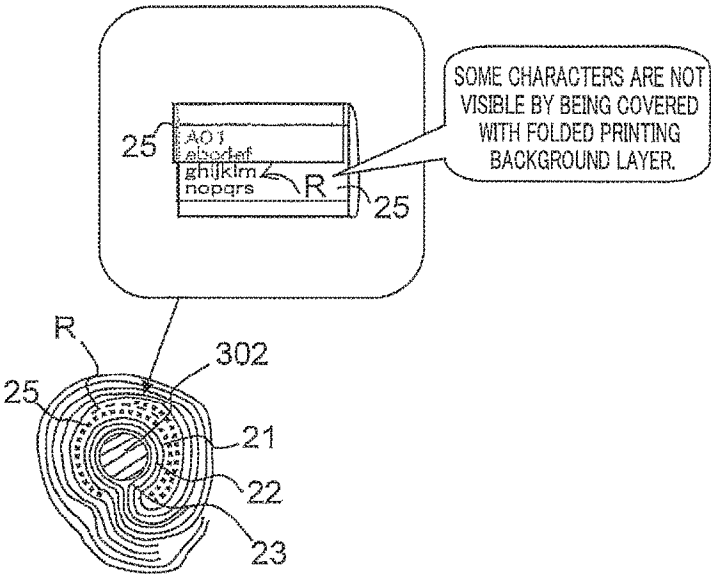
FIGS. 24A and 24B are cross-sectional views for explaining a problem in attachment of the print label to a wrapped member having a small diameter.
Figure 24A:
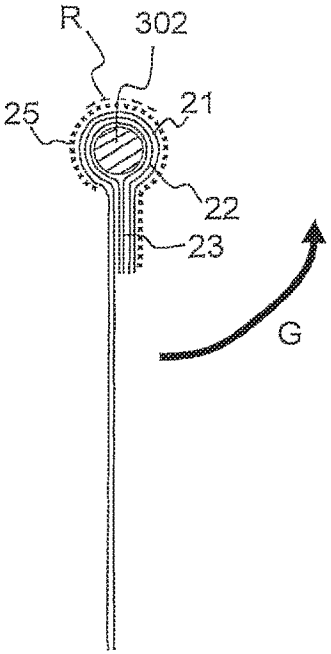

FIGS. 24A and 24B illustrate one example in which the print label L is attached to the wrapped member 302 having an outside diameter less than that of the wrapped member 302 illustrated in FIGS. 23A-23C. FIGS. 24A and 24B respectively correspond to FIGS. 23B and 23C. In this case, as a result of the wrapping in the inner-sides sticking (in which the rest portion due to the inner-sides sticking is folded and wrapped around the outer circumferential portion), as illustrated in FIG. 24B, the folded printing background layer 25 may cover the character strings R so as to make it impossible or difficult to visually recognize the character strings R. In this example, as illustrated in the enlarged view in FIG. 24B (noted that the enlarged view in FIG. 24B illustrates the printing background layer 25 viewed from a position nearest thereto inside the portion of the print label L in the adhesive region D3*b*), the character strings R respectively representing "A01" and "abcdef" are not visually recognized due to the printing background layer 25 among the character strings R respectively representing "A01", "abcdef", "ghijklm", and "nopqrs".

Inconvenience in the Case of Wrapped Member of Large Diameter

Figures 25A, 25B:
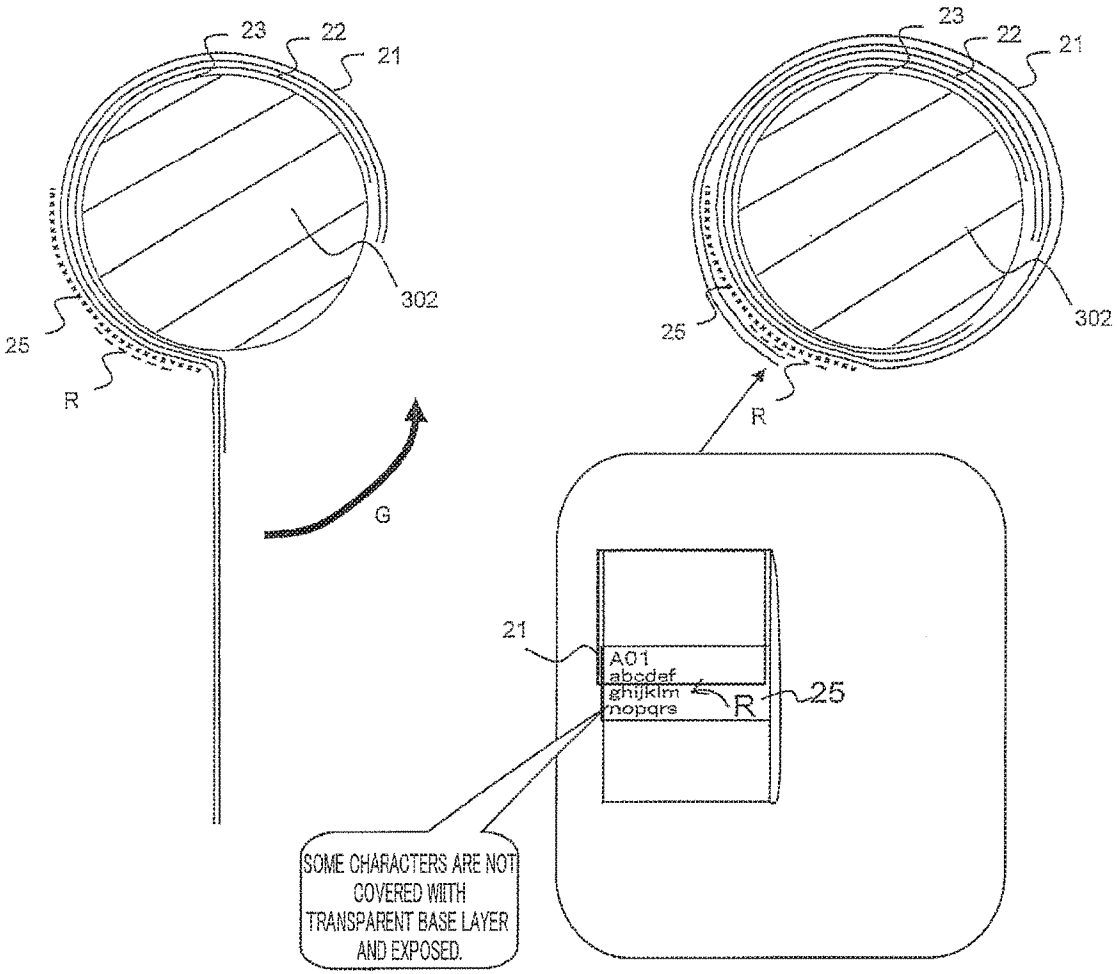
FIGS. 25A and 25B are cross-sectional views for explaining a problem in attachment of the print label to a wrapped member having a large diameter.

FIGS. 25A and 25B illustrate one example in which the print label L is attached to the wrapped member 302 having an outside diameter greater than that of the wrapped member 302 illustrated in FIGS. 23A-23C. FIGS. 25A and 25B respectively correspond to FIGS. 23B and 23C.

Ideally, as described in FIGS. 23A-23C, the character strings R formed on the printing background layer 25 are covered with and protected by the transparent base layer 21 in the adhesive region D3*b*, which is wrapped on an outer circumferential portion of the printing background layer 25, so as to ensure viewability of the character strings R, thereby preventing the character strings R from being soiled or faded.

However, in the case illustrated in FIGS. 25A and 25B, some of the character strings R ("ghijklm" and "nopqrs" among "A01", "abcdef", "ghijklm", and "nopqrs" in this example) are not covered with the base layer 21 and are exposed (see the enlarged view in FIG. 25B). That is, it is impossible to cover this portion with the transparent base layer 21 for protection.

Overview of Technique in Present Embodiment

To solve this problem, in this second embodiment, in the case where the outside diameter of the wrapped member 302 is small as described above, for example, the character strings R are printed on one-side portion of the print label L in the circumferential direction of the wrapped member 302 (in the direction in which the print label L is wrapped), thereby preventing the character strings R from being covered with the printing background layer 25, thereby reducing an amount of lowering of the viewability. Specifically, a limitation in the first direction is imposed on the character-string print region RA set on the portion of the printing background layer 25 in the non-adhesive region D2*b* (for example, a limitation is imposed on the length of the character-string print region RA in the first direction or on positions of upper and lower ends of the character-string print region RA in the first direction), and the thermal head 7 is allowed to form the character strings R on the limited character-string print region RA. In this respect, the character-string print region RA may be hereinafter referred to as "character-string printable region RA". In the present embodiment, since the margin regions RS are not always set (or set to regions having the fixed width), the following explanation omits illustration and explanation of the margin regions RS.

Figure 26B:
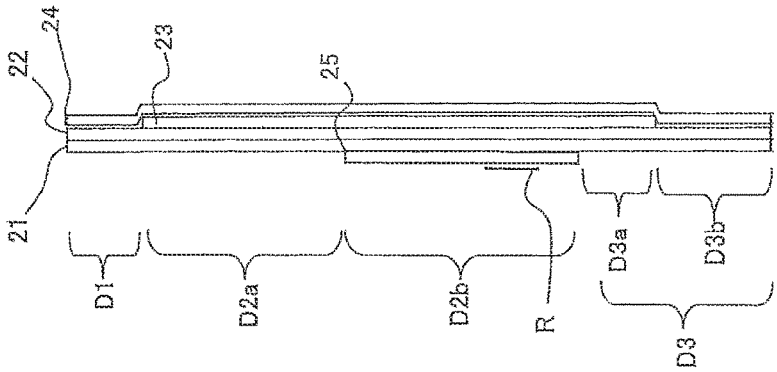
FIG. 26B is a cross-sectional view taken along line XXVIB-XXVIB in FIG. 26A.

That is, in the example illustrated in FIGS. 26A and 26B, the character-string printable region RA is set below a center line m extending through a center of the portion of the printing background layer 25 in the first direction in the non-adhesive region D2*b* in FIGS. 26A and 26B if possible. In other words, the character-string printable region RA is set on one side of the center line m in the first direction. That is, the position of the upper end of the character-string printable region RA is located below the center line m in FIGS. 26A and 26B, which reduces the dimension (height) of the character-string printable region RA in the up and down direction in FIGS. 26A and 26B (in the first direction).

The maximum values are set for the number of lines and the font size of the character strings R printable on the character-string printable region RA, in other words, the number of lines and the font size are limited. In this example, the font size of the character strings R is made smaller than those in the example in FIG. 22, and the number of lines on the character-string printable region RA is reduced from four to two, so that not the four character strings R respectively representing "A01", "abcdef", "ghijklm", and "nopqrs" but only the two character strings R respectively representing "A01" and "abcdef" are printed.

Figure 27B:
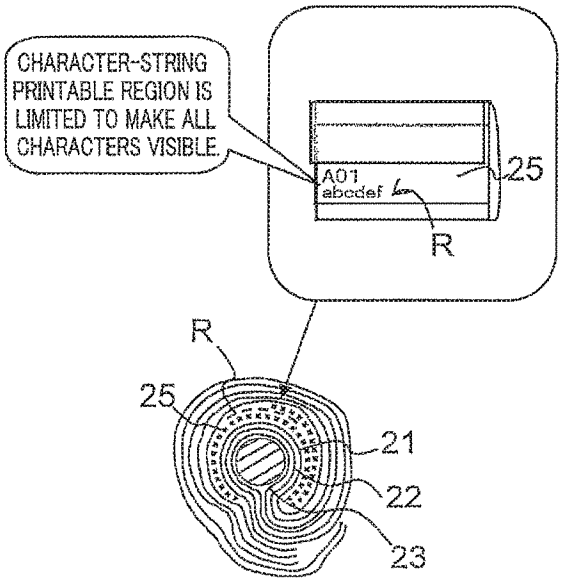
FIGS. 27A and 27B are cross-sectional views for explaining behavior in attachment of the print label to a wrapped member having a small diameter.
Figure 27A:
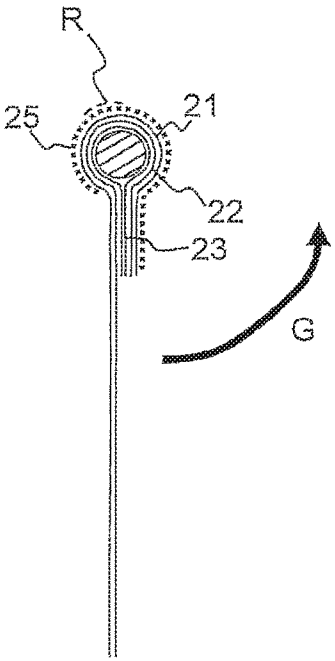

As a result, as illustrated in FIGS. 27A and 27B respectively corresponding to FIGS. 24A and 24B, since the character-string printable region RA is displaced as described above even after the print label L is attached to the wrapped member 302, the printing background layer 25 does not cover all the character strings R ("A01" and "abcdef"), ensuring the viewability.

Figure 28B:
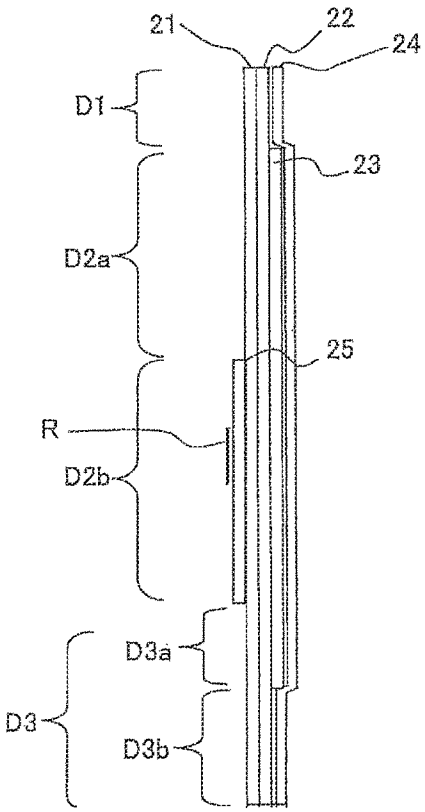
FIG. 28B is a cross-sectional view taken along line XXVIIIB-XXVIIIB in FIG. 26A.
Figure 28A:
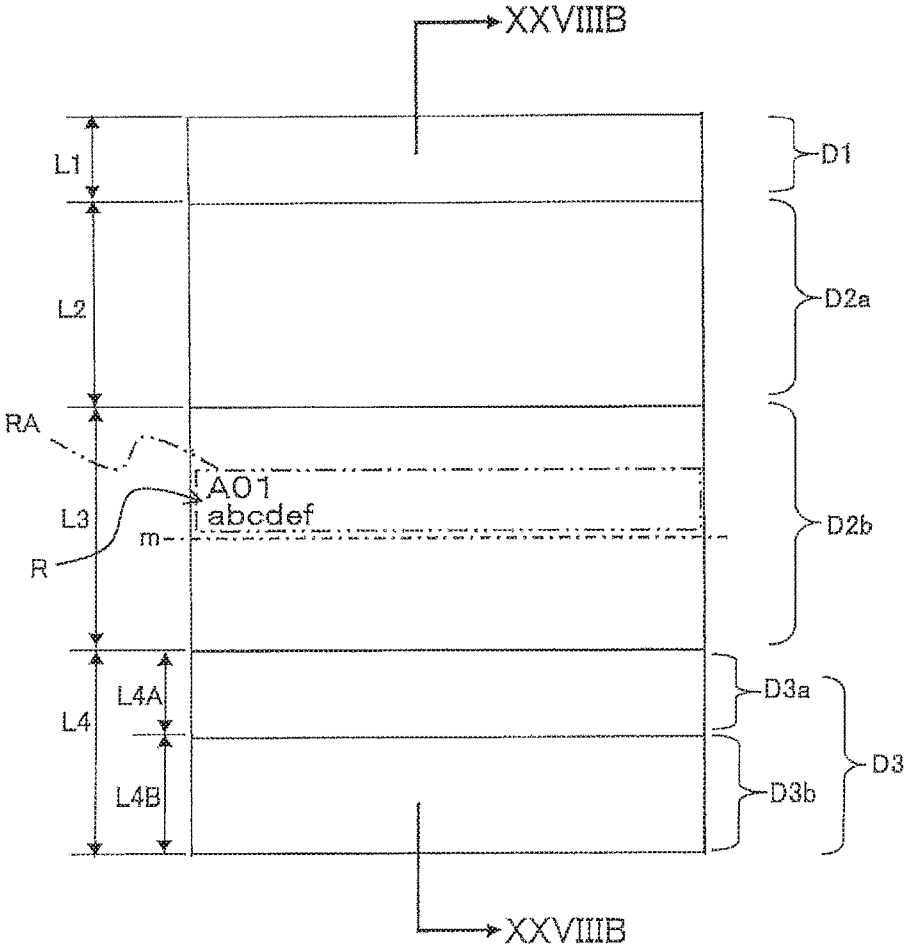
FIG. 28A is a development plan view of another example of the print label in the second embodiment.

In the case where the outside diameter of the wrapped member 302 is large, on the other hand, the character strings R are printed on the other-side portion of the print label L in the circumferential direction of the wrapped member 302, whereby the transparent region reliably covers the printing background layer 25, thereby ensuring the viewability and preventing the character strings R from being soiled or faded. Specifically, as illustrated in FIGS. 28A and 28B, the character-string printable region RA is set above the center line m extending through the center of the portion of the printing background layer 25 in the first direction in the non-adhesive region D2*b* in FIGS. 28A and 28B. In other words, the character-string printable region RA is set on the other side of the center line m in the first direction. That is, the position of the lower end of the character-string printable region RA is located above the center line m in FIGS. 28A and 28B, which reduces the height of the character-string printable region RA.

As in the above-described case, the maximum values are set for the number of lines and the font size of the character strings R printable on the character-string printable region RA, in other words, the number of lines and the font size are limited. In this example, the font size of the character strings R is made smaller than those in the example in FIG. 22, and the number of lines on the character-string printable region RA is reduced from four to two, so that not the four character strings R respectively representing "A01", "abcdef", "ghijklm", and "nopqrs" but only the two character strings R respectively representing "A01" and "abcdef" are printed.

Figure 29B:
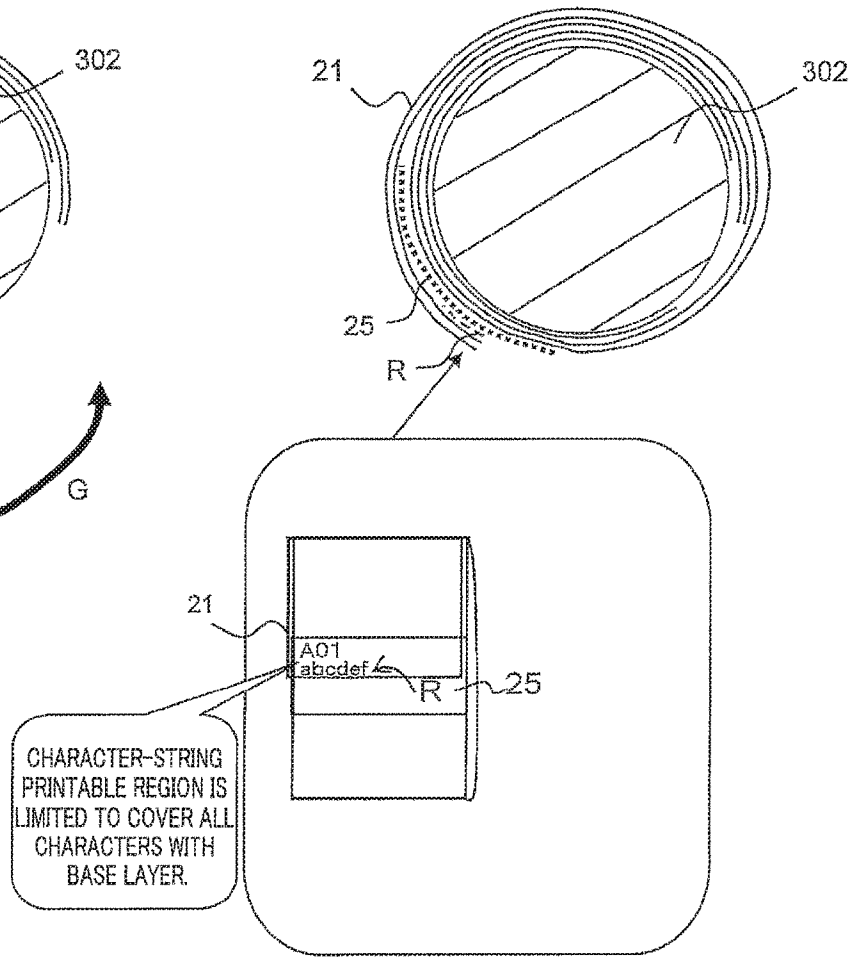
FIGS. 29A and 29B are cross-sectional views for explaining behavior in attachment of the print label to a wrapped member having a large diameter.
Figure 29A:
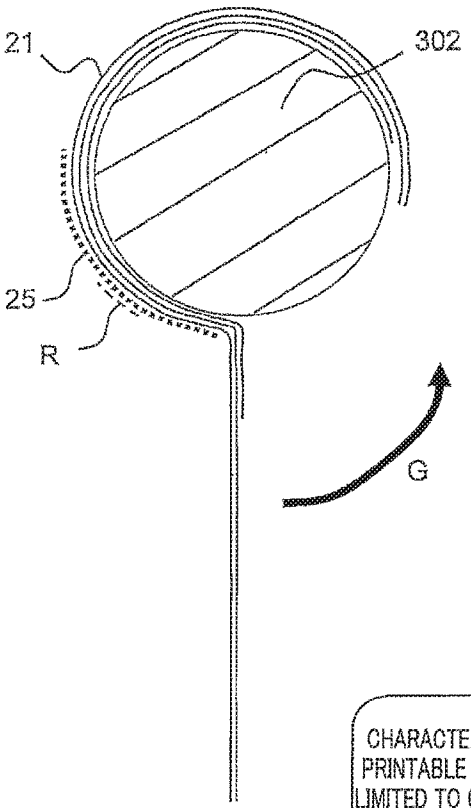

As a result, as illustrated in FIGS. 29A and 29B respectively corresponding to FIGS. 24A and 24B, since the character-string printable region RA is displaced as described above even after the print label L is attached to the wrapped member 302, all the character strings R ("A01" and "abcdef") are covered with the base layer 21, thereby ensuring the viewability and protecting the character strings R.

Center Alignment

There will be next explained other examples of the technique in the present embodiment with reference to FIGS. 30A-31B. In these examples, the center line of the character-string printable region RA in the first direction is aligned with the center line m as in the case in FIG. 22 (center alignment).

Figure 30B:
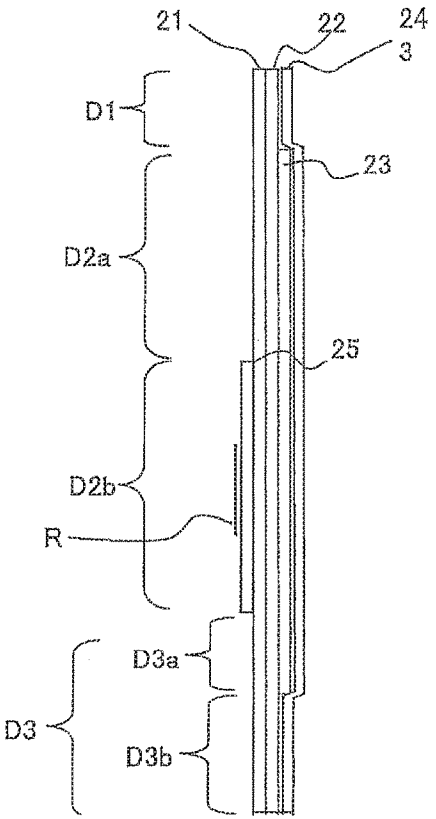
FIG. 30B is a cross-sectional view taken along line XXXB-XXXB in FIG. 30A.
Figure 30A:
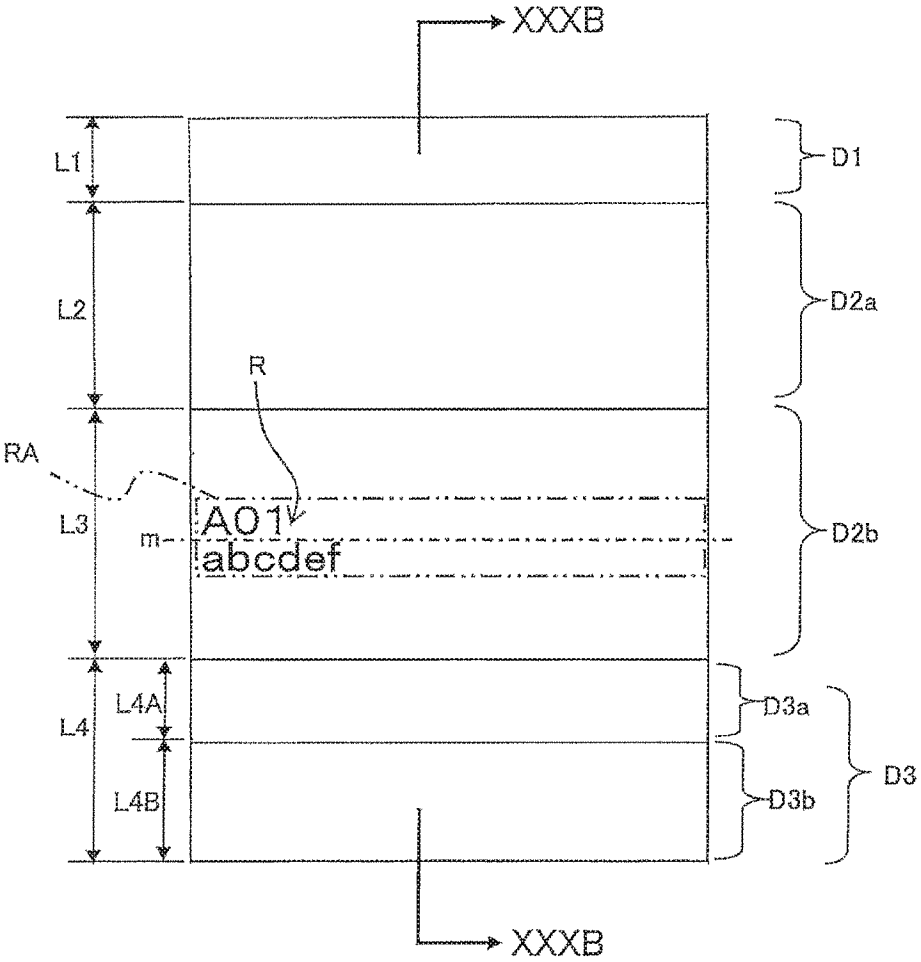
FIG. 30A is a development plan view of still another example of the print label in the second embodiment.
Figure 31B:
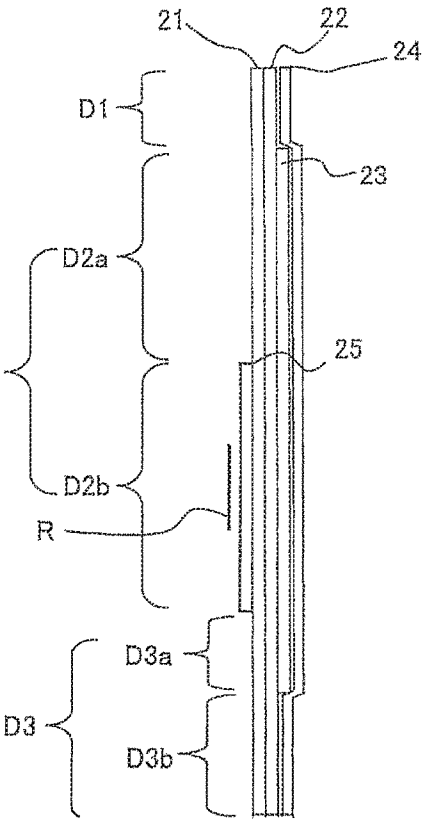
FIG. 31B is a cross-sectional view taken along line XXXIB-XXXIB in FIG. 30A.
Figure 31A:
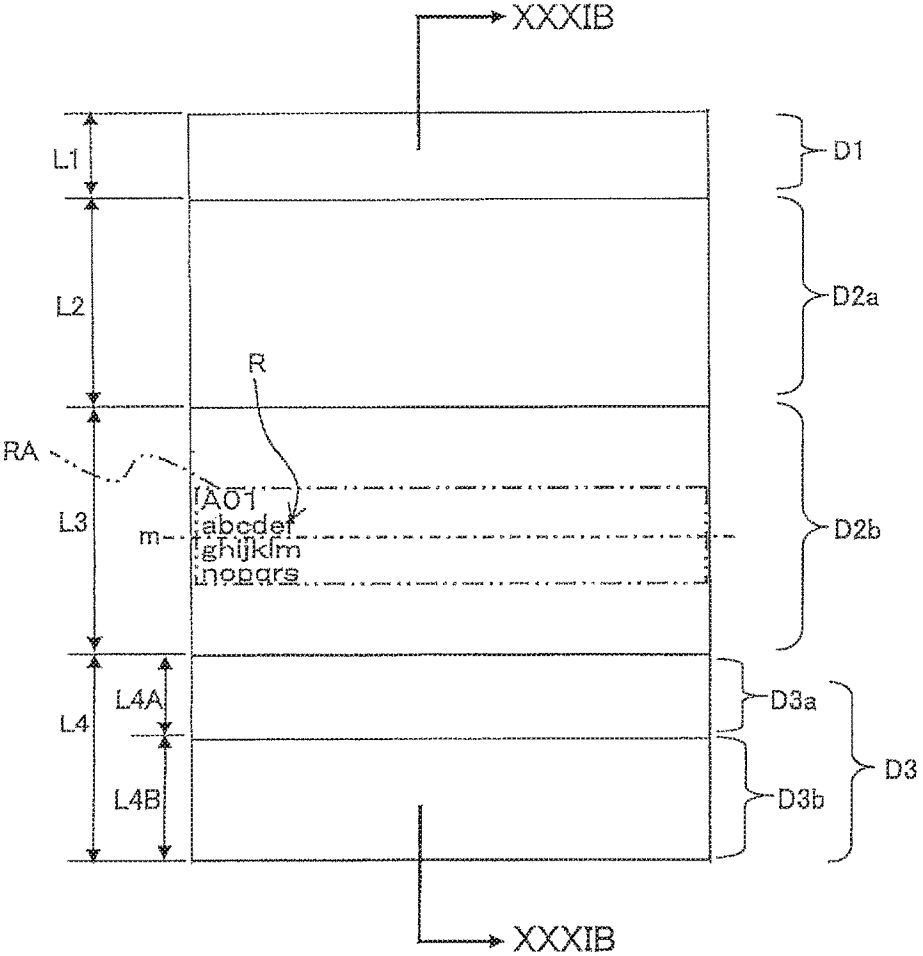
FIG. 31A is a development plan view of still another example of the print label in the second embodiment.

In the example illustrated in FIG. 30, not the character strings R respectively representing "A01", "abcdef", "ghijklm", and "nopqrs" but only the character strings R respectively representing "A01" and "abcdef" are printed without change of the font size, thereby reducing the height of the character-string printable region RA when compared with the example in FIG. 22. In the example illustrated in FIG. 31, the font size of each character of the character strings R respectively representing "A01", "abcdef", "ghijklm", and "nopqrs" is made smaller than in the example in FIG. 22, thereby reducing the height of the character-string printable region RA when compared with the example in FIG. 22.

In any of these cases, the positions of the lower and upper ends of the character-string printable region RA are displaced toward one side or the other side in the circumferential direction when compared with the case in FIG. 22, thereby achieving the same effects as those described above.

Control Circuit

Figure 32:
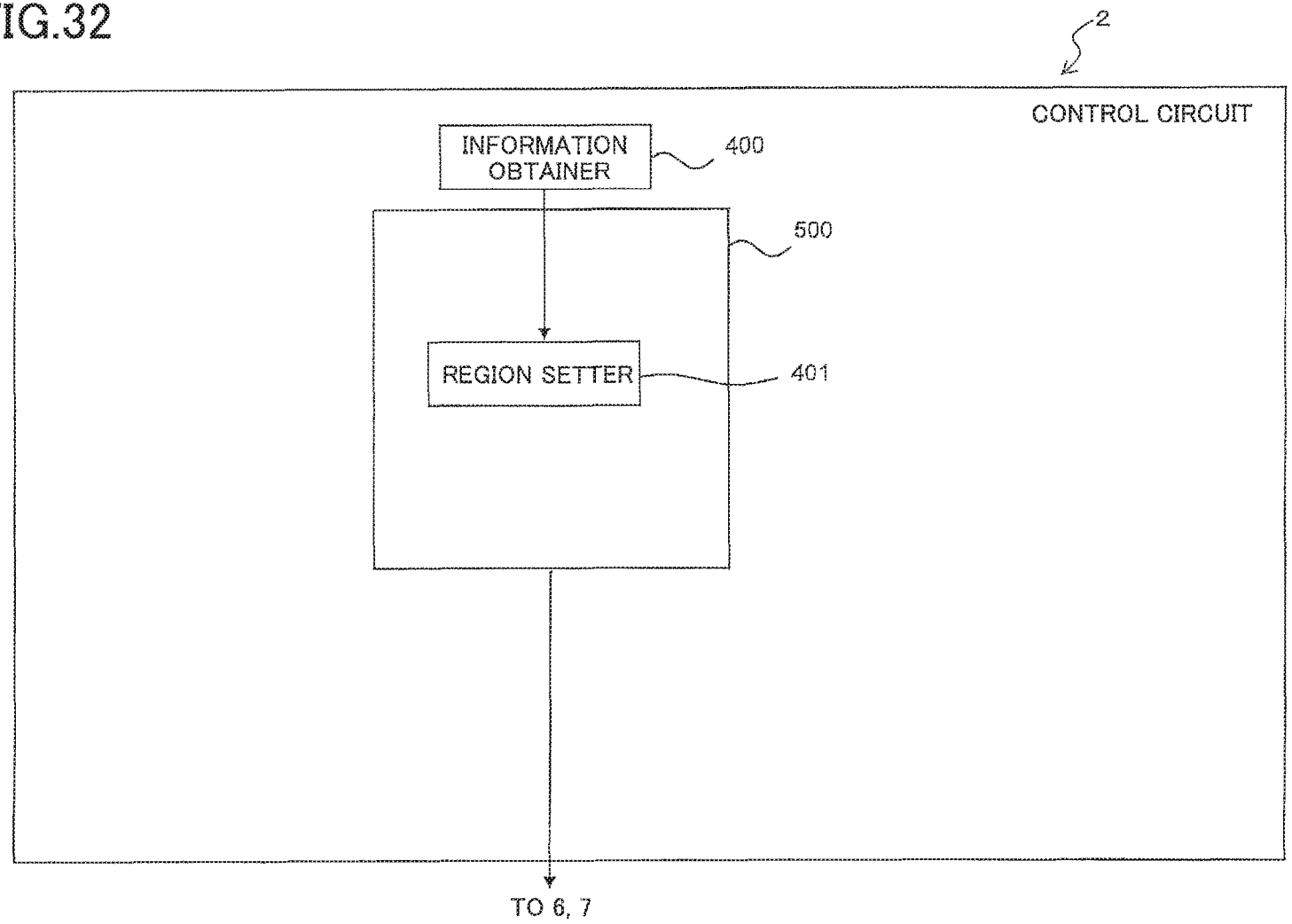
FIG. 32 is a block diagram illustrating a functional configuration of a control circuit.

There will be next explained a configuration and a control procedure of the control circuit 2 for achieving the above-described functions in the present embodiment. FIG. 32 illustrates a functional configuration of the control circuit 2. In the present embodiment, as illustrated in FIG. 32, the control circuit 2 functionally includes only the controller 500 and the information obtainer 400. The controller 500 includes only a region setter 401. Functions of these elements will be described later in detail.

There will be next explained a procedure of the print setting processing executed by the control circuit 2 in the second embodiment.

Detailed Procedure of Print Setting Processing

Figure 33:
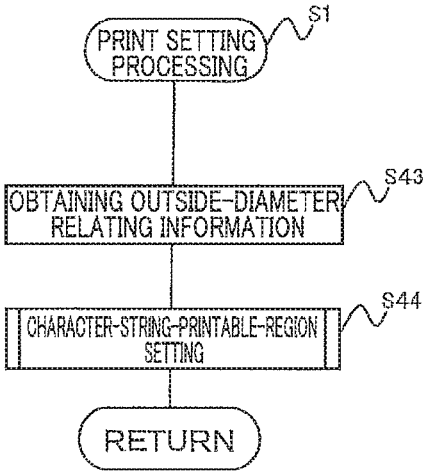
FIG. 33 is a flow chart illustrating a procedure of control executed by a CPU of the control circuit.

FIG. 33 illustrates the print setting processing executed in the present embodiment. FIG. 33 corresponds to FIG. 14. In the present embodiment, as illustrated in FIG. 33, a processing at S44 is provided instead of the processings at S45 and S46 in FIG. 14.

That is, the flow goes to S44 after the information obtainer 400 obtains the outside-diameter relating information at S43 as in the first embodiment.

The region setter 401 of the control circuit 2 at S44 executes a character-string-printable-region setting processing for adjustably setting the character-string printable region RA based on the outside-diameter relating information obtained at S43. Upon completion of this processing, this procedure ends, and the flow returns to S5 in FIG. 13.

Setting of Character-string Printable Region

Figure 34:
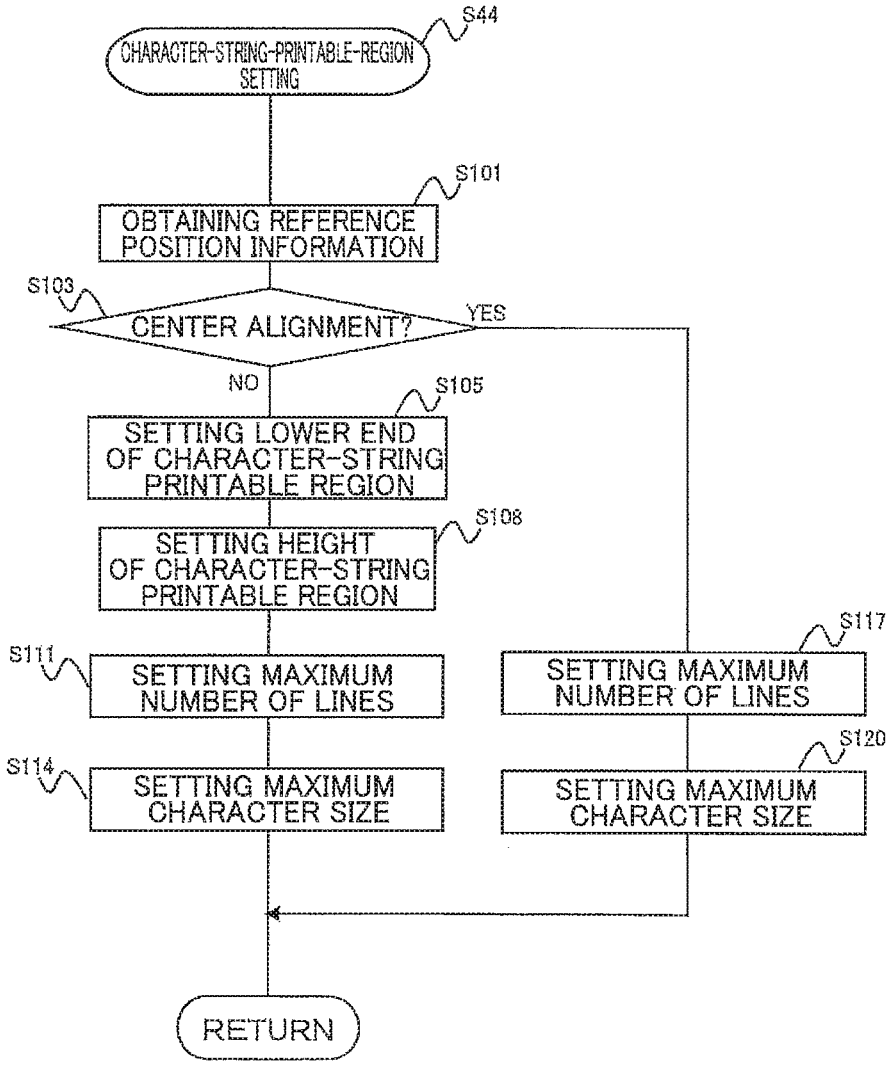
FIG. 34 is a flow chart illustrating a procedure of a processing at S44 in FIG. 33.

There will be next explained a procedure of the character-string-printable-region setting processing with reference to FIG. 34.

The procedure in FIG. 34 begins with S101 at which the CPU of the control circuit 2 receives alignment reference position information input by the user via the operation device 3. The alignment reference position information indicates whether setting on the character-string printable region RA is the above-described center alignment (see FIGS. 30 and 31) or another type of alignment (see FIGS. 26 and 28). That is, in the present embodiment, the user is allowed to select the type of alignment to any of the center alignment and the above-described normal alignment.

The CPU of the control circuit 2 at S103 determines whether selection indicating use of the center alignment is received at S101. When selection of the center alignment is not received, that is, when selection of the above-described normal alignment is received (S103: NO), this flow goes to S105. When selection of the center alignment is received (S103: YES), this flow goes to S117.

At S105, S108, S111, and S114, the region setter 401 of the control circuit 2 sets, based on the outside-diameter relating information obtained at S43 (the outside diameter in the above-described example), the position of the lower end of the character-string printable region RA, the height of the character-string printable region RA, the maximum number of lines in the character-string printable region RA, and the maximum character size (font size) in the character-string printable region RA. This setting is performed with reference to the character-string-printable-region table stored in the memory 5 (as one example of a first storage).

Character-String-Printable-Region Table

FIG. 35 illustrates one example of the character-string-printable-region table. In FIG. 35, the dimension of each of the print tapes To, T in the widthwise direction is 50.8 mm by way of example. As illustrated in FIG. 35, the character-string-printable-region table stores a relationship among the outside-diameter relating information obtained at S43 (the outside diameter of the wrapped member 302 in this example), the position of the lower end of the corresponding character-string printable region RA, the height of the character-string printable region RA, the maximum number of lines of the character strings R in the character-string printable region RA, and the maximum character size of each character of the character strings R in the character-string printable region RA. It is noted that the position of the lower end of the character-string printable region RA is represented by a distance (mm) from a reference position (0 mm) that is set at one end of the print label L in the first direction (e.g., a lower end of the adhesive region D3*b* in the case of the print label L in FIG. 22A).

In this table, as illustrated in FIG. 35, in the case where the outside diameter of the wrapped member 302 is 9.1 mm, the position of the lower end of the character-string printable region RA is 29.6 mm, the height of the character-string printable region RA is 6.4 mm, the maximum number of lines in the character-string printable region RA is two, and the maximum character size in the character-string printable region RA is 17 pt, for example. Likewise, in the case where the outside diameter of the wrapped member 302 is 8.1 mm, the position of the lower end of the character-string printable region RA is 26.4 mm, the height of the character-string printable region RA is 9.6 mm, the maximum number of lines in the character-string printable region RA is three, and the maximum character size in the character-string printable region RA is 26 pt, for example. Likewise, in the case where the outside diameter of the wrapped member 302 is 7.1 mm, the position of the lower end of the character-string printable region RA is 23.3 mm, the height of the character-string printable region RA is 12.7 mm, the maximum number of lines in the character-string printable region RA is four, and the maximum character size in the character-string printable region RA is 34 pt, for example. Likewise, in the case where the outside diameter of the wrapped member 302 is 6.1 mm, the position of the lower end of the character-string printable region RA is 23.3 mm, the height of the character-string printable region RA is 12.7 mm, the maximum number of lines in the character-string printable region RA is four, and the maximum character size in the character-string printable region RA is 34 pt, for example. Likewise, in the case where the outside diameter of the wrapped member 302 is 5.1 mm, the position of the lower end of the character-string printable region RA is 23.3 mm, the height of the character-string printable region RA is 12.7 mm, the maximum number of lines in the character-string printable region RA is four, and the maximum character size in the character-string printable region RA is 34 pt, for example. Likewise, in the case where the outside diameter of the wrapped member 302 is 4.1 mm, the position of the lower end of the character-string printable region RA is 23.3 mm, the height of the character-string printable region RA is 12.7 mm, the maximum number of lines in the character-string printable region RA is four, and the maximum character size in the character-string printable region RA is 34 pt, for example. Likewise, in the case where the outside diameter of the wrapped member 302 is 3.1 mm, the position of the lower end of the character-string printable region RA is 23.3 mm, the height of the character-string printable region RA is 9.6 mm, the maximum number of lines in the character-string printable region RA is three, and the maximum character size in the character-string printable region RA is 26 pt, for example. Likewise, in the case where the outside diameter of the wrapped member 302 is 2.1 mm, the position of the lower end of the character-string printable region RA is 23.3 mm, the height of the character-string printable region RA is 6.4 mm, the maximum number of lines in the character-string printable region RA is two, and the maximum character size in the character-string printable region RA is 17 pt, for example.

Figure 26A:
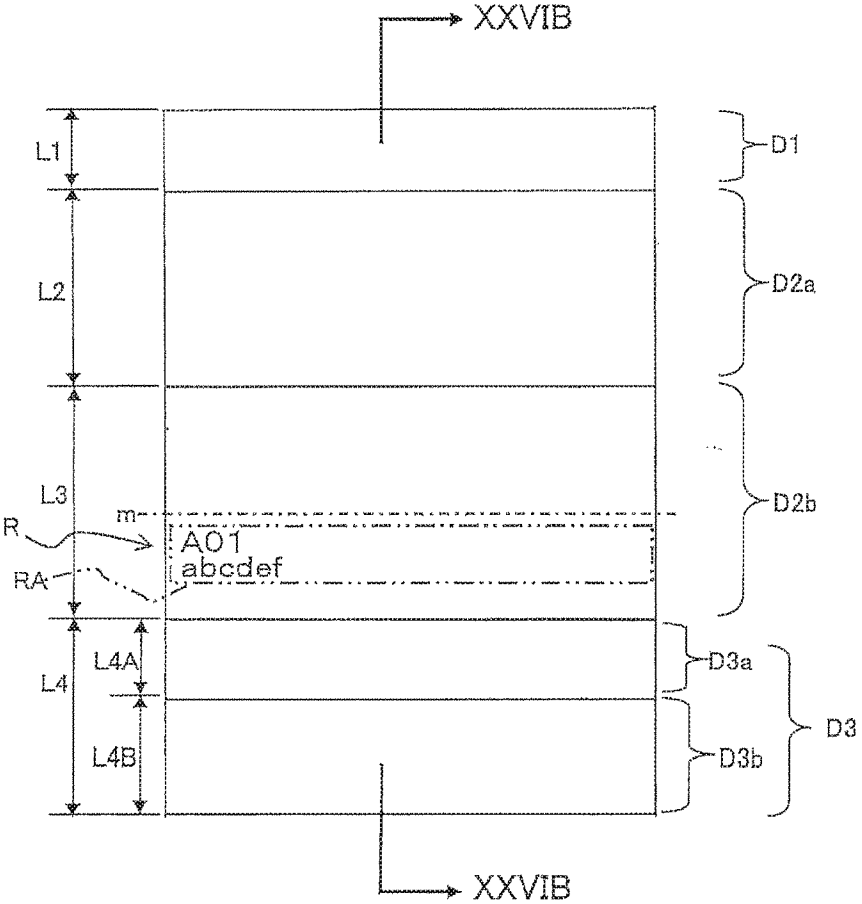
FIG. 26A is a development plan view of one example of a print label in a second embodiment.

According to the settings in the character-string-printable-region table, the CPU executes control for adjustably setting, based on the outside diameter of the wrapped member 302, an other-side end of the character-string printable region RA in the first direction (an upper end thereof in FIG. 26A which corresponds to a position of a second end portion) and a one-side end of the character-string printable region RA in the first direction (a lower end thereof in FIG. 26A which corresponds to a position of a first end portion). Specifically, for example, the CPU executes control such that the other-side end of the character-string printable region RA in the first direction (the upper end thereof in FIG. 26A) is situated nearer to the one side in the first direction (the lower side in FIG. 26A) in the case where the outside diameter of the wrapped member 302 is less than a first predetermined diameter (e.g., 4.1 mm) than in the case where the outside diameter of the wrapped member 302 is greater than or equal to the first predetermined diameter and less than or equal to a second predetermined diameter (e.g., 7.1 mm) and such that the one-side end of the character-string printable region RA in the first direction (i.e., the lower end thereof in FIG. 26A) is situated nearer to the other side in the first direction (the upper side in FIG. 26A) in the case where the outside diameter of the wrapped member 302 is greater than the second predetermined diameter (e.g., 7.1 mm) than in the case where the outside diameter of the wrapped member 302 is greater than or equal to the first predetermined diameter and less than or equal to the second predetermined diameter (e.g., 7.1 mm).

In this control, the one-side end of the character-string printable region RA in the first direction (i.e., the lower end thereof in FIG. 26A) is situated at the same position in the first direction between the case where the outside diameter of the wrapped member 302 is less than the first predetermined diameter (e.g., 4.1 mm) and the case where the outside diameter of the wrapped member 302 is greater than or equal to the first predetermined diameter and less than or equal to the second predetermined diameter (e.g., 7.1 mm). Likewise, the other-side end of the character-string printable region RA in the first direction (the upper end thereof in FIG. 26A) is situated at the same position in the first direction between the case where the outside diameter of the wrapped member 302 is greater than the second predetermined diameter (e.g., 7.1 mm) and the case where the outside diameter of the wrapped member 302 is greater than or equal to the first predetermined diameter and less than or equal to the second predetermined diameter (e.g., 7.1 mm).

Also, the CPU executes control so as to make the maximum number of lines R in the character-string printable region RA less in the case where the outside diameter of the wrapped member 302 is less than the first predetermined diameter (e.g., 4.1 mm) than in the case where the outside diameter of the wrapped member 302 is greater than or equal to the first predetermined diameter and less than or equal to the second predetermined diameter (e.g., 7.1 mm) and so as to make the maximum number of lines R in the character-string printable region RA less in the case where the outside diameter of the wrapped member 302 is greater than the second predetermined diameter (e.g., 7.1 mm) than in the case where the outside diameter of the wrapped member 302 is greater than or equal to the first predetermined diameter (e.g., 4.1 mm) and less than or equal to the second predetermined diameter (e.g., 7.1 mm), for example.

Also, the CPU executes control so as to make the maximum character size in the character-string printable region RA less in the case where the outside diameter of the wrapped member 302 is less than the first predetermined diameter (e.g., 4.1 mm) than in the case where the outside diameter of the wrapped member 302 is greater than or equal to the first predetermined diameter and less than or equal to the second predetermined diameter (e.g., 7.1 mm) and so as to make the maximum character size in the character-string printable region RA less in the case where the outside diameter of the wrapped member 302 is greater than the second predetermined diameter (e.g., 7.1 mm) than in the case where the outside diameter of the wrapped member 302 is greater than or equal to the first predetermined diameter (e.g., 4.1 mm) and less than or equal to the second predetermined diameter (e.g., 7.1 mm), for example.

When the processings at S105-S114 are finished as described above, this procedure ends, and the flow returns to S5 in FIG. 13.

When the CPU at S103 determines that selection of the center alignment is received, the region setter 401 of the control circuit 2 at S117 and S120 sets the maximum number of lines in the character-string printable region RA and the maximum character size (font size) in the character-string printable region RA based on the outside-diameter relating information obtained at S43. These settings are respectively performed with reference to a maximum-number-of-lines table and a maximum-character-size table stored in the memory 5 (as one example of second and third storages).

Maximum-Number-of-Lines Table

FIG. 36 illustrates one example of the maximum-number-of-lines table. In FIG. 36, the dimension of each of the print tapes To, T in the widthwise direction is 50.8 mm by way of example. As illustrated in FIG. 36, the maximum-number-of-lines table stores a relationship between the outside-diameter relating information obtained at S43 (the outside diameter of the wrapped member 302 in this example) and the maximum number of lines of the character strings R in the character-string printable region RA.

In this table, for example, in the case where the outside diameter of the wrapped member 302 is 9.1 mm, the maximum number of lines in the character-string printable region RA is not set (that is, printing is not permitted). In the case where the outside diameter of the wrapped member 302 is 8.1 mm, the maximum number of lines in the character-string printable region RA is two. In the case where the outside diameter of the wrapped member 302 is 7.1 mm, the maximum number of lines in the character-string printable region RA is four. In the case where the outside diameter of the wrapped member 302 is 6.1 mm, the maximum number of lines in the character-string printable region RA is four. In the case where the outside diameter of the wrapped member 302 is 5.1 mm, the maximum number of lines in the character-string printable region RA is four. In the case where the outside diameter of the wrapped member 302 is 4.1 mm, the maximum number of lines in the character-string printable region RA is four. In the case where the outside diameter of the wrapped member 302 is 3.1 mm, the maximum number of lines in the character-string printable region RA is two. In the case where the outside diameter of the wrapped member 302 is 9.1 mm, the maximum number of lines in the character-string printable region RA is not set (that is, printing is not permitted).

Maximum-Character-Size Table

FIG. 37 illustrates one example of the maximum-character-size table. In FIG. 37, the dimension of each of the print tapes To, T in the widthwise direction is 50.8 mm by way of example. As illustrated in FIG. 37, the maximum-character-size table stores a relationship between the outside-diameter relating information obtained at S43 (the outside diameter of the wrapped member 302 in this example) and the maximum character size (font size) of each character of the character strings R in the character-string printable region RA.

In this table, for example, in the case where the outside diameter of the wrapped member 302 is 9.1 mm, the maximum character size in the character-string printable region RA is not set (that is, printing is not permitted). In the case where the outside diameter of the wrapped member 302 is 8.1 mm, the maximum character size in the character-string printable region RA is 18 pt. In the case where the outside diameter of the wrapped member 302 is 7.1 mm, the maximum character size in the character-string printable region RA is 34 pt. In the case where the outside diameter of the wrapped member 302 is 6.1 mm, the maximum character size in the character-string printable region RA is 34 pt. In the case where the outside diameter of the wrapped member 302 is 5.1 mm, the maximum character size in the character-string printable region RA is 34 pt. In the case where the outside diameter of the wrapped member 302 is 4.1 mm, the maximum character size in the character-string printable region RA is 34 pt. In the case where the outside diameter of the wrapped member 302 is 3.1 mm, the maximum character size in the character-string printable region RA is 18 pt. In the case where the outside diameter of the wrapped member 302 is 2.1 mm, the maximum character size in the character-string printable region RA is not set (that is, printing is not permitted).

Since the center alignment is employed in this case, though not specified in the table, the region setter 401 of the control circuit 2 sets a position (center position) of the center line m of the printing background layer 25 (in other words, the center line of the character-string printable region RA) to the same position in the first direction between the case where the outside diameter of the wrapped member 302 is less than the first predetermined diameter (e.g., 4.1 mm) and the case where the outside diameter of the wrapped member 302 is greater than or equal to the first predetermined diameter and less than or equal to the second predetermined diameter (e.g., 7.1 mm). Also, the region setter 401 of the control circuit 2 sets the center line m to the same position in the first direction between the case where the outside diameter of the wrapped member 302 is greater than the second predetermined diameter (e.g., 7.1 mm) and the case where the outside diameter of the wrapped member 302 is greater than or equal to the first predetermined diameter (e.g., 4.1 mm) and less than or equal to the second predetermined diameter (e.g., 7.1 mm).

When the processings at S117 and S120 are finished as described above, this procedure ends, and the flow returns to S5 in FIG. 13. It is noted that both of the setting for the maximum number of lines at S117 and the setting for the maximum character size at S120 are not necessarily executed, and the CPU may execute one of these processings.

Effects in Second Embodiment

In the second embodiment as described above, the character-string printable region RA is adjustably set based on the outside-diameter relating information on the wrapped member 302. As a result, in the case where the outside diameter of the wrapped member 302 is small, for example, the character-string printable region RA is set to a position nearer to the one side in the first direction (the lower side in FIG. 26), and in the case of the center alignment, the height of the character-string printable region RA is reduced with respect to the center line m, thereby preventing the character strings R from being covered with the printing background layer 25 as illustrated in FIG. 24, resulting in reduction in an amount of lowering of the viewability. Also, in the case where the outside diameter of the wrapped member 302 is large, for example, the character-string printable region RA is set to a position nearer to the other side in the first direction (the upper side in FIG. 28), and in the case of the center alignment, the height of the character-string printable region RA is reduced with respect to the center line m, thereby reliably covering the character strings R printed on the printing background layer 25 with the transparent base layer 21 unlike the case in FIG. 25, thereby ensuring the viewability and preventing the character strings R from being soiled or faded. In the present embodiment as described above, it is possible to fill user's need for the character strings R to improve a convenience to the user.

Modifications of Second Embodiment

While the second embodiment has been described above, it is to be understood that the disclosure is not limited to the details of the illustrated embodiment, but may be embodied with various changes and modifications, which may occur to those skilled in the art, without departing from the spirit and scope of the disclosure. There will be described modifications of the second embodiment. It is noted that the same reference numerals as used in the first and second embodiments and the modifications of the first embodiment are used to designate the corresponding elements of the modifications, and an explanation of which is simplified or dispensed with.

That is, while the character-string printable region RA is adjustably set (that is, the height and the position of the character-string printable region RA are changeable) with respect to the structure illustrated in FIG. 22 in the second embodiment, the present disclosure is not limited to this configuration. In a modification, the character strings R in the character-string printable region RA may be situated nearer to the one side or the other side in the first direction, with the character-string printable region RA being fixed. The modification will be next explained with reference to FIGS. 38A-47.

Figure 38A:
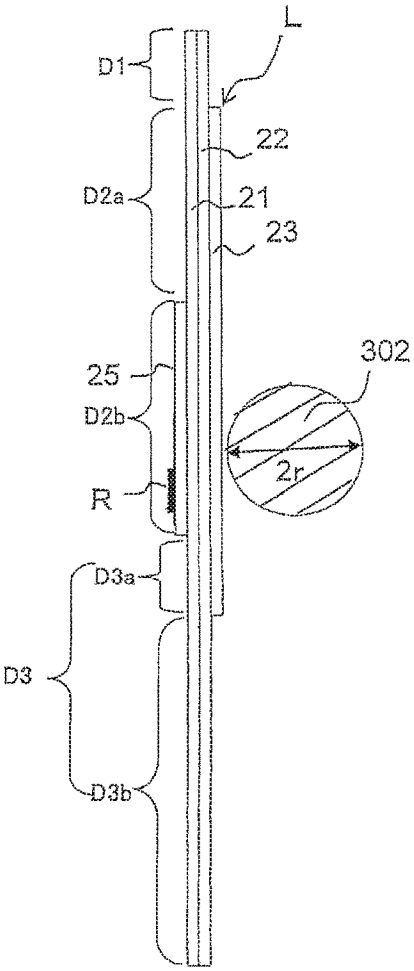
FIGS. 38A through 38C are views for explaining a configuration of a print label and a procedure of attachment thereof to a wrapped member, which are a precondition for a modification in which characters in the character-string printable region are placed near one side or the other side.
Figure 38B:
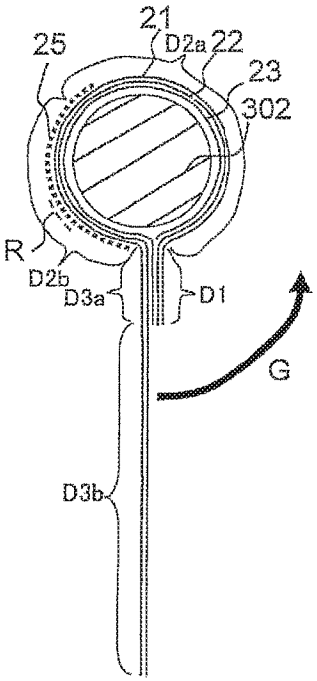
Figure 38C:
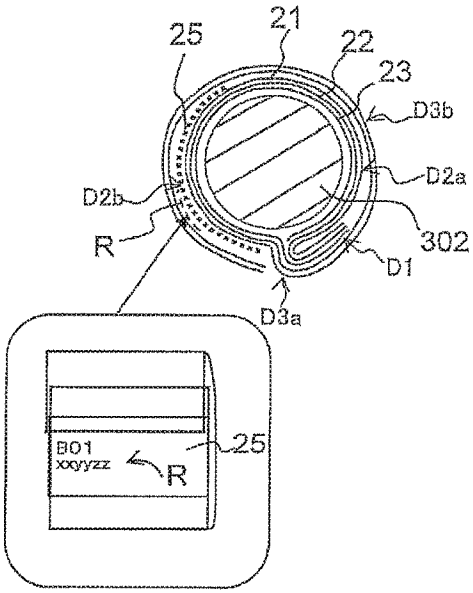

FIGS. 38A-38C illustrate a structure and an attachment manner of the print label L which are precondition for the present modification. As illustrated in FIG. 38D, in this example, two lines of the character strings R respectively representing "B01" and "xxyyzz" are formed on the printing background layer 25 in the non-adhesive region D2*b*.

When the print label L is attached to a wrapped member, as described above, the print label L is wrapped around the wrapped member 302 so as to form a cylindrical member surrounding the wrapped member 302, and then the adhesive layer 22 in the adhesive region D1 as a distal end portion of the print label L (noted that the adhesive layer 22 in the adhesive region D1 serves as the sticking portion) is stuck to a portion of the adhesive layer 22 in the non-adhesive region D3*a* of the partly-adhesive region D3 (noted that the portion serves as the stuck portion) via the non-adhesive layer 23 (that is, the inner-sides sticking is performed). As a result, as illustrated in FIG. 38C, the character strings R respectively representing "B01" and "xxyyzz" on the printing background layer 25 are covered with a portion of the print label L in the adhesive region D3*b* (noted that the enlarged view in FIG. 38C illustrates the printing background layer 25 viewed from a position nearest thereto inside the portion of the print label L in the adhesive region D3*b*). However, since portions of the base layer 21 and the adhesive layer 22 in the adhesive region D3*b* are transparent, the character strings R are visually recognizable.

Inconvenience in the Case of Wrapped member of Small Diameter

Figure 39B:
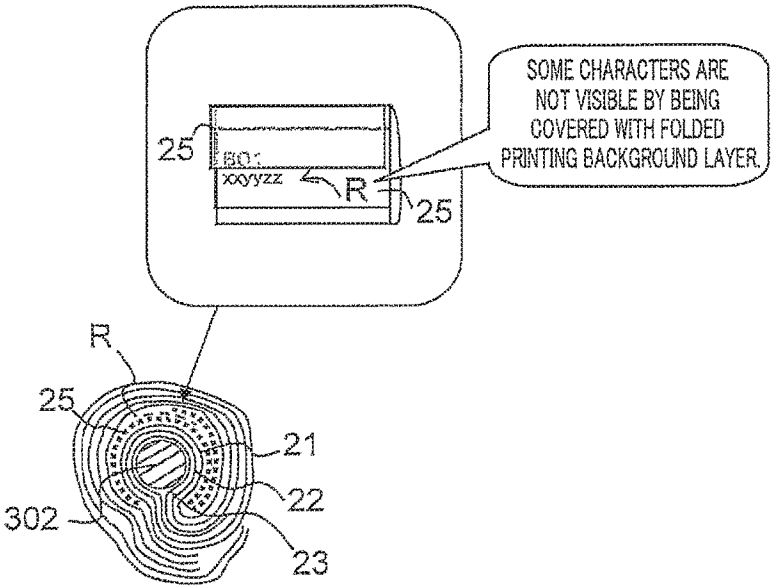
FIGS. 39A and 39B are cross-sectional views for explaining a problem in attachment of the print label to a wrapped member having a small diameter.
Figure 39A:
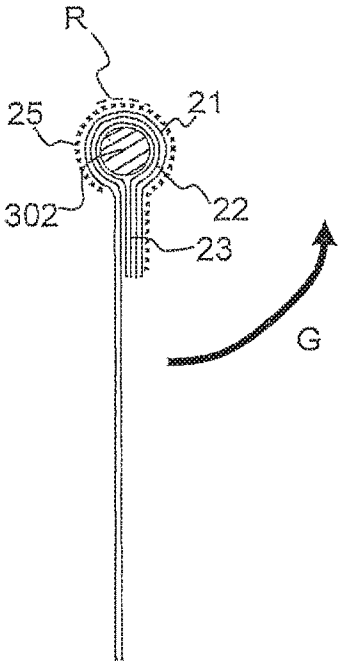

FIGS. 39A and 39B illustrate one example in which the print label L is attached to the wrapped member 302 having an outside diameter less than that of the wrapped member 302 illustrated in FIGS. 38A-38C. FIGS. 39A and 39B respectively correspond to FIGS. 39A and 39B. In this case, as a result of the wrapping in the inner-sides sticking (in which the rest portion due to the inner-sides sticking is folded and wrapped around the outer circumferential portion), as illustrated in FIG. 39B, the folded printing background layer 25 may cover the character strings R so as to make it impossible or difficult to visually recognize the character strings R. In this example, as illustrated in the enlarged view in FIG. 39B (noted that the enlarged view in FIG. 39B illustrates the printing background layer 25 viewed from a position nearest thereto inside the portion of the print label L in the adhesive region D3*b*), the character string R representing "B01" is not visually recognized due to the printing background layer 25 among the character strings R respectively representing "B01" and "xxyyzz".

Inconvenience in the Case of Wrapped Member of Large Diameter

Figures 40A, 40B:
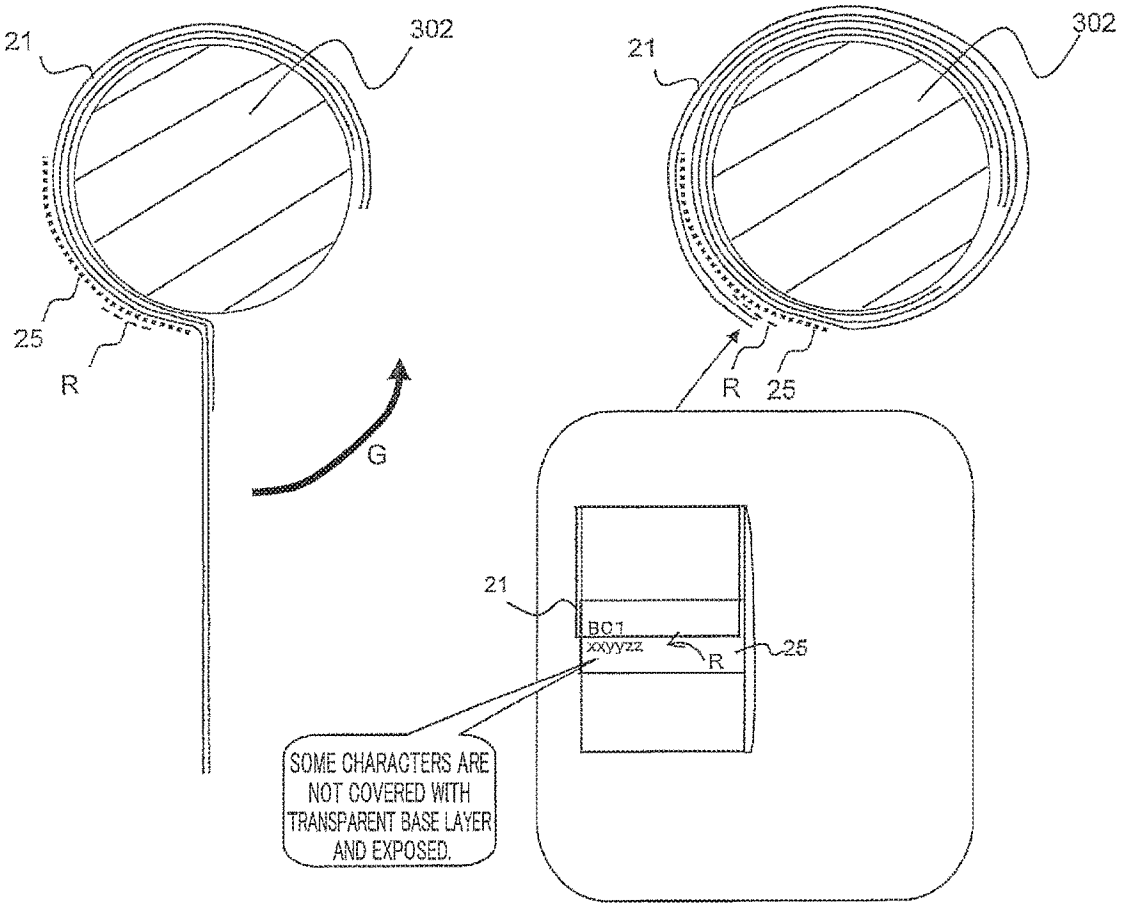
FIGS. 40A and 40B are cross-sectional views for explaining a problem in attachment of the print label to a wrapped member having a large diameter.
Figure 41B:
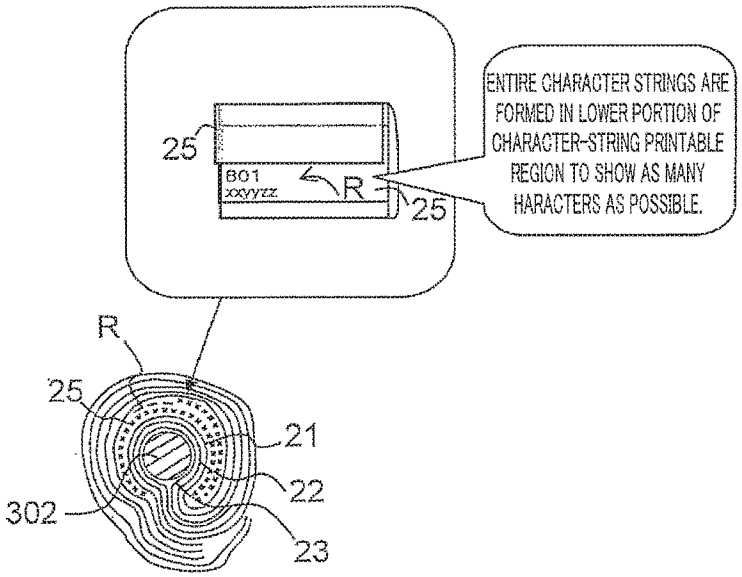
FIGS. 41A and 41B are cross-sectional views illustrating a procedure of attachment of one example of a print label to a wrapped member in the modification in which characters in the character-string printable region are placed near one side or the other side.
Figure 41A:
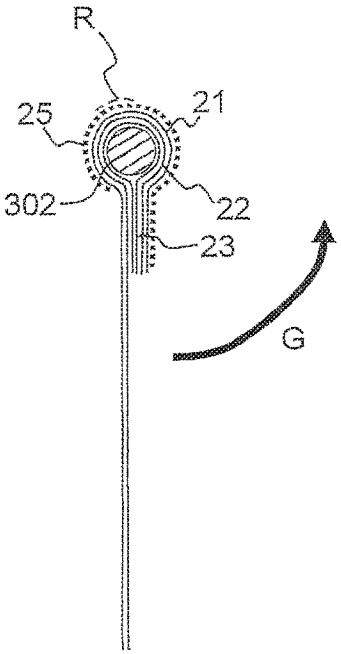

FIGS. 40A and 40B illustrate one example in which the print label L is attached to the wrapped member 302 having an outside diameter greater than that of the wrapped member 302 illustrated in FIGS. 38A-38C. FIGS. 40A and 40B respectively correspond to FIGS. 38B and 38C.

Ideally, as described in FIG. 38A-38C, the character strings R formed on the printing background layer 25 are covered with and protected by the transparent base layer 21 in the adhesive region D3*b*, which is wrapped on an outer circumferential portion of the printing background layer 25, so as to ensure viewability of the character strings R, thereby preventing the character strings R from being soiled or faded.

However, in the case illustrated in FIGS. 40A and 40B, one of the character strings R ("xxyyzz" of "B01" and "xxyyzz" in this example) is not covered with the base layer 21 and is exposed (see the enlarged view in FIG. 40B). That is, it is impossible to cover this portion with the transparent base layer 21 for protection.

Overview of Technique in Present Embodiment

To solve this problem, in the present modification, in the case where the outside diameter of the wrapped member 302 is small as described above, for example, as illustrated in FIGS. 41A and 41B, the position of the entire character strings R is located nearer to the lower side in FIGS. 41A and 41B than in the case in FIGS. 40A and 40B, with no change of the position of the character-string printable region RA. It is noted that the number of lines and the font size of the character strings R printable on the character-string printable region RA are not changed, either. As a result of this arrangement, in the illustrated example, since the character-string printable region RA is displaced as described above even after the print label L is attached to the wrapped member 302, the printing background layer 25 does not cover all the character strings R ("B01" and "xxyyzz"), ensuring the viewability. It should be noted that no problems arise in the case of the character strings R of two lines as in this example, but in the case of the character strings R of three or more lines, the first and second character strings R from the bottom are located outside the printing background layer 25, but the other character strings R are covered with the printing background layer 25. Accordingly, the present modification is effective in particular in the case where the number of lines is small and in the case where the height of the region to be printed is low.

Figure 42B:
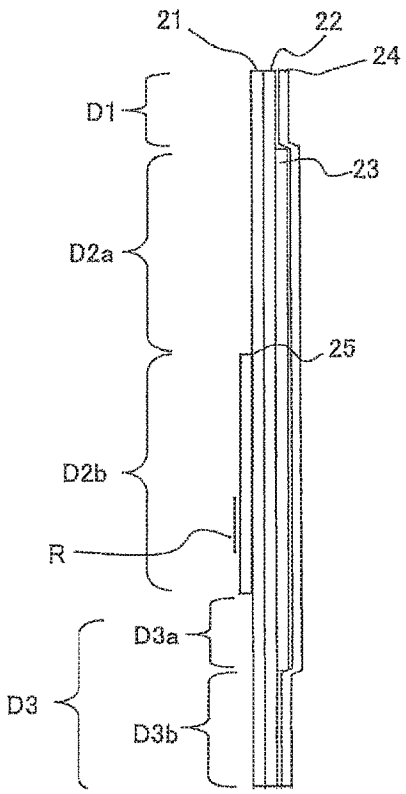
FIG. 42B is a cross-sectional view taken along line XLIIB-XLIIB in FIG. 42A.
Figure 42A:
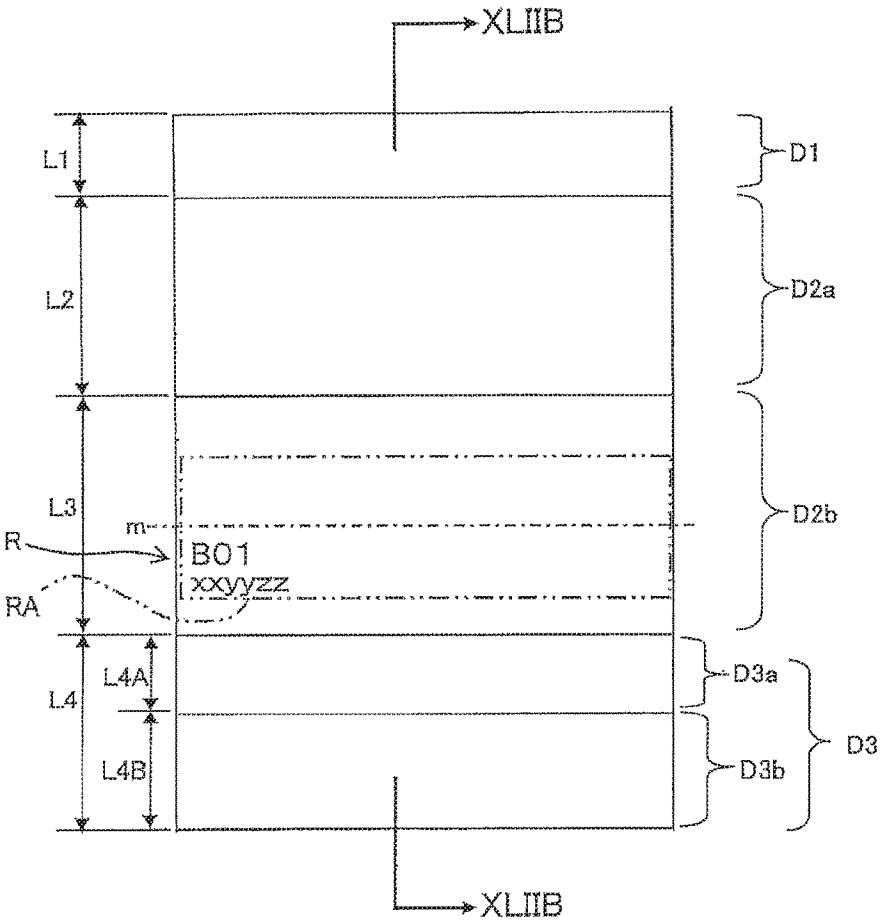
FIG. 42A is a development plan view of one example of a print label in the modification in which characters in the character-string printable region are placed near one side or the other side.

FIGS. 42A and 42B illustrate the structure of the print label L in this case. FIGS. 42A and 42B respectively correspond to FIGS. 26A and 26B. As illustrated in FIGS. 42A and 42B, the entire character strings R are arranged in the character-string printable region RA at positions located below the center line m in FIG. 42A as near as possible to the one-side end of the character-string printable region RA in the first direction.

Figure 43B:
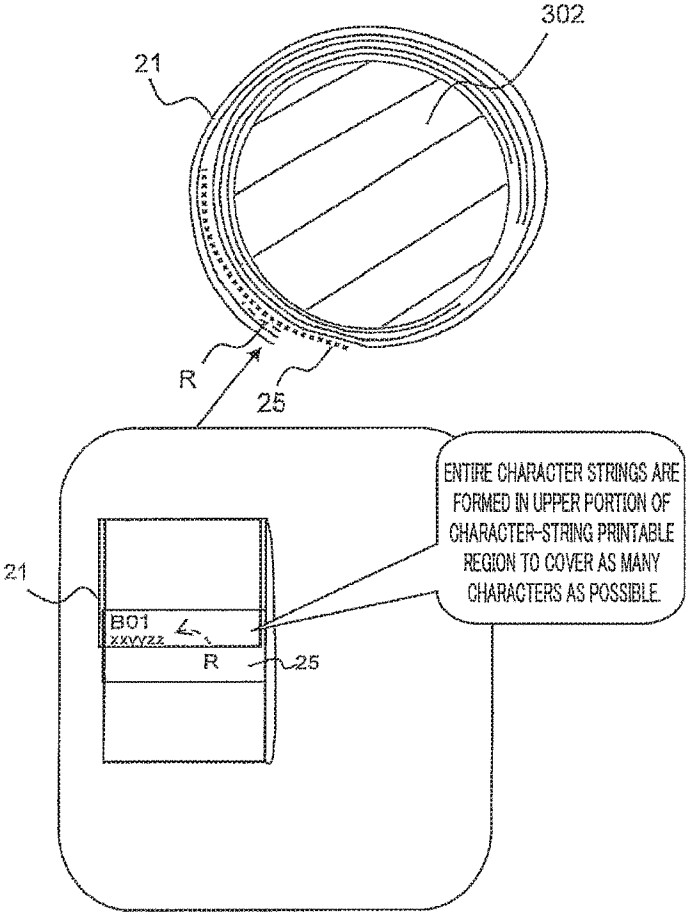
FIGS. 43A and 43B are cross-sectional views illustrating a procedure of attachment of another example of the print label to the wrapped member in the modification in which characters in the character-string printable region are placed near one side or the other side.
Figure 43A:
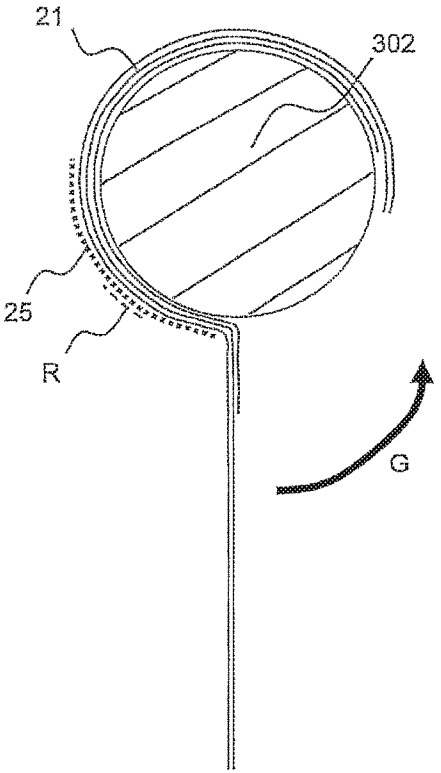

On the other hand, in the case where the outside diameter of the wrapped member 302 is large, as illustrated in FIGS. 43A and 43B, the position of the entire character strings R is located nearer to the upper side in FIGS. 43A and 43B than in the case in FIGS. 40A and 40B, with no change of the position of the character-string printable region RA. As in the above-described case, the number of lines and the font size of the character strings R printable on the character-string printable region RA are not changed, either. As a result of this arrangement, as illustrated in FIGS. 43A and 43B, since the character-string printable region RA is displaced as described above even after the print label L is attached to the wrapped member 302, all the character strings R ("B01" and "xxyyzz") are reliably covered with the transparent base layer 21, thereby ensuring the viewability and preventing the character strings R from being soiled or faded. It should be noted that no problems arise in the case of the character strings R of two lines as in this example, but in the case of the character strings R of three or more lines, the first and second character strings R from the top are covered with the base layer 21, but the other character strings R are exposed without being covered with the base layer 21. Accordingly, the present modification is effective in particular in the case where the number of lines is small and in the case where the height of the region to be printed is low.

Figure 44B:
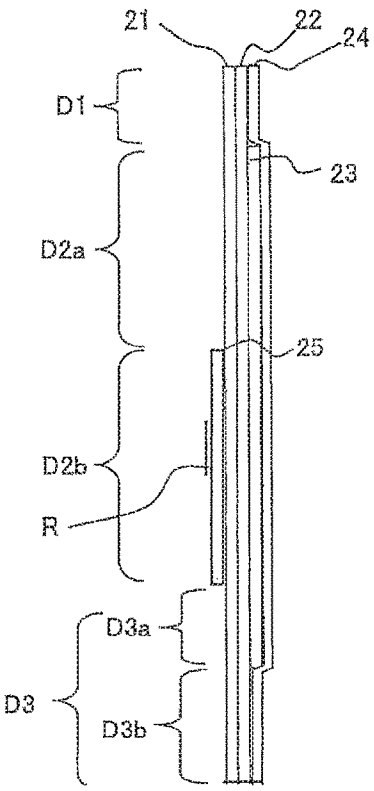
FIG. 44B is a cross-sectional view taken along line XLIVB-XLIVB in FIG. 42A.
Figure 44A:
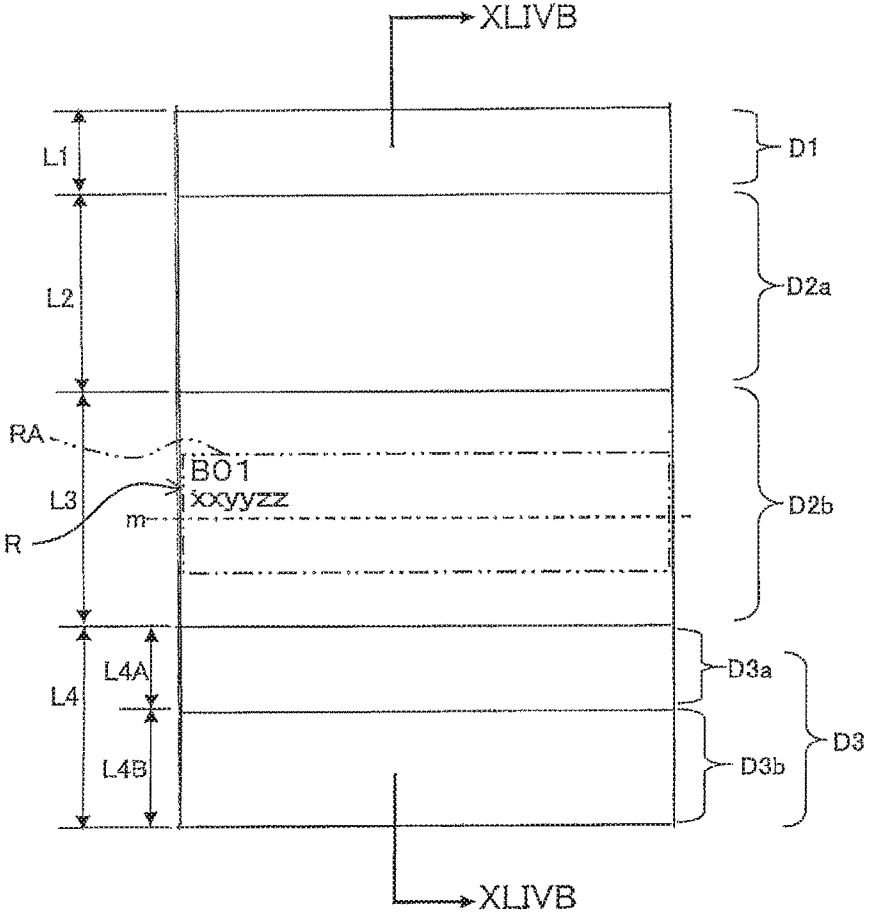
FIG. 44A is a development plan view of another example of the print label in the modification in which characters in the character-string printable region are placed near one side or the other side.

FIGS. 44A and 44B illustrate the structure of the print label L in this case. FIGS. 44A and 44B respectively correspond to FIGS. 38A and 38B. As illustrated in FIGS. 44A and 44B, the entire character strings R are arranged in the character-string printable region RA at positions located above the center line m in FIG. 44A as near as possible to the other-side end of the character-string printable region RA in the first direction.

Figure 45:
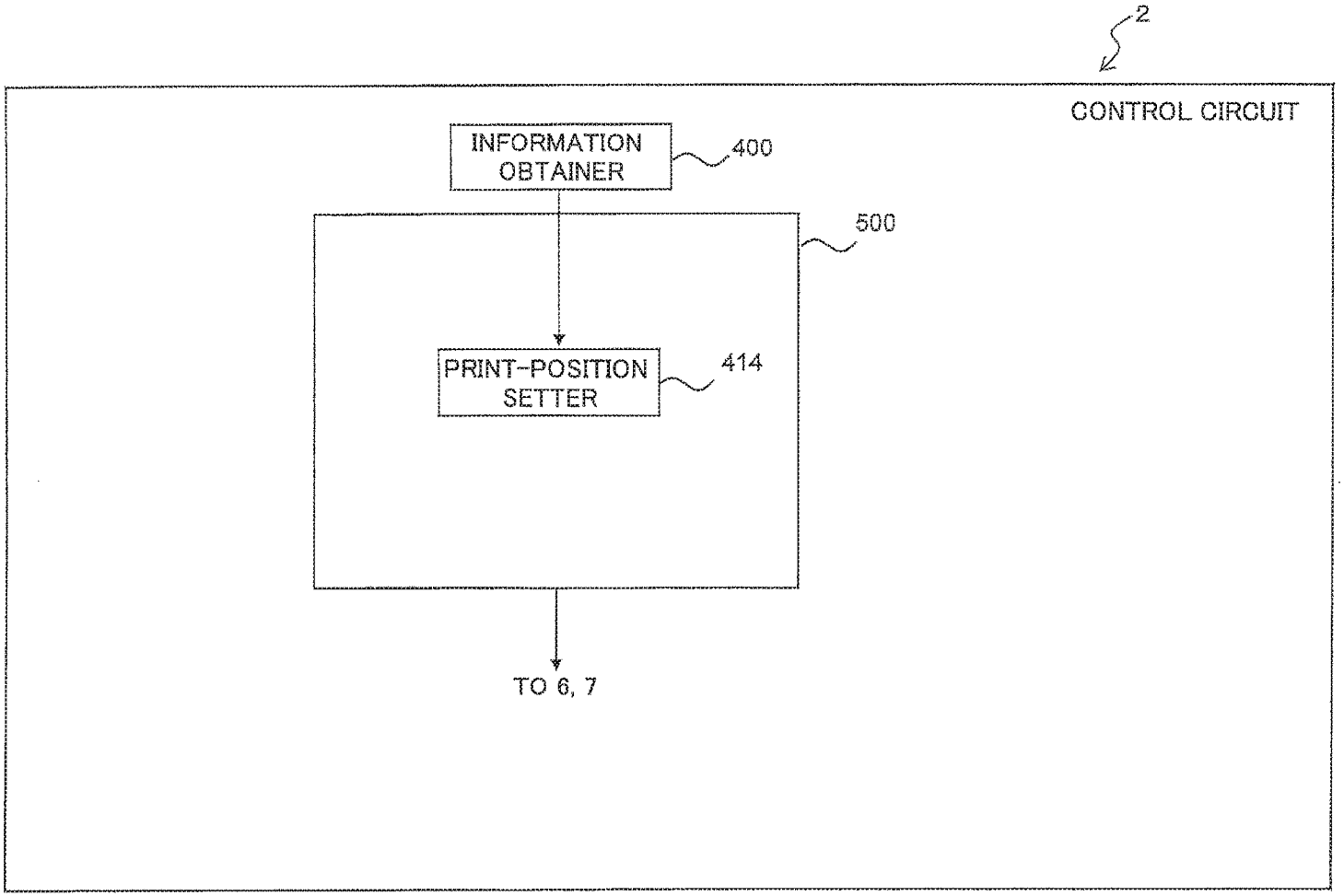
FIG. 45 is a block diagram illustrating a functional configuration of a control circuit.

FIG. 45 illustrates a configuration of the control circuit 2 in the present modification. FIG. 45 corresponds to FIG. 32. In the present modification, as illustrated in FIG. 45, the controller 500 includes a print-position setter 414 instead of the region setter 401. This print-position setter 414 sets positional alignment of the character strings R in the portion of the printing background layer 25 in the character-string printable region RA, based on the outside-diameter relating information obtained from the information obtainer 400. This setting is performed with reference to a character layout table stored in advance in the memory 5 (as one example of a fourth storage), for example.

Character Layout Table

FIG. 46 illustrates one example of the character layout table. In FIG. 46, the dimension of each of the print tapes To, T in the widthwise direction is 50.8 mm by way of example. As illustrated in FIG. 46, the character layout table stores a relationship between the outside-diameter relating information obtained at S43 (the outside diameter of the wrapped member 302 in this example) and positional alignment of the character strings R.

In this table, for example, in the case where the outside diameter of the wrapped member 302 is 9.1 mm, the positional alignment of the character strings R is top alignment corresponding to alignment toward the other side in the first direction. In the case where the outside diameter of the wrapped member 302 is 8.1 mm, the positional alignment of the character strings R is the top alignment corresponding to the alignment toward the other side in the first direction. In the case where the outside diameter of the wrapped member 302 is 7.1 mm, the positional alignment of the character strings R is not the top alignment or bottom alignment, which will be described below, but center alignment (equivalent to the above-described center alignment). In the case where the outside diameter of the wrapped member 302 is 6.1 mm, the positional alignment of the character strings R is the center alignment. In the case where the outside diameter of the wrapped member 302 is 5.1 mm, the positional alignment of the character strings R is the center alignment. In the case where the outside diameter of the wrapped member 302 is 4.1 mm, the positional alignment of the character strings R is the center alignment. In the case where the outside diameter of the wrapped member 302 is 3.1 mm, the positional alignment of the character strings R is the bottom alignment corresponding to alignment toward the one side in the first direction. In the case where the outside diameter of the wrapped member 302 is 2.1 mm, the positional alignment of the character strings R is the bottom alignment.

Figure 47:
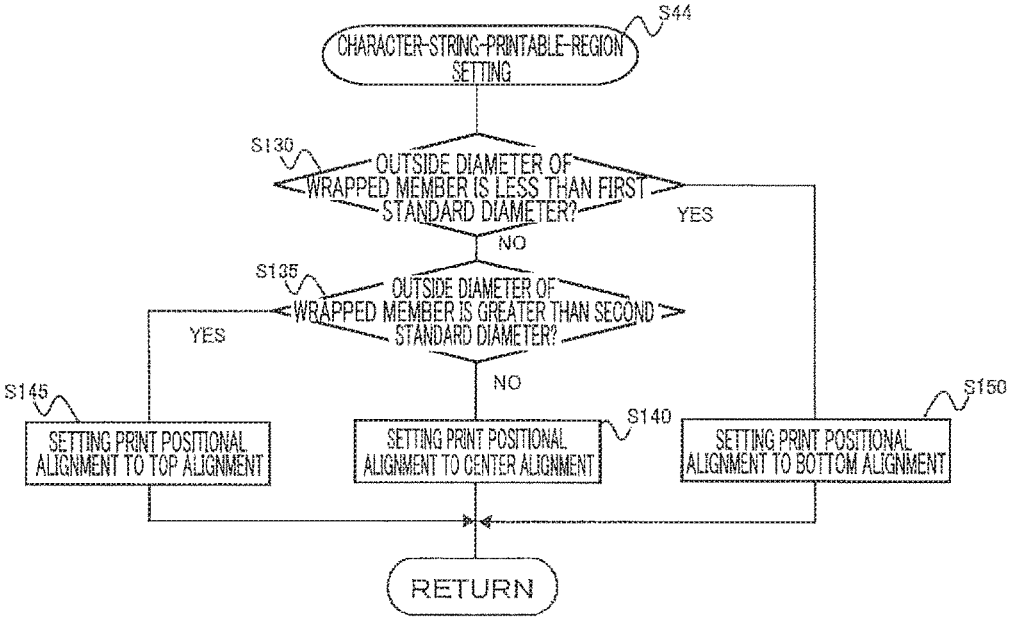
FIG. 47 is a flow chart illustrating a procedure of a character-string-printable-region setting processing in a procedure of control executed by a CPU of the control circuit.

FIG. 47 illustrates a detail of a mark setting processing executed by the mark-position detector 411 with reference to the character layout table in the present modification. FIG. 47 corresponds to FIG. 34.

In the present modification, the procedure in FIG. 47 begins with S130 at which the print-position setter 414 of the control circuit 2 at S130 determines, based on the outside-diameter relating information obtained at S43, whether the outside diameter of the wrapped member 302 is less than a preset standard diameter. For example, this standard diameter is greater than or equal to the first predetermined diameter and less than or equal to the second predetermined diameter (e.g., 4.1-7.1 mm). In the present modification, for example, this standard diameter is a first standard diameter (as one example of a first outside diameter) of 4.1 mm. When the outside diameter of the wrapped member 302 is less than the first standard diameter (S130: YES), this flow goes to S150. When the outside diameter of the wrapped member 302 is greater than or equal to the first standard diameter (S130: NO), this flow goes to S135.

The print-position setter 414 of the control circuit 2 at S135 determines, based on the outside-diameter relating information obtained at S43, whether the outside diameter of the wrapped member 302 is greater than a second standard diameter (as one example of a second outside diameter) that is greater than the first standard diameter. For example, the second standard diameter is 7.1 mm. When the outside diameter of the wrapped member 302 is greater than the second standard diameter (S135: YES), this flow goes to S145. When the outside diameter of the wrapped member 302 is less than or equal to the second standard diameter (S135: NO), this flow goes to S140.

The print-position setter 414 of the control circuit 2 at S140 sets the print positional alignment to the center alignment. Upon completion of this processing, this procedure ends, and the flow returns to S5 in FIG. 13.

The print-position setter 414 of the control circuit 2 at S145 sets the print positional alignment to the top alignment. Upon completion of this processing, this procedure ends, and the flow returns to S5 in FIG. 13.

The print-position setter 414 of the control circuit 2 at S150 sets the print positional alignment to the bottom alignment. Upon completion of this processing, this procedure ends, and the flow returns to S5 in FIG. 13.

As a result of this procedure, the CPU executes the control based on the outside diameter of the wrapped member 302 such that when the outside diameter of the wrapped member 302 is less than the first standard diameter (e.g., 4.1 mm), the print positional alignment is set to the alignment toward the one side in the first direction and such that when the outside diameter of the wrapped member 302 is greater than the second standard diameter (e.g., 7.1 mm), the print positional alignment is set to the alignment toward the other side in the first direction.

In the present modification as described above, in the case where the outside diameter of the wrapped member 302 is small, for example, the entire character strings R are displaced in the character-string printable region RA toward one side (the lower side in FIG. 42) in the first direction to prevent the character strings R from being covered with the printing background layer 25 as illustrated in FIG. 39, thereby reducing an amount of lowering of the viewability. On the other hand, in the case where the outside diameter of the wrapped member 302 is large, for example, the entire character strings R are displaced in the character-string printable region RA toward the other side (the upper side in FIG. 28) in the first direction to cover the character strings R printed on the printing background layer 25 with the transparent base layer 21 unlike the case in FIG. 40, thereby ensuring the viewability and preventing the character strings R from being soiled or faded. In the present modification as described above, as in the second embodiment, it is possible to fill user's need for the character strings R to improve a convenience to the user.

Third Embodiment

There will be next explained a third embodiment. It is noted that the same reference numerals as used in the first embodiment and the modifications thereof are used to designate the corresponding elements of the third embodiment, and an explanation of which is simplified or dispensed with.

Rotatable Label Wrapping Manner and Self-Laminating Wrapping Manner

For example, it is usually considered that a wrapping manner in which the print label L is wrapped around the wrapped member 302 as described above includes: a rotatable label wrapping manner (as one example of a first wrapping manner) in which the print label L is wrapped around the wrapped member 302 so as to be rotatable as described above; and a self-laminating wrapping manner (as one example of a second wrapping manner) in which the print label L is wrapped around the wrapped member 302 so as not to be rotatable.

In the case where the print label L is used in the rotatable label wrapping manner, as described in, e.g., the first and second embodiments, a back surface of the portion of the base layer 21 in the adhesive region D1 and a back surface of the portion of the base layer 21 in the partly-adhesive region D3 are stuck to each other in a state in which the print label L is wrapped around the outer circumferential surface of the wrapped member 302, and then portions of the print label L in the non-adhesive region D2*a* and the partly-adhesive region D3 are wrapped around the wrapped member 302 (see FIGS. 8 and 23, for example). In this case, since the portion of the print label L in the adhesive region D1 is not stuck to the wrapped member 302, and the portion of the print label L in the non-adhesive region D2*a* is not adhesiveness, the print label L is rotatable around the wrapped member 302.

Figure 48B:
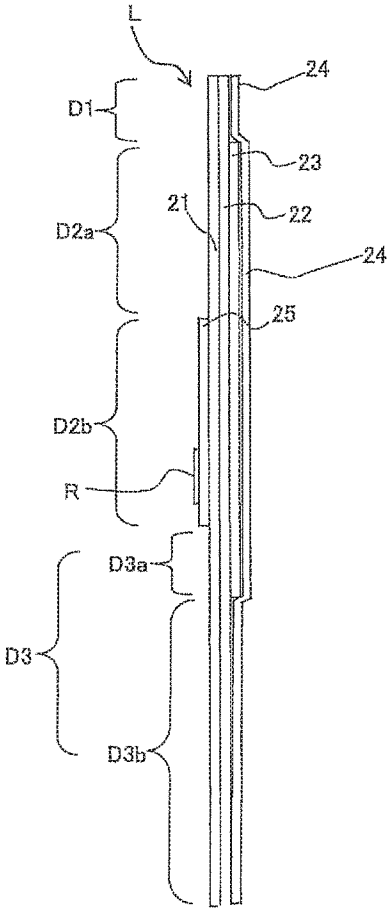
FIG. 48B is a cross-sectional view taken along line XLVIIIB-XLVIIIB.
Figure 48A:
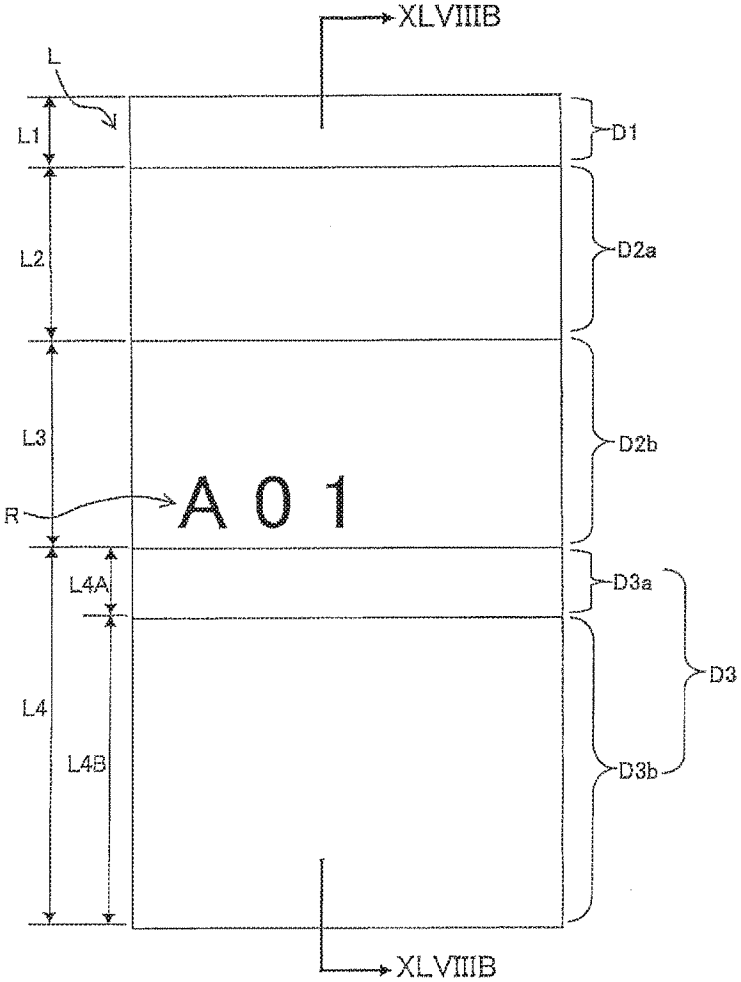
FIG. 48A is a development plan view of a print label in a third embodiment.
Figure 49:
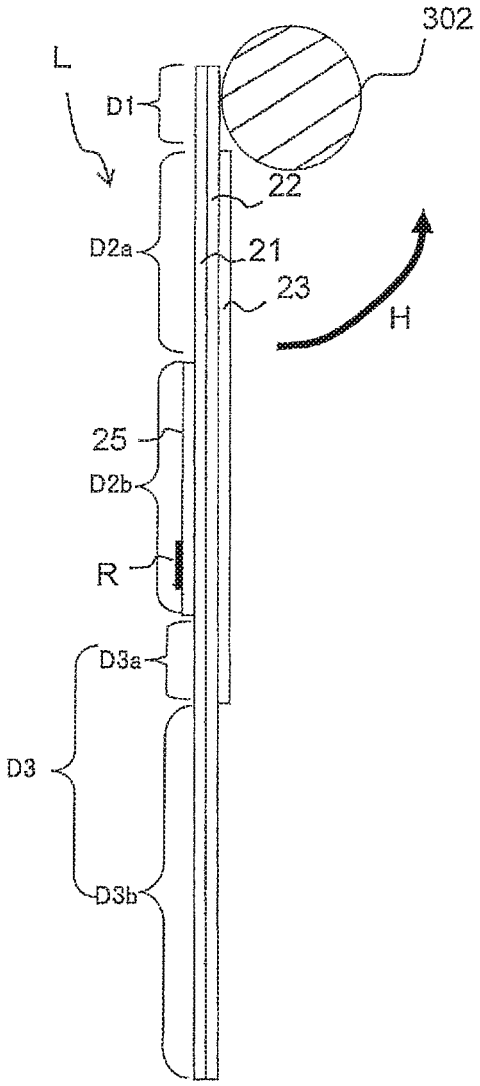
FIG. 49 is a cross-sectional view illustrating a procedure of attachment of the print label to a wrapped member in a case where the print label is used in a self-laminating wrapping manner.

FIGS. 48A and 48B illustrate one example of the print label L used in the self-laminating wrapping manner. FIGS. 48A and 48B generally correspond to FIGS. 3A and 3B, respectively. As illustrated in FIGS. 48A and 48B, the marks M1, M2 are not printed on the print label L unlike the structure illustrated in FIGS. 3A and 3B. When the print label L is attached to the wrapped member 302, as illustrated in FIG. 49, the back surface (the right surface in FIG. 49) of the portion of the base layer 21 in the adhesive region D1 is stuck to the wrapped member 302 via the adhesive layer 22, and then the portions of the print label L in the non-adhesive region D2*a* and the partly-adhesive region D3 are wrapped around the wrapped member 302 in order as indicated by arrow H. In this case, since the portion of the base layer 21 in the adhesive region D1 adheres to the wrapped member 302 via the adhesive layer 22, the print label L is not rotatable around the wrapped member 302.

As described above, the same print tape To may be used for the above-described two wrapping manners (the print tape To illustrated in FIG. 2A may be used for the above-described two wrapping manners in the above-described example), and only a use is different between the above-described two wrapping manners, for example. In the label creating apparatus 1, however, a manner of creation of the print label L (which is performed by the thermal head 7 and the conveying roller 6) is in some cases preferably changed depending upon which wrapping manner is used between the above-described two wrapping manners.

That is, for example, in the case of the self-laminating wrapping manner, as described above with reference to FIG. 49, the portions of the print label L in the non-adhesive region D2*a* and the partly-adhesive region D3 are wrapped around the wrapped member 302 in the state in which the portion of the base layer 21 in the adhesive region D1 is stuck to the wrapped member 302, making it difficult to cause misalignment in wrapping.

In the case of the rotatable label wrapping manner, in contrast, as described above with reference to, e.g., FIG. 4, when the back surface (the right surface in FIG. 4A) of the portion of the base layer 21 in the adhesive region D1 and the back surface (the left surface in FIG. 4A) of the portion of the base layer 21 in the partly-adhesive region D3 are stuck to each other in the state in which the portion of the print label L is wrapped around the wrapped member 302, misalignment in sticking easily occurs, which may lead to misalignment in wrapping.

To solve this problem, in the case of the rotatable label wrapping manner, the CPU preferably executes control for forming the marks M1, M2 on the portions of the print label L in the adhesive region D1 and the partly-adhesive region D3 such that each of the marks M1 and a corresponding one of the marks M2 are arranged in a line in the first direction as in the first embodiment. The marks M1, M2 may be formed by the printer. In the case where the marks M1 or M2 are formed on the print tape To in advance, the CPU executes control for additionally print the other marks such that each of the marks M1 and a corresponding one of the marks M2 are arranged in a line in the up and down direction. This control creates the print label L with the two marks M1, M2 arranged in the first direction. Thus, by aligning the two marks with each other in sticking in the rotatable label wrapping manner, it is possible to prevent misalignment in sticking and the misalignment in wrapping (see FIGS. 4B and 4C in the first embodiment, for example). In the case of the self-laminating wrapping manner, on the other hand, since the misalignment in wrapping does not easily occur, there is little need to provide the marks as described above.

The user may want to reliably cover the character strings R formed in the non-adhesive region D2*a* with the base layer 21 as described above with reference to, e.g., FIGS. 25 and 29 in the second embodiment. In this case, in the case of the rotatable label wrapping manner, the length of wrapping is shorter than in the case of the self-laminating wrapping manner, leading to a possibility that all the character strings R cannot be covered with the base layer 21. That is, in the case of the rotatable label wrapping manner, the CPU preferably executes control such that the portion of the non-adhesive region D2*a* on which printing of the character strings R is allowed (the character-string printable region RA) is different from that in the case of the self-laminating wrapping manner.

In this third embodiment, the CPU changes control for the conveying roller 6 and the thermal head 7, depending upon whether the print label L is wrapped in the rotatable label wrapping manner or the self-laminating wrapping manner.

Control Circuit

Figure 50:
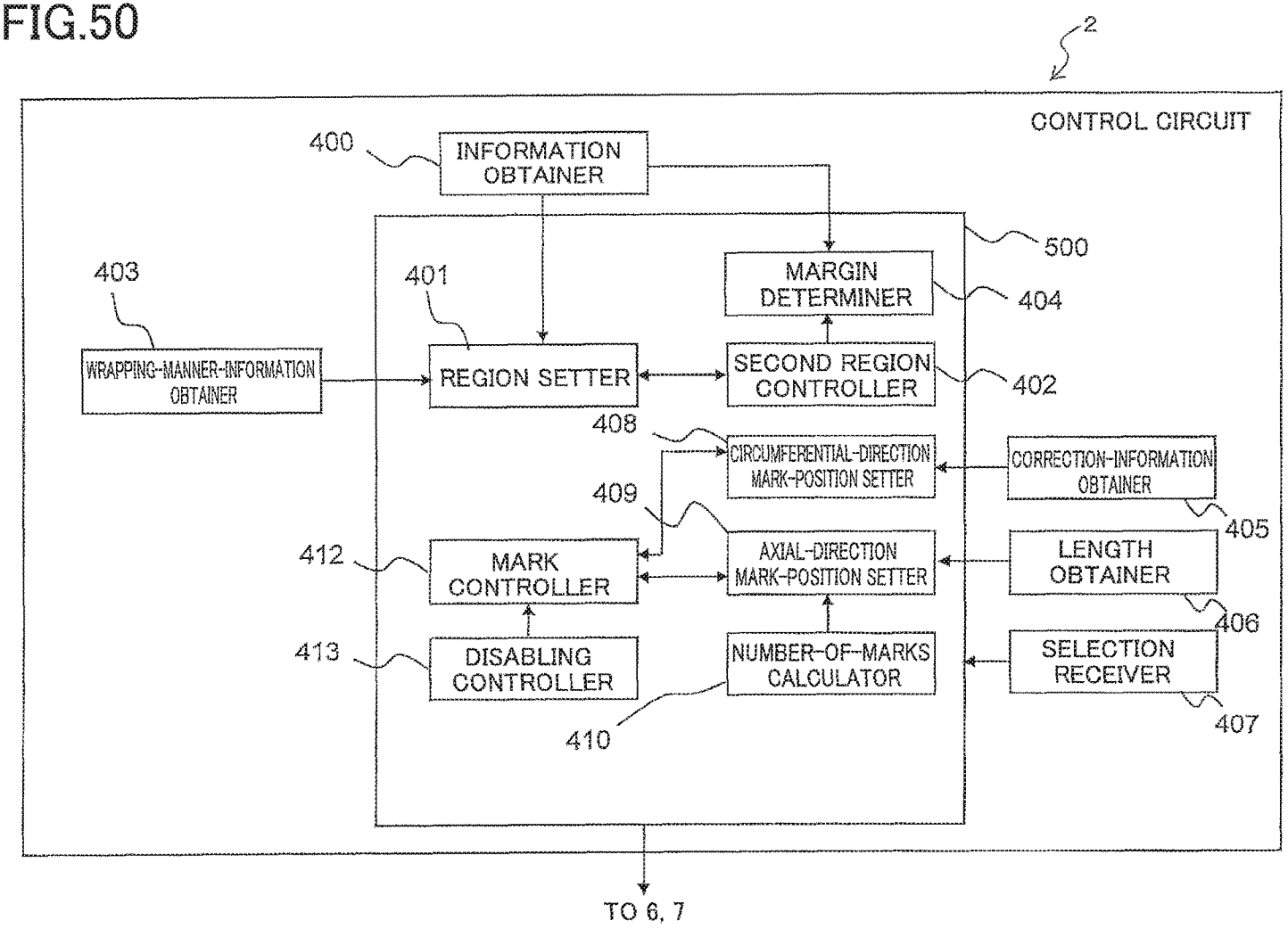
FIG. 50 is a block diagram illustrating a functional configuration of a control circuit.

There will be next explained a configuration and a control procedure of the control circuit 2 for achieving the above-described functions in the present embodiment. FIG. 50 illustrates a functional configuration of the control circuit 2. In the present embodiment, as illustrated in FIG. 50, the control circuit 2 includes a wrapping-manner-information obtainer 403 in addition to the controller 500, the information obtainer 400, the correction-information obtainer 405, the length obtainer 406, and the selection receiver 407 provided in the first embodiment and the second embodiment.

The controller 500 includes a second region controller 402, a mark controller 412, and a disabling controller 413 in addition to the margin determiner 404, the circumferential-direction mark-position setter 408, the axial-direction mark-position setter 409, the number-of-marks calculator 410, and the region setter 401 provided in the first embodiment and the second embodiment.

The wrapping-manner-information obtainer 403 obtains wrapping-manner information indicating whether the print label L is to be wrapped in the rotatable label wrapping manner or the self-laminating wrapping manner. The wrapping manner indicated by the wrapping-manner information is input by the user via the operation device 3. That is, in the present embodiment, the user is allowed to select whether the print label L is to be wrapped in the rotatable label wrapping manner or the self-laminating wrapping manner.

The controller 500 changes control for the conveying roller 6 and the thermal head 7, depending upon whether the wrapping-manner information obtained by the wrapping-manner-information obtainer 403 indicates the rotatable label wrapping manner or the self-laminating wrapping manner. There will be explained this processing below specifically.

That is, the region setter 401 functions in the same manner as in the second embodiment based on the wrapping-manner information obtained by the wrapping-manner-information obtainer 403. In the case of the rotatable label wrapping manner, the region setter 401 sets an occupying region of the character-string printable region RA in which printing of the character strings R by the thermal head 7 is allowed, based on the outside-diameter relating information on the wrapped member 302 which is obtained by the information obtainer 400. That is, the region setter 401 sets a position, in the first direction, of the occupying region that is a region of the non-adhesive region D2*b* which is occupied by the character-string printable region RA, to a different position between the case where the obtained wrapping-manner information indicates the rotatable label wrapping manner and the case where the wrapping-manner information indicates the self-laminating wrapping manner. Specifically, in the case where the wrapping-manner information indicates the rotatable label wrapping manner, as explained with reference to FIG. 34, in the case of the alignment different from the center alignment, the position and the height (including the maximum number of lines and the maximum character size of the character strings R in the character-string printable region RA) of the one-side end of the character-string printable region RA in the first direction are set adjustably to change the position of the occupying region when compared with the case of the self-laminating wrapping manner without such setting, and in the case of the center alignment, the maximum number of lines, the maximum character size and so on of the character strings R in the character-string printable region RA are set adjustably to change the position of the occupying region when compared with the case of the self-laminating wrapping manner without such setting.

In the case where the wrapping-manner information obtained by the wrapping-manner-information obtainer 403 indicates the rotatable label wrapping manner, the second region controller 402 functions the margin determiner 404 in the same manner as in the second embodiment to reduce the length, in the second direction, of an occupying region that is a region of the printing background layer 25 which is occupied by the character-string printable region RA when compared with the case where the wrapping-manner information indicates the self-laminating wrapping manner. Specifically, in the case where the obtained wrapping-manner information indicates the rotatable label wrapping manner, as explained with reference to FIG. 15, in the case where the outside diameter of the wrapped member 302 is less than or equal to the predetermined value assumed in advance, the second region controller 402 increases the length of each of the margin regions RS when compared with the case where the outside diameter of the wrapped member 302 is greater than the predetermined value, to reduce the occupying region of the character-string printable region RA when compared with the case of the self-laminating wrapping manner without such setting.

In the case of the rotatable label wrapping manner, the mark controller 412 functions the circumferential-direction mark-position setter 408 and the axial-direction mark-position setter 409 in the same manner as in the first embodiment. That is, the mark controller 412 controls the thermal head 7 and the conveying roller 6 to perform at least one of printing of the first marks M1 on the adhesive region D1 or the non-adhesive region D2*a* and printing of the second marks M2 on the partly-adhesive region D3 such that each of the marks M1 and a corresponding one of the marks M2 are arranged in a line in the first direction. The disabling controller 413 executes control based on the wrapping-manner information obtained by the wrapping-manner-information obtainer 403. That is, in the case where the obtained wrapping-manner information indicates the self-laminating wrapping manner, the disabling controller 413 disables the function of the mark controller 412. In the case where the obtained wrapping-manner information indicates the rotatable label wrapping manner, the disabling controller 413 does not disable the function of the mark controller 412.

Print Setting Processing

Figure 51:
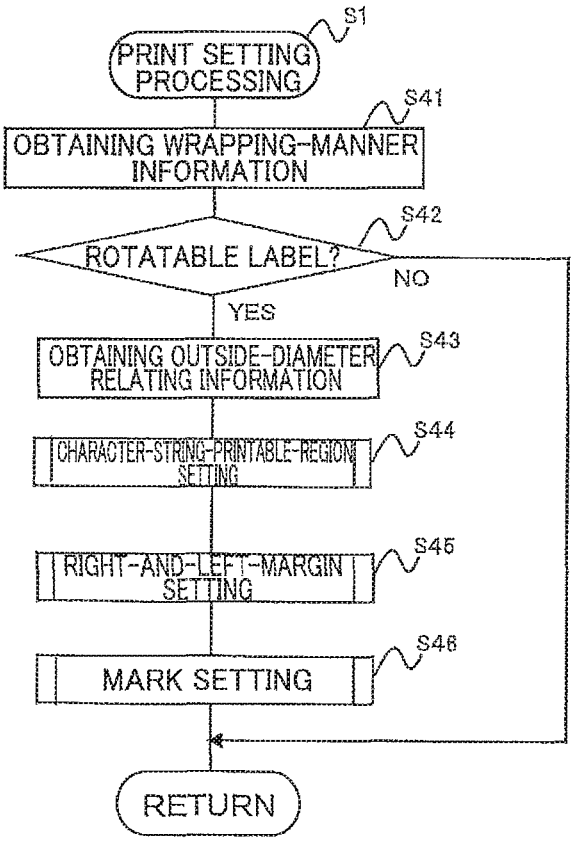
FIG. 51 is a flow chart illustrating a procedure of a print setting processing in a procedure of control executed by a CPU of the control circuit.

FIG. 51 illustrates the print setting processing executed by the CPU of the control circuit in the present embodiment to achieve the above-described technique. FIG. 51 corresponds to FIG. 14. As illustrated in FIG. 51, in the present embodiment, the wrapping-manner-information obtainer 403 of the control circuit 2 at S41 obtains the wrapping-manner information indicating whether the print label L is to be wrapped in the rotatable label wrapping manner or the self-laminating wrapping manner.

The disabling controller 413 of the control circuit 2 at S42 determines whether the wrapping-manner information obtained at S41 indicates the rotatable label wrapping manner. When the wrapping-manner information obtained at S41 does not indicate the rotatable label wrapping manner (S42: NO), this procedure ends, and the flow returns to S5 in FIG. 13 without execution of processings at S43, S44, S45, and S46. In this case, in particular, skipping the processing at S46 corresponds to disabling of the function by the mark controller 412. When the wrapping-manner information obtained at S41 indicates the rotatable label wrapping manner (S42: YES), this flow goes to S43 similar to that in FIGS. 14 and 33.

As in the first and second embodiments, the information obtainer 400 of the control circuit 2 at S43 obtains the outside-diameter relating information on the wrapped member 302 (the outside diameter of the wrapped member 302 or the module number, the type, or the like corresponding to the outside diameter) which is manually input via the operation device 3, for example.

At S44 similar to that in FIG. 33, the region setter 401 of the control circuit 2, as in the second embodiment, executes the character-string-printable-region setting processing (see FIG. 34) for adjustably setting the character-string printable region RA based on the outside-diameter relating information obtained at S43.

At S45 similar to that in FIG. 14, the second region controller 402 and the margin determiner 404 of the control circuit 2, as in the first embodiment, executes the right-and-left-margin setting processing to determine the length of each of the margin regions RS in the second direction, based on the outside-diameter relating information obtained at S43 (see FIG. 15).

At S46 similar to that in FIG. 14, the mark controller 412, the circumferential-direction mark-position setter 408, the axial-direction mark-position setter 409, and the number-of-marks calculator 410 of the control circuit 2 execute the mark setting processing for the marks M1, M2 (see FIG. 17) as in the first embodiment. Upon completion of this processing, this procedure ends, and the flow returns to S5 in FIG. 13.

Effects in Third Embodiment

In the present embodiment as described above, control of the controller 500 of the control circuit 2 for controlling the conveying roller 6 and the thermal head 7 is changed depending upon whether the wrapping-manner information indicates the rotatable label wrapping manner or the self-laminating wrapping manner. This change enables the controller to execute control appropriate for each wrapping manner, resulting in improved convenience to the user.

In the present embodiment, in particular, the occupying region of the character-string printable region RA is different between the case of the rotatable label wrapping manner and the case of the self-laminating wrapping manner. This processing makes it possible to reliably cover the character strings R on the portion of the print label L in the non-adhesive region D2*b* with the portion of the print label L in the partly-adhesive region D3 as described above, for example.

In the present embodiment, in particular, only in the case of the rotatable label wrapping manner, control of the circumferential-direction mark-position setter 408 and the axial-direction mark-position setter 409 by the mark controller 412 is effectively executed, thereby creating the print label L with the first marks M1 and the second marks M2 arranged such that each of the marks M1 and a corresponding one of the marks M2 are arranged in a line in the first direction (see FIG. 3, for example). As a result, it is possible to prevent misalignment and skew of the print label L as described above.

In the present embodiment, in particular, in the case where the wrapping-manner information indicates the rotatable label wrapping manner, the second region controller 402 reduces the length, in the second direction, of the occupying region that is a region of the printing background layer 25 which is occupied by the character-string printable region RA, when compared with the case where the wrapping-manner information indicates the self-laminating wrapping manner. This reduction prevents the character strings R formed in the character-string printable region RA from being hidden by the marks M1, M2 in the above-described wrapping, resulting in reduction in amount of lowering of the viewability.

In the above-described explanation, one example of the stickability is adhesion (adhesiveness) of the adhesive of the adhesive layer 22, but the present disclosure is not limited to this configuration. For example, the present disclosure may use various structures including: a pressure pseudo-adhesive structure which is used for, e.g., postcards and in which a pseudo-adhesive portion of the label cannot be stuck once peeled; and a structure in which portions of the label are stuck to each other by static electricity like a resin sheet used for, e.g., wrapping. For example, the pseudo-adhesive material may have such a property that the material is wet before sticking, and once dried and peeled, the material cannot be stuck again.

It is noted that the first mark M1 and the second mark M2 may have different shapes. FIG. 52 illustrates examples of shapes after sticking of the first mark M1 and the second mark M2 having different shapes. In the case where the first mark M1 is a white circle with a black border, and the second mark M2 is a solid black circle smaller than the first mark M1, when the two marks M1, M2 overlap each other by the above-described sticking, the small black circle can be viewed within the white circle, making it easy for the user to recognize the overlapping state.

In the case where the first mark M1 is a solid black circle, and the second mark M2 is a solid black circle smaller than the first mark M1, when the two marks M1, M2 overlap each other by the above-described sticking, the small solid black circle is hidden by the large solid black circle, making it easy for the user to recognize the overlapping state (that is, overlapping is proper if the second mark M2 is not located off the first mark M1).

In the case where the first mark M1 is a cross, and the second mark M2 is a cross formed by rotating the first mark M1 by 45 degrees, when the two marks M1, M2 overlap each other by the above-described sticking, the two crosses form an asterisk with a lateral line, making it easy for the user to recognize the overlapping state.

In the case where the first mark M1 is a solid black square, and the second mark M2 is a solid black square smaller than the first mark M1, when the two marks M1, M2 overlap each other by the above-described sticking, the small solid black square is hidden by the large solid black square, making it easy for the user to recognize the overlapping state (that is, overlapping is proper if the second mark M2 is not located off the first mark M1).

While the terms "the same", "equal", "different", and the like are used for dimensions and sizes in external appearance in the above-described explanation, these terms are not strictly used. That is, tolerance and error in design and manufacture are allowed, and "same", "equal", and "different" may be respectively interpreted as "substantially the same", "substantially equal", and "substantially different".

Each arrow in FIGS. 1, 12, 18, 32, 45, and 50 indicates one example of a flow of signals and does not limit a direction or directions of the flow of the signals.

Each flow chart in FIGS. 13-15, 17, 21, 33, 34, 46, and FIG. 51 may be modified without departing from the spirit and scope of the disclosure. For example, a processing or processings may be added to or deleted from the flow chart, and the order of the processings in the flow chart may be changed.

The techniques in the above-described embodiments and the modifications may be combined as needed.

The present disclosure is not limited to the details of the illustrated embodiments and modifications, but may be embodied with various changes and modifications, which may occur to those skilled in the art, without departing from the spirit and scope of the disclosure.

What is claimed is:

1. A printing apparatus, comprising:

a conveyor configured to convey a medium comprising a transparent base layer and a separation layer stacked on each other in a stacking direction, the medium further comprising a printing background layer;

a printer configured to print a character on the medium conveyed by the conveyor; and a controller configured to control the conveyor and the printer, wherein the controller is configured to:

obtain outside-diameter relating information relating to an outside diameter of a wrapped member; and based on the obtained outside-diameter relating information, set a character printable region in which the printer is allowed to print the character on the printing background layer, wherein a plurality of regions are defined in the medium along a first direction orthogonal to the stacking direction, wherein the plurality of regions comprise (i) a first region in which a portion of the medium which is in contact with the separation layer is stickable, (ii) a second region which is located on one side of the first region in the first direction and in which a portion of the medium which is in contact with the separation layer is non-stickable, and (iii) a third region which is located on the one side of the second region in the first direction and in which at least a part of a portion of the medium which is in contact with the separation layer is stickable, wherein the controller is configured to, based on the outside-diameter relating information, set a position of a first end portion of the character printable region and a position of a second end portion of the character printable region, wherein the first end portion is located on the one side of the character printable region in the first direction, and the second end portion is located on the other side of the character printable region in the first direction, wherein a length of the third region in the first direction is greater than a length of the first region in the first direction, and wherein the controller is configured to set the position of the second end portion such that the position of the second end portion when the outside diameter of the wrapped member is less than a first outside diameter is nearer to the one side in the first direction than the position of the second end portion when the outside diameter of the wrapped member is greater than or equal to the first outside diameter and less than or equal to a second outside diameter that is greater than the first outside diameter.

2. The printing apparatus according to claim 1, wherein the controller is configured to set a maximum value of the number of lines of characters printable in the character printable region, such that the maximum value when the outside diameter of the wrapped member is less than a first outside diameter is less than the maximum value when the outside diameter of the wrapped member is greater than or equal to the first outside diameter and less than or equal to a second outside diameter that is greater than the first outside diameter.

3. The printing apparatus according to claim 2, further comprising a second storage configured to store a relationship between the outside-diameter relating information and the maximum value of the number of lines of characters.

4. The printing apparatus according to claim 1, wherein the controller is configured to set a maximum value of a font of the character printable in the character printable region, such that the maximum value when the outside diameter of the wrapped member is less than a first outside diameter is less than the maximum value when the outside diameter of the wrapped member is greater than or equal to the first outside diameter and less than or equal to a second outside diameter that is greater than the first outside diameter.

5. The printing apparatus according to claim 4, further comprising a third storage configured to store a relationship between the outside-diameter relating information and the maximum value of the font of the character.

6. The printing apparatus according to claim 1, wherein the controller is configured to set the position of the first end portion to an identical position in the first direction between when the outside diameter of the wrapped member is less than a first outside diameter and when the outside diameter of the wrapped member is greater than or equal to the first outside diameter and less than or equal to a second outside diameter that is greater than the first outside diameter.

7. The printing apparatus according to claim 1, wherein the controller is configured to set a central position of the character printable region in the first direction to an identical position in the first direction between when the outside diameter of the wrapped member is less than a first outside diameter and when the outside diameter of the wrapped member is greater than or equal to the first outside diameter and less than or equal to a second outside diameter that is greater than the first outside diameter.

8. The printing apparatus according to claim 1, further comprising a first storage configured to store a relationship between the outside-diameter relating information and end-portion-relating information relating to the position of the first end portion and the position of the second end portion.

9. A printing apparatus, comprising:

a conveyor configured to convey a medium comprising a transparent base layer and a separation layer stacked on each other in a stacking direction, the medium further comprising a printing background layer;

a printer configured to print a character on the medium conveyed by the conveyor; and a controller configured to control the conveyor and the printer, wherein the controller is configured to:

obtain outside-diameter relating information relating to an outside diameter of a wrapped member; and based on the obtained outside-diameter relating information, set a character printable region in which the printer is allowed to print the character on the printing background layer, wherein a plurality of regions are defined in the medium along a first direction orthogonal to the stacking direction, wherein the plurality of regions comprise (i) a first region in which a portion of the medium which is in contact with the separation layer is stickable, (ii) a second region which is located on one side of the first region in the first direction and in which a portion of the medium which is in contact with the separation layer is non-stickable, and (iii) a third region which is located on the one side of the second region in the first direction and in which at least a part of a portion of the medium which is in contact with the separation layer is stickable, wherein the controller is configured to, based on the outside-diameter relating information, set a position of a first end portion of the character printable region and a position of a second end portion of the character printable region, wherein the first end portion is located on the one side of the character printable region in the first direction, and the second end portion is located on the other side of the character printable region in the first direction, wherein a length of the third region in the first direction is greater than a length of the first region in the first direction, and wherein the controller is configured to set the position of the first end portion such that the position of the first end portion when the outside diameter of the wrapped member is greater than a second outside diameter that is greater than a first outside diameter is nearer to the other side in the first direction than the position of the first end portion when the outside diameter of the wrapped member is greater than or equal to the first outside diameter and less than or equal to the second outside diameter.

10. The printing apparatus according to claim 9, wherein the controller is configured to set a maximum value of the number of lines of characters printable in the character printable region, such that the maximum value when the outside diameter of the wrapped member is greater than a second outside diameter that is greater than a first outside diameter is less than the maximum value when the outside diameter of the wrapped member is greater than or equal to the first outside diameter and less than or equal to the second outside diameter.

11. The printing apparatus according to claim 10, further comprising a second storage configured to store a relationship between the outside-diameter relating information and the maximum value of the number of lines of characters.

12. The printing apparatus according to claim 9, wherein the controller is configured to set a maximum value of a font of the character printable in the character printable region, such that the maximum value when the outside diameter of the wrapped member is greater than a second outside diameter that is greater than a first outside diameter is less than the maximum value when the outside diameter of the wrapped member is greater than or equal to the first outside diameter and less than or equal to the second outside diameter.

13. The printing apparatus according to claim 12, further comprising a third storage configured to store a relationship between the outside-diameter relating information and the maximum value of the font of the character.

14. The printing apparatus according to claim 9, wherein the controller is configured to set the position of the second end portion to an identical position in the first direction between when the outside diameter of the wrapped member is greater than a second outside diameter that is greater than a first outside diameter and when the outside diameter of the wrapped member is greater than or equal to the first outside diameter and less than or equal to the second outside diameter.

15. The printing apparatus according to claim 9, wherein the controller is configured to set a central position of the character printable region in the first direction to an identical position in the first direction between when the outside diameter of the wrapped member is greater than a second outside diameter that is greater than a first outside diameter and when the outside diameter of the wrapped member is greater than or equal to the first outside diameter and less than or equal to the second outside diameter.

16. The printing apparatus according to claim 9, further comprising a first storage configured to store a relationship between the outside-diameter relating information and end-portion-relating information relating to the position of the first end portion and the position of the second end portion.

17. A printing apparatus, comprising:

a conveyor configured to convey a medium comprising a transparent base layer and a separation layer stacked on each other in a stacking direction, the medium further comprising a printing background layer;

a printer configured to print a character on the medium conveyed by the conveyor; and a controller configured to control the conveyor and the printer, wherein the controller is configured to:

obtain outside-diameter relating information relating to an outside diameter of a wrapped member; and based on the obtained outside-diameter relating information, set a position of the character in a character printable region in which the printer is allowed to print the character on the printing background layer, wherein a plurality of regions are defined in the medium along a first direction orthogonal to the stacking direction, wherein the plurality of regions comprise (i) a first region in which a portion of the medium which is in contact with the separation layer is stickable, (ii) a second region which is located on one side of the first region in the first direction and in which a portion of the medium which is in contact with the separation layer is non-stickable, and (iii) a third region which is located on the one side of the second region in the first direction and in which at least a part of a portion of the medium which is in contact with the separation layer is stickable, wherein the controller is configured to, based on the outside-diameter relating information, set a character aligned position in the character printable region in the first direction, wherein a length of the third region in the first direction is greater than a length of the first region in the first direction, and wherein the controller is configured to set the character aligned position such that the character aligned position when the outside diameter of the wrapped member is less than a first outside diameter is nearer to the one side in the first direction than the character aligned position when the outside diameter of the wrapped member is greater than or equal to the first outside diameter.

18. The printing apparatus according to claim 17, wherein the controller is configured to set the character aligned position such that the character aligned position when the outside diameter of the wrapped member is greater than a second outside diameter that is greater than a first outside diameter is nearer to the other side in the first direction than the character aligned position when the outside diameter of the wrapped member is greater than or equal to the first outside diameter and less than or equal to the second outside diameter.

19. The printing apparatus according to claim 17, further comprising a fourth storage configured to store a relationship between the outside-diameter relating information and the character aligned position.

20. A printing apparatus, comprising:

a conveyor configured to convey a medium comprising a transparent base layer and a separation layer stacked on each other in a stacking direction, the medium further comprising a printing background layer;

a printer configured to print a character on the medium conveyed by the conveyor; and a controller configured to control the conveyor and the printer, wherein the controller is configured to:

obtain outside-diameter relating information relating to an outside diameter of a wrapped member; and based on the obtained outside-diameter relating information, set a position of the character in a character printable region in which the printer is allowed to print the character on the printing background layer, wherein a plurality of regions are defined in the medium along a first direction orthogonal to the stacking direction, wherein the plurality of regions comprise (i) a first region in which a portion of the medium which is in contact with the separation layer is stickable, (ii) a second region which is located on one side of the first region in the first direction and in which a portion of the medium which is in contact with the separation layer is non-stickable, and (iii) a third region which is located on the one side of the second region in the first direction and in which at least a part of a portion of the medium which is in contact with the separation layer is stickable, wherein the controller is configured to, based on the outside-diameter relating information, set a character aligned position in the character printable region in the first direction, wherein a length of the third region in the first direction is greater than a length of the first region in the first direction, and wherein the controller is configured to set the character aligned position such that the character aligned position when the outside diameter of the wrapped member is greater than a second outside diameter that is greater than a first outside diameter is nearer to the other side in the first direction than the character aligned position when the outside diameter of the wrapped member is greater than or equal to the first outside diameter and less than or equal to the second outside diameter.

21. The printing apparatus according to claim 20, wherein a length of the third region in the first direction is greater than a length of the first region in the first direction, and wherein the controller is configured to set the character aligned position such that the character aligned position when the outside diameter of the wrapped member is less than a first outside diameter is nearer to the one side in the first direction than the character aligned position when the outside diameter of the wrapped member is greater than or equal to the first outside diameter.

22. The printing apparatus according to claim 20, further comprising a fourth storage configured to store a relationship between the outside-diameter relating information and the character aligned position.

* * * * *